US005651235A

United States Patent [19]

Ashley et al.

[11] Patent Number: 5,651,235

[45] Date of Patent: Jul. 29, 1997

[54] PACKAGING METHOD AND APPARATUS

[75] Inventors: Robert John Ashley, Oxfordshire, United Kingdom; Lodewyk Johannes Claessen, Heemskerk, Netherlands; Trevor John Colby, Hertfordshire, United Kingdom; Ian Flude, Oxfordshire, United Kingdom; Eric Charles Hopson, Wiltshire, United Kingdom; Simon Murray, Cambridgeshire, United Kingdom; Andrew Philip Pavely, Wiltshire, United Kingdom; Timothy James Pitcher, Berkshire, United Kingdom

[73] Assignee: Odin Developments Limited, Stevenage, United Kingdom

[21] Appl. No.: 162,141

[22] PCT Filed: Jun. 15, 1992

[86] PCT No.: PCT/GB92/01067

§ 371 Date: Jun. 13, 1994

§ 102(e) Date: Jun. 13, 1994

[87] PCT Pub. No.: WO92/22460

PCT Pub. Date: Dec. 23, 1992

[30] Foreign Application Priority Data

Jun. 15, 1991 [GB] United Kingdom ..... 9112964

[51] Int. Cl.[6] ..... B65B 3/02; B65B 3/04; B65B 7/28

[52] U.S. Cl. ..... 53/458; 53/471; 53/488; 53/489; 53/202; 53/282; 53/543; 53/563

[58] Field of Search ..... 53/563, 282, 202, 53/426, 471, 307, 310, 312, 543, 458, 488, 489; 426/399; 141/99, 169, 237

[56] References Cited

U.S. PATENT DOCUMENTS

| | | | |
|---|---|---|---|
| Re. 32,074 | 1/1986 | Bennet | 141/169 |
| 1,476,737 | 12/1923 | Strout . | |
| 1,774,401 | 8/1930 | Quade et al. | 53/202 X |
| 1,838,797 | 12/1931 | Towy . | |
| 2,356,021 | 8/1944 | Wilckens | 259/75 |
| 2,371,419 | 3/1945 | Bergman | 53/202 X |
| 2,404,232 | 7/1946 | Hunter | 53/202 X |
| 2,801,650 | 8/1957 | Breeback | 141/169 X |
| 3,009,300 | 11/1961 | Johansson | 53/95 |
| 3,249,206 | 5/1966 | Mumma | 198/170 |
| 3,270,903 | 9/1966 | Wilms | 214/308 |
| 3,561,740 | 2/1971 | Bergstrom | 229/43 |
| 3,566,575 | 3/1971 | Lisiecki | 53/426 |
| 3,628,307 | 12/1971 | Croasdale et al. | 53/307 |
| 3,874,740 | 4/1975 | Hurd | 302/31 |
| 4,073,372 | 2/1978 | List | 53/282 X |
| 4,313,476 | 2/1982 | Bennett et al. | 141/169 X |
| 4,590,734 | 5/1986 | Ueda | 53/563 X |
| 4,604,850 | 8/1986 | Reil | 53/563 X |
| 4,790,123 | 12/1988 | Ljungstrom et al. | 53/202 X |
| 4,866,907 | 9/1989 | Iuchi et al. | 53/307 X |
| 4,930,289 | 6/1990 | Fransson et al. | 53/251 |
| 5,069,021 | 12/1991 | Reil et al. | 53/202 X |
| 5,230,203 | 7/1993 | Wu et al. | 53/282 X |

FOREIGN PATENT DOCUMENTS

| | | | |
|---|---|---|---|
| 490498 | 8/1949 | Belgium . | |
| 0274280 | 7/1988 | European Pat. Off. | B65B 7/28 |
| 1371343 | 7/1964 | France . | |
| 7707520 | 1/1978 | Netherlands | B65D 5/70 |
| 422746 | 1/1935 | United Kingdom . | |
| 1062431 | 3/1967 | United Kingdom . | |
| 2098570 | 5/1982 | United Kingdom | B65B 5/10 |

*Primary Examiner*—Horace M. Culver

*Attorney, Agent, or Firm*—Reising, Ethington, Barnard & Perry

[57] ABSTRACT

In a system of packaging of foodstuffs in containers (12), each container (12) has a closure of aluminium/LDPE laminate formed with a central tear panel (322) which either has a pull-tab (402) rivetted thereto or is connected to a pull-tab (321) at an, edge of the closure (1) by a narrow tear strip (323) extending up, over and down the rim of the container (12). The closures (1) are conveyed in horizontal positions pneumatically from a closure-manufacturing machine towards a downwardly inclined, vibrating, tranpsort box (110) and tilted pneumatically into vertical positions as they approached the box (110) for stacking in the box (110). On a packaging machine, the box (110) is pointed obliquely downwards and emptied by vibration to cause the closures (1) to slide from the box (110) onto a downwardly and then upwardly inclined guide surface ready for transfer to the containers (12) Bottom-closed containers (12) advance side-by-side in rows (235, 236) which are divided into rows (231–234) for filling and top-closing. The dividing mechanism (118) includes transverse belts (249) which can grip the containers (12) horizontally between them and can laterally outwardly reject faulty containers (12). The dividing mechanism is followed by an unloading device (119) comprising suction cups (278) mounted upon a modified "Watt" linkage converting rotary drive motion into approximately rectilinear motion of the cups (278), the linkage having no exposed sliding surfaces. The containers (12) are advanced through the filling and top-closing stations by a chain conveyor (68) with leading and trailing bars (296 and 292) resiliently gripping the containers (12) between them and with lower trailing bars (299) pushing lower portions of the container (12). Horizontal guide members (300, 301) guiding the bars (299) and the containers (12) are vertically adjustable, to adjust for containers (12) of various heights. A discharge belt conveyor (70) has lanes (231–234) for approved top-closed containers (12) alternating with reject lanes (311) into which selected containers (12) can be rejected by inclined rejecting plates (317).

33 Claims, 35 Drawing Sheets

PACKAGING METHOD AND APPARATUS

TECHNICAL FIELD

This invention relates to the packaging of various substances, especially foodstuffs, in closed containers.

BACKGROUND ART

A variety of systems are known for packaging foodstuffs in closed containers and a few of the known systems will now be described.

For packaging solid foodstuffs, for example cakes, it is known to use lidded boxes formed from cardboard blanks, the lids either being made integral with or separate from the box, by being folded from the box blanks or being folded from lid blanks separate from the box blanks. It is alternatively known to mould paperboard, plastics, or metal foil, to form solid-foodstuff-receiving trays which may have one or more receiving compartments, and then to wrap the foodstuffs and the trays in plastics or metal foil.

For packaging liquid foodstuffs, where fluid-tightness is important, it is known to fit paperboard or plastics lids in a fluid-tight manner on cups of plastics or paperboard, the paperboard having at least at its inside a liquid-tight layer, for example a thermoplastics relatively impervious to the liquid foodstuff. It is known alternatively to fold a paperboard blank coated on at least one side with a liquid-impervious layer into the form of a side-and-bottom-sealed open-topped carton, with that one side, at the inside of the carton, and then to fill and top-seal the carton.

EP-A-0274280 discloses a system of packaging of foodstuffs in containers of rectangular horizontal section. The containers are formed by folding and side-and bottom-sealing blanks of paperboard coated on both sides with thermoplastics. Each open-topped container is sterilized, filled, and closed with a sterilized closure. The closure is of a laminate including a thermoplastics layer of sufficient thickness to fill an internal discontinuity of the container mouth during heat-sealing of the closure to the container. In making the closure, a portion of laminate is partially severed to form a flap and the laminate is clamped around the flap and drawn to form a shallow dish, to the inside of the base of which is heat-sealed a diaphragm including a pull tab. The thermoplastics layer of the closure is on a reflective metal layer and incorporates infrared-absorbing particles and infrared-reflective particles. Among the drawn zones are transverse rectangular slots which facilitate drawing of the laminate material without splitting, in spite of the sharp corners of the rectangular shape of each drawn zone. However, the presence of the slots can result in undesired deformation of the material among the slots on drawing, because of insufficient support for the material bounding the slots.

GB-A-998242 discloses an apparatus for turning match books which are being transferred one after another from a book-match-making machine to a packing station. A guideway connects the output of the machine to a turning chamber and an endless chain advances the match books in line along the guideway to a guide which maintains the match books upright in a vertical position. Above the guide is a microswitch the movable contact of which depends into an opening in the guide. After the match books have been advanced to a position under the guide, they are clamped, one-by-one, by a feeding slide which rapidly advances them past the microswitch, thereby to operate the same, to the turning chamber, in which they are turned into horizontal positions by means of jets of compressed air, after which they are ejected by a plunger into an arcuate chute forming a downwards continuation of the turning chamber. The compressed air jets are provided by four pairs of nozzles, two pairs arranged one above the other at one side of the turning chamber and the other two pairs arranged one above the other at the opposite side of the turning chamber, the four nozzles at the one side being directly opposite the respective four nozzles at the opposite side. Since the match books have a profile which is wedge-shaped, every second match book is turned in a sense opposite to that in which the other match books are turned, thereby ensuring that the match books stack horizontally in a vertical stack. Such turning is achieved by so timing the jets from the nozzles that simultaneous jets from the upper pair of nozzles at the one side and the lower pair at the opposite side, to turn one match book about a central horizontal axis thereof clockwise, say, to a horizontal position are followed by simultaneous jets from the lower pair of nozzles at the one side and the upper pair at the opposite side, to turn the next match book about a central horizontal axis thereof anti-clockwise, say, to a horizontal position. This apparatus is relatively complicated and requires very accurate timing of release of the match books by the feeding slide and production of the Jets from the nozzles.

GB-A-1112243 discloses an apparatus for grouping bags, containing stockings for example, inside an open-topped rectangular container. A belt conveyor drops the bags into a chute obliquely inclined at its upper end but curving downwards to its substantially vertical lower end, whence the bags, while vertical, drop vertically into the container, which is horizontal. The bags are held vertically in position in the container by a vertical plate which is carried by a rod suspended from a roller running on a sloping rail and which is retractable from a filled container. The bags are dropped into each container adjacent one end wall, which is formed with holes through which horizontal pusher pins are introduced to push each dropped bag in turn along the container to join the row of already dropped bags therein. As the bag is pushed along to join the row, its upper edge is forced to pass under a nose of a curved guide sheet and its lower edge is forced to pass over a boss at the beginning of transverse corrugations formed on the bottom of the container. Once a container is filled, it is advanced horizontally away by a chain conveyor and an empty container is brought into position beneath the chute. This apparatus includes relatively complicated mechanisms for advancing the dropped bags along the horizontal container and maintaining them vertical therein.

U.S. Pat. No. 2,356,021 discloses an apparatus for oscillating a rectangular receptacle, containing small, lightweight articles, such as container caps or closures, about a horizontal axis below the middle of the receptacle. Two receptacles are mounted side-by-side upon respective rectangular frames tiltable about that axis by respective vertical, shaking, piston-and-cylinder devices, in order to settle the articles in the receptacles.

U.S. Pat. No. 3,270,903 discloses a system for handling empty lightweight plastics bottles and particularly for removing such bottles from shipping or storage containers. A belt conveyor advances the containers in turn onto a platform which is apertured at its front section and mounted upon a horizontal pivot at its rear section. At the front of the platform is an eccentric formed so as to oscillate the platform longitudinally of the pivot and about the pivot, simultaneously, in order to vibrate the entire platform sufficiently to jar loose any bottles which might tend to stick in the carton and thus to ensure that they fall through the apertures at the front section into chutes, whence they are conveyed to a filling machine.

GB-A-654617 discloses a conveyor for cartons, in which the cartons are advanced by being gripped between two flat endless belts moving around vertical rollers.

U.S. Pat. No. 4,313,476 discloses a filling machine for filling containers with a quick-drying fluid product by the use of a bank of filling nozzles. The machine includes two substantially parallel filling channels which are formed in part by two separate conveyors, a vacuum filling mechanism connected with the filling nozzles, a support for the filling nozzles, a mechanism for lowering and raising the nozzle support and therewith the filling nozzles into and out of containers held stationary under the filling nozzles, an indexing mechanism for determining the correct number of containers to be filled at the same time in a respective channel during a given filling operation while the associated conveyor is stationary and the containers being filled are held stationary in their filling positions, a reciprocating mechanism for the nozzle support alternately to place the filling nozzles over the containers to be filled in one channel and after completion of the filling operation to move the nozzle support over the other channel to fill the containers which have been brought into filling position in the meantime in the other channel, and a control system for operating the filling machine. This machine requires a large number, for example a dozen, containers to be filled simultaneously, otherwise it becomes very inefficient owing to the time taken to traverse the bank of nozzles to-and-fro between the two channels.

GB-A-1062431 discloses a machine for use in packaging articles, such as leaflets, in cartons, comprising an endless conveyer the flights of which are spaced apart to receive cartons between them and are arranged to advance the cartons along stationary carton support, wherein the conveyer flights are distributed on two different parallel bands of the conveyer in arrangement such that the flights on one band define the leading extremities of conveyer carton-pockets while those on the other band define the trailing extremities of the pockets, wherein the two conveyer bands are relatively adjustable longitudinally to vary the conveyer flight spacings, and wherein the conveyer is elevationally adjustable with respect to the carton support. The machine receives the careens, in a collapsed flat-folded condition, in a magazine having a bottom guide surface downwardly inclined, at a decreasing gradient, to a restricted opening through which the collapsed cartons are pulled, one-by-one, by a suction cup arrangement, relying upon the flexibility of the cartons. A similar magazine and suction-cup arrangement, but for use with container lids, is disclosed in U.S. Pat. No. 4,122,649.

U.S. Pat. No. 1,476,737 discloses a package-conveying system including a conveying belt and a package feeler which, when the number of packages on the belt is normal, intermittently swings freely between the packages but, when there is an excess number of packages on the belt, is obstructed by a package and immediately sets into operation a normally inactive package pusher disposed upstream thereof and effective when actuated to remove successively the packages from the belt until such time as the number of packages on the belt has been restored to normal, whereupon the pusher is automatically thrown out of operation, and the feeler resumes its normal action.

U.S. Pat. No. 3,249,206 discloses an egg-handling machine including a chain conveyor for egg containers. The chain conveyor includes two parallel endless chains running on sprockets with horizontal axes of rotation. Extending transversely between the two chains are a plurality of horizontal pivot rods upon which are mounted a plurality of impellers having vertical leading walls and serving to impel the egg containers. Alternating with the impellets are carton-retaining members also mounted between the two chains upon horizontal pivot rods. When the impellets are in use for impelling containers in the form of cardboard grids, the carton-retaining members occupy lowered positions beneath the level of the grids. However, when two-row cartons are to be impelled, a camming ledge extending along the chain conveyor is swung from a lowered position into a raised position and thereby comes to bear upon and move upwards rollers depending from the carton-retaining members, thus to move the carton-retaining members into raised positions in which their trailing walls are substantially vertical. The distance between the vertical surface of each impeller and the substantially vertical surface of the raised carton-retaining member ahead of that impeller is arranged to be of a proper size snugly to receive and retain a two-row carton.

Various container-conveying apparatus are known, for example from U.S. Pat. No. 3,009,300, which include linear and/or rotary sliding couplings and/or bearings in their drive and/or control linkages. Especially when such container-conveying apparatus are used in foodstuff-packaging machines, a clean-in-place method is advantageously applied to such apparatus, but such method can leave on machine surfaces extremely hard crystalline deposits from the cleaning chemicals evaporating from those surfaces. Thus, wherever the mutually sliding surfaces are exposed, the exposed portions are particularly vulnerable to wear.

U.S. Pat. No. 2,719,663 discloses a container with a rip-open flap. The container is formed of cardboard or paper and comprises a tubular body having upstanding side walls and top and bottom closures. The top closure includes a top frame with an upper surface recessed below the upper edges of the side walls and surrounded by upstanding flanges. The top closure has an opening therein and a closure flap fitting in the opening. The top closure also includes a sealing flap completely covering the upper surface and the closure flap and fitting against the flanges, the sealing flap being covered substantially throughout its underside with adhesive to be secured permanently to the closure flap and releasably to the upper surface, the sealing flap having at its front an area free of but completely surrounded by adhesive. This area includes and overlaps the front end of the closure flap. The sealing flap has an extension at its front for fitting against the adjacent upstanding flange with the ends of the extension nesting in the corners of the flanges, and a tab on the extension for fitting over the front flange to facilitate opening the sealing flap. The closure flap is made of a stronger material than the appertaining container wall, so that the closure flap, in conjunction with the sealing flap, and with the layer of adhesive between them, form a relatively rigid and firm lid that keeps its even form and positively pivots about the rear edge of the closure flap in the tearing-open operation. There is, nevertheless, a risk that the sealing flap will tear within itself in such manner that the flap is torn short.

GB-A-1535653 discloses a cuboidal liquid-packaging container made of a laminated material which comprises a base layer of paper provided on each side with a layer of plastics. For opening the container a tear-open pull-tab is provided located mainly in the top surface of the container, but extending also partially over an edge into a side surface. The pull-tab which constitutes an integral part of the material of the container is defined by a weakening or perforation line which extends through all the laminate layers. The line is substantially U-shaped, with the legs of the U on the top surface of the package, whilst the part of the line which forms the base of the U runs over the edge and onto the side surface of the container. The U is wider at its base than at its free ends. To prevent the contents in the container from leaking out through the perforations of the weakening line, a cover layer is provided underneath the tear-open pull-tab and preferably consists of a strip of suitable plastics film bonded to the inside of the laminated material in a continuous sealing zone between the edge of the cover layer and the weakening line. Since the cover layer as well as the endless seal should be impervious to fluids, the contents of the container should not leach or leak out from the perforations of the weakening line, and, conversely, penetration of air into the package through the perforations should be substantially prevented. A flexible strip of plastics may be provided between the cover layer and the laminate, located within the area defined by the sealing zone. The main pan of the flexible strip is situated underneath, and extends parallel to the edges of, the tear-open pull-tab, while a front end of the strip extends a little beyond the edge of the container. To provide an outlet for pouring out the contents of the package after breaking the weakening line and lifting the tear-open pull-tab, the strip is provided with a substantially oval opening located at a little distance inside the container edge. To allow the container to be opened in one single action, the cover layer is sealed to the underside of the tear-open pull-tab over a second sealing zone extending round the periphery of the opening, and inside the line defining the opening.

Again, there is a risk that the tear-open pull tab is torn short.

In conventional manufacture of components for beverage and other food cans, shells are formed on a primary conversion press and are then collated into stacks before being fed into a secondary conversion press where a rivet dome and button are formed prior to attachment of a preformed pull-tab. The tab manufacture and the riveting both take place in the secondary conversion press. There are two disadvantages, one being that there is double handling of the component, which can lead to damage to components of non-rigid materials,.and another that, in certain cases, location of the rivet point cannot be accurately determined.

DISCLOSURE OF INVENTION

According to a first aspect of the present invention, there is provided a method of tilting articles, comprising applying fluid to said articles to turn said articles about respective substantially horizontal axes, characterized by tilting said articles from respective substantially horizontal conditions to respective substantially vertical conditions by applying fluid to said articles so that the upward force components of the fluid upon the articles at respective edge portions of the articles are greater than those at respective opposite edge portions of the articles.

According to a second aspect of the present invention, there is provided apparatus for tilting articles, comprising means arranged to apply fluid to said articles to turn said articles about respective substantially horizontal axes, characterized in that said means so applies said fluid to said articles that the upward force components of the fluid upon the articles at respective edge portions of the articles are greater than those at respective opposite edge portions of the articles, thereby to tilt said articles from respective substantially horizontal conditions to respective substantially vertical conditions.

Owing to these aspects of the invention, the articles, which in the preferred embodiment are closures, are easily tilted, as if about respective hinges, from horizontal to vertical positions. This feature can be employed to simplify feeding of the articles and packaging thereof in containers.

According to a third aspect of the present invention, there is provided a method of unloading a container, comprising mounting said container upon a support from which a guide surface extends downwards away from a downwardly directed mouth of said container, and vibrating said container and thus an article therein to cause the article to exit from said mouth and advance down said guide surface, characterized in that said guide surface extends inclinedly downwards from said support and that said container contains a stack of articles and said articles advance down said guide surface as an inclined stack.

According to a fourth aspect of the present invention, there is provided apparatus for use in unloading a container containing an article, comprising a support arranged to support said container, a guide surface extending downwards from said support for guiding downwards said article exiting from a mouth of said container, and vibrating means arranged to vibrate said container, characterized in that said support is arranged to support said container in such a condition that said mouth of said container is directed inclinedly downwards and that said guide surface extends inclinedly downwards from said support for guiding a stack of said articles exiting from said mouth.

Owing to these aspects of the invention, a stack of articles can be unloaded smoothly and reliably from a container.

According to a fifth aspect of the present invention, there is provided a packaging method, comprising providing a row of open-topped containers one behind another, thereafter dividing the row of open-topped containers into a plurality of rows of open-topped containers, filling the open-topped containers in the plurality of rows, and subsequently closing the open tops of the containers, characterized in that the open-topped containers are formed on container-forming apparatus before said dividing occurs and in that the filling of the open-topped containers in the plurality of rows occurs in all of said plurality of rows substantially simultaneously.

According to an sixth aspect of the present invention, there is provided packaging apparatus, comprising container-conveying means including a lane which carries a row of open-topped containers and which divides into a plurality of lanes, filling means at said plurality of lanes arranged to fill a plurality of rows of said open-topped containers, and top-closing means arranged to close the open tops of the containers in said plurality of lanes, characterized in that the apparatus further comprises means at said lane arranged to form the containers of a row of open-topped containers, said filling means comprising a plurality of fillers at the respective lanes of said plurality of lanes.

Owing to these aspects of the invention, it is possible to fill and, if desired, to top-close the containers with a rate of advance or an indexing rate lower than that for the forming of the containers, giving more time for filling (and top-closing).

According to a seventh aspect of the present invention, there is provided a packaging method, including advancing containers in a row in a lane, and removing selected containers by displacing the selected containers transversely of said lane, characterized in that said advancing comprises advancing said containers in parallel rows in a system of lanes substantially parallel to each other and to said rows, and said removing comprises removing selected containers transversely of said system.

According to an eighth aspect of the present invention, there is provided packaging apparatus, comprising longitudinal container-conveying means providing a lane for advancing containers in a row, and transverse container-conveying means arranged to remove selected containers, characterized in that said longitudinal container-conveying means provides a system of substantially parallel lanes for advancing containers in rows substantially parallel to each other and to said lanes, and said transverse container-conveying means is arranged to remove selected containers transversely of said lanes.

Owing to these aspects of the invention, it is possible to improve the removal of reject containers.

According to an ninth aspect of the present invention, there is provided packaging apparatus comprising an operating member for operating upon a container, a rotary drive, and a linkage interconnecting said drive and said member and arranged to convert rotary motion of said drive into substantially rectilinear motion of an operating portion of said member, characterized in that all sliding surfaces of said linkage are substantially exclusively pairs of co-extensive annular rotary sliding surfaces.

Owing to this aspect of the invention, wear of the linkage is minimized.

According to a tenth aspect of the present invention, there is provided a method of conveying containers, comprising locating the containers between leading and trailing bars, and advancing the bars and thus the containers, characterized in that the containers are resiliently gripped between the bars.

According to an eleventh aspect of the present invention, there is provided apparatus for conveying containers, comprising leading and trailing rigid bars for receiving containers therebetween, and advancing means arranged to advance the bars and thus the containers therebetween, characterized in that biassing means is arranged to cause the bars to bear against the containers therebetween.

Owing to these aspects of the invention, the containers are more reliably held in position during their advance.

According to a twelfth aspect of the present invention, there is provided a method of weakening sheet material to form a tear path, characterized by forming a first line of weakness in first and second portions of said sheet material which portions are arranged in substantially the same plane as each other and contiguously with each other, displacing said first portion relative to said second portion to bring said first portion into a position inclined to said plane, and forming in said second portion a second line of weakness meeting, or extending to just short of, said first line of weakness.

According to a thirteenth aspect of the present invention, there is provided apparatus for weakening sheet material to form a tear path, characterized by first weakening means arranged to form a first line of weakness in first and second portions of said sheet material which portions are arranged in substantially the same plane as each other and contiguously with each other, displacing means arranged to displace said first portion relative to said second portion to bring said first portion into a position inclined to said plane, and second weakening means arranged to form, after said first line of weakness and in said second portion, a second line of weakness meeting, or extending to just short of, said first line of weakness.

According to a fourteenth aspect of the present invention, there is provided sheet material comprising first and second portions contiguous with each other, said first portion being inclined to a plane substantially containing said second portion, characterized by a first line of weakness formed in said first and second portions, and a second line of weakness formed in said second portion and meeting, or extending to just short of, said first line of weakness to form therewith a tear path.

Owing to these aspects of the invention, the risk of splitting of the sheet material along the second line of weakness during the displacing of the first portion relative to the second portion is avoided.

According to a fifteenth aspect of the present invention, there is provided a combination comprising a container and a tear-open closure closing an opening in said container, characterized in that said closure is comprised of material less readily tearable than material of said container, is adhered to said container around the inside and the outside of the rim of said opening and includes a manually seizable tab attached to a tear strip extending over said rim from the outside of said rim to the inside thereof for seizing and pulling to tear said strip from said rim.

According to a sixteenth aspect of the present invention, there is provided a combination comprising a container and a tear-open closure closing an opening in said container, characterized in that said closure includes a relatively narrow tear strip adhered to the rim of said opening and a relatively wide, manually seizable tab attached to the outer end of said tear strip.

Owing to these aspects of the invention, correct functioning of the tear strip is promoted.

According to a seventeenth aspect of the present invention, there is provided a method of producing a recess in a strip of stretchable material, characterized by forming through said strip, at intervals along said strip, slot means extending from one longitudinal edge zone of said strip towards the opposite edge zone thereof, but so as to leave relatively narrow bridge means across each slot means, and subsequently displacing out of the plane of the strip a portion of the strip between two slot means and thereby stretching said material in the regions of said two slot means and forming said recess.

According to an eighteenth aspect of the present invention, there is provided a strip of stretchable material comprising a recess therein formed by displacing a portion of said strip out of the plane of said strip, first and second slot means formed therethrough and extending from one longitudinal edge zone thereof towards the opposite edge zone thereof at respective opposite sides of said recess, characterized by first and second relatively narrow bridge means across said first and second slot means, respectively.

Owing to these aspects of the invention, it is possible to reduce the risk that the displacing of the portion of the strip out of the plane of the strip produces undesired deformation of the part of the strip between the two slot means because that part is insufficiently supported.

According to a nineteenth aspect of the present invention, there is provided a method of manufacturing tabbed shells, comprising forming bulges in a web at locations spaced apart therealong, and severing said bulges from said web to provide shells, characterized by attaching tabs to said web at said locations prior to severing said bulges as aforesaid.

According to a twentieth aspect of the present invention, there is provided apparatus for manufacturing tabbed shells, comprising bulge-forming means arranged to form bulges in a web at locations spaced apart therealong, severing means arranged to sever said bulges from said web to provide shells, and tab-applying means, characterized in that a single machine includes said bulge-forming means, said severing means and said tab-applying means.

Owing to these aspects of the present invention, it is possible to simplify the manufacture of tabbed shells and to improve its reliability.

According to a twenty-first aspect of the present invention, there is provided a packaging system, including mounting a box upon a support from which a guide surface extends downwards away from a downwardly directed mouth of said box, and vibrating said box and thus a packaging article therein to cause the article to exit from said mouth and advance down said guide surface, characterized in that said guide surface extends inclinedly downwards from said support and that said box contains a stack of packaging closures and said closures advance down said guide surface as an inclined stack.

BRIEF DESCRIPTION OF DRAWINGS

In order that the invention may be clearly understood and readily carried into effect, reference will now be made, by way of example, to the accompanying drawings, in which.

MODES FOR CARRYING OUT THE INVENTION

Figure 1:
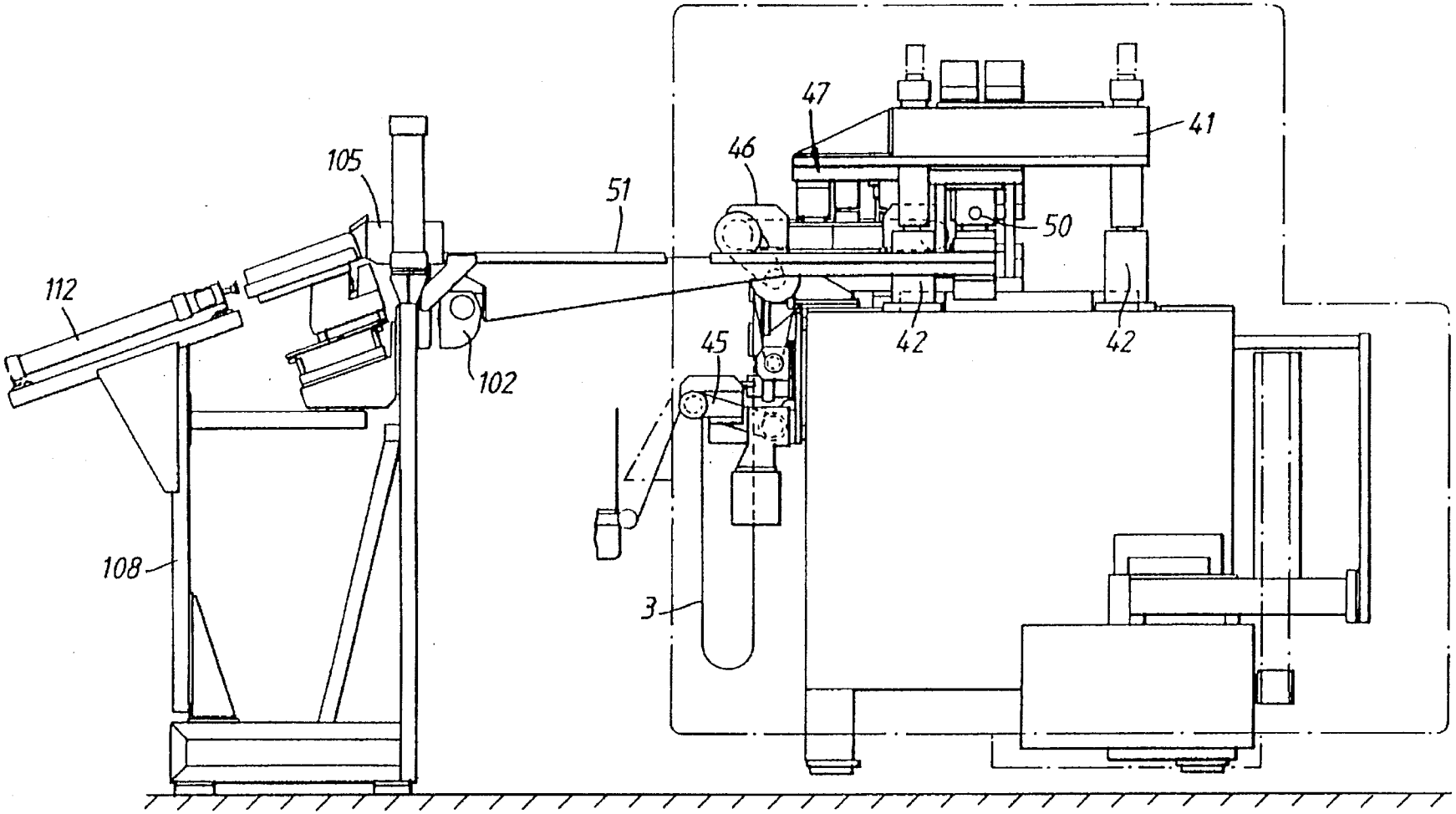
FIG. 1 shows an elevation of a machine for manufacturing container closures from sheet material, the machine constituting part of a packaging system.

The system to be described with reference to the drawings is a development of the system disclosed in our International Patent Application Publication WO88/05012 and reference may be had to that Publication for an understanding of those parts of the system not disclosed in detail herein.

The present machine for manufacturing the closures is substantially identical to the machine described with reference to FIGS. 6 to 11 of the aforesaid International Publication. However, referring to the present FIGS. 5 and 6, in the heat-sealing device 49 of that earlier machine, the diaphragm 7 has its thermoplastics layer 3C heat-sealed to the lacquer (polymer) layer 2A by means of two heat-sealing dies which have completely planar sealing faces co-extensive with the whole of the diaphragm 7. This heat-sealing has been found sometimes to be difficult to perform totally successfully, for the reason which will now be explained. If there is any space between the diaphragm 7, on the one hand, and the flap 5 and its surround, on the other hand, around the gap 6, foreign matter, such as bacteria, can penetrate into that space and may not be sterilized by the infra-red heaters 77 and 78. Therefore, the seal between the diaphragm 7, on the one hand, and the flap 5 and its surround, on the other hand, must be continuous at the gap 6, otherwise the foreign matter, after the closure 1 has been sealed to the container, may gain access to the interior of the container. In order to be sure that there was a seal right up to the gap 6 the dies of the device 49 were heated to a relatively high temperature, which caused the closure 1 to become relatively hot, so that there was an undesirable delay while it was being cooled prior to subsequent handling.

Figure 5:
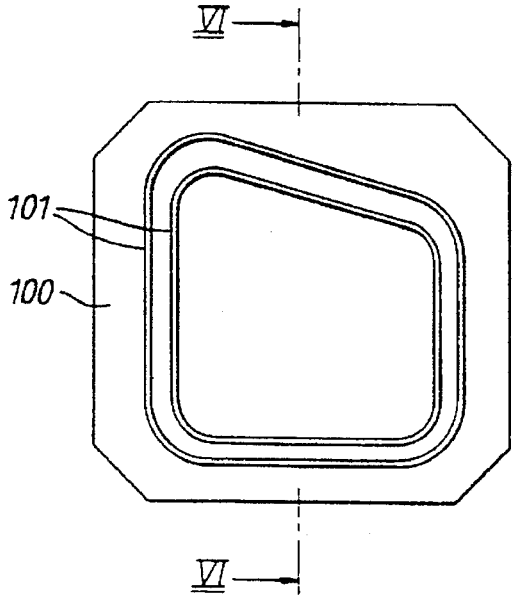
FIG. 5 shows a top plan view of a bottom anvil of a heat-sealing device for heat-sealing together a diaphragm and a laminate of the closure.
Figure 6:
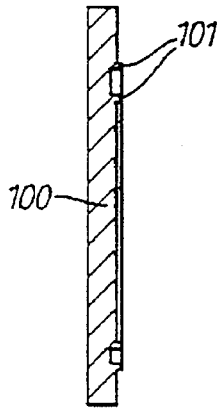
FIG. 6 shows a section taken on the line VI—VI of FIG. 5.

In order to reduce that delay, and referring to the present FIGS. 5 and 6, the bottom die 100 of the heat sealing device 49 is formed with a pair of endless beads 101 which respectively match the inside and outside profiles of the gap 6. In practice, there is a narrow margin between each bead 101 and the gap 6. However, during the heat-sealing, heat spreads outwards from each bead 6, so that the seals between the diaphragm 7, on the one hand, and the flap 5 and its surround, on the other hand, extend right up to the gap 6.

Figure 2:
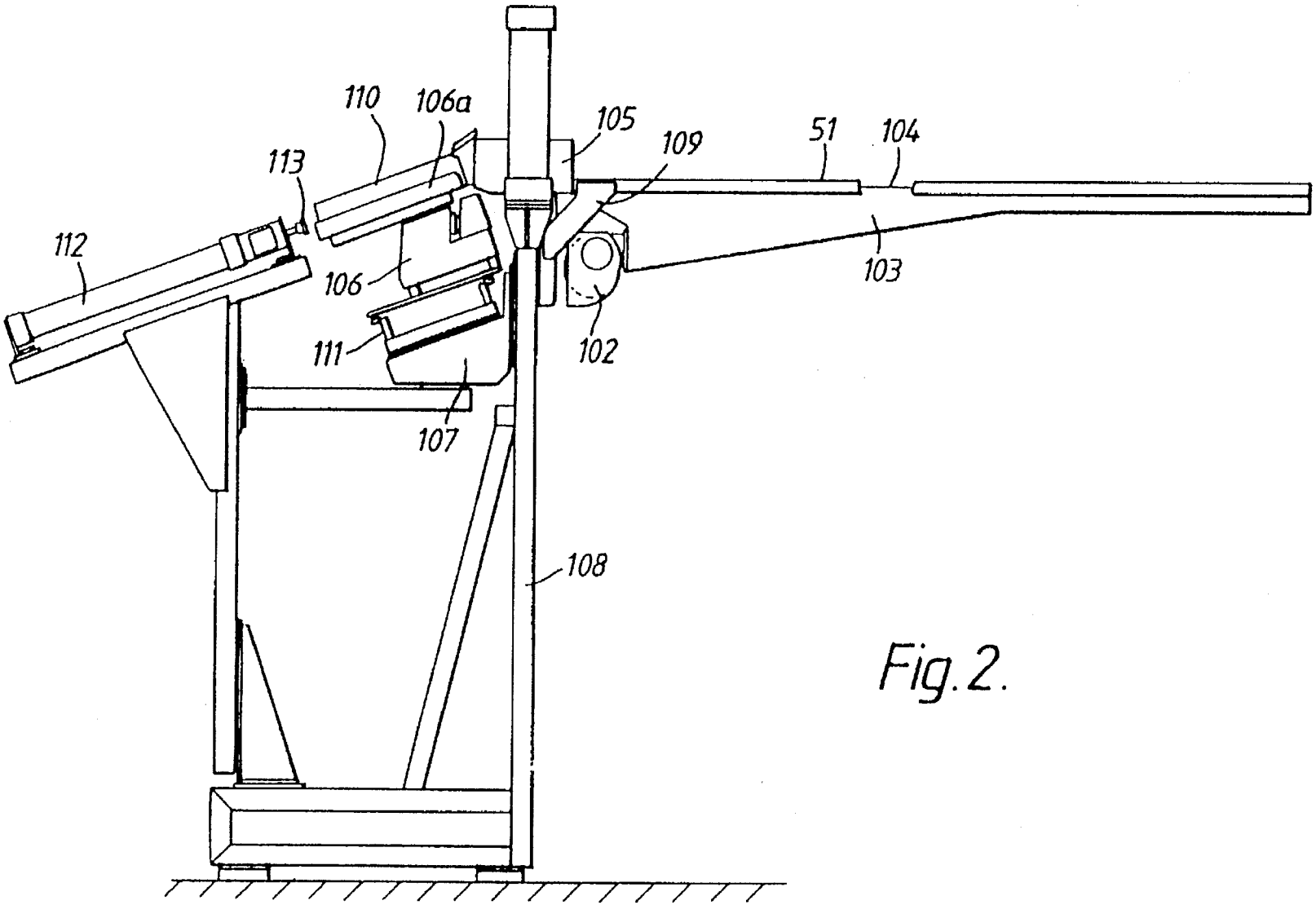
FIG. 2 shows a detail of FIG. 1.

Referring to the present FIGS. 1 and 2, FIG. 1 again shows the sheet material 3 passing through the loop control device 45 to the stepping feed device 46 and the forming and folding device 47. The press head 41 fixed upon the pillars 42 is again shown. The cropping device 50 which cuts out the individual closure 1 causes them to fall upon the discharge conveyor 51. The closures 1 are substantially horizontal as they are received by the conveyor 51 and have their polymer layers 2D lowermost. As shown in more detail in FIG. 2, the conveyor 51 is an air cushion conveyor including an air compressor 102 supplying air under pressure to a chamber 103 closed at its top by a perforated plate 104 providing a large number of small jets of air forwardly inclined to advance the closure 1 away from the closure manufacturing machine and effectively providing individual cushions of air beneath the closures. The conveyor 51 leads to an air tunnel 105 which provides an increased supply of air and thus additional air pressure to cause the closures 1 to lift at their trailing ends while still advancing, and thus flip into a vertical orientation, in other words the upward force components of the air upon the trailing edge portions of the closures 1 are greater than those upon the leading edge portions of the closures 1 and so the closures flip into a vertical orientation. The air tunnel 105 leads to a vibratory unit 106 mounted on a transverse slide 111 fixed by way of a bracket 107 to a supporting framework 108 to which the conveyor 51 is fixed by way of a bracket 109. Mounted at the top of the vibratory unit 106 is a carrier **106*a* for boxes 110 into which the closures 1 are to be stacked. The vibratory unit 106 is so mounted upon the transverse slide 111 as to be able to be shuttled to and fro transversely of the approaching line of closures 1. It supports two boxes 110 arranged in parallel with each other and is shifted across when one has been filled, to allow the empty one to begin to be filled and the filled one to be replaced by an empty box. Fixed to the framework 108 is the cylinder of a piston-and-cylinder device 112 the piston rod of which has a platform end 113 against which the first loaded closure 1 comes to rest. The piston rod can penetrate through a hole in the closed base of each box 110. By means of a level sensor which senses the height of the stack of closures 1 in the box 110** as it is being filled, the piston is progressively retracted at a controlled rate until the box is full, to provide a gradually lowering support for the closures i being filled into the box.

Figure 3:
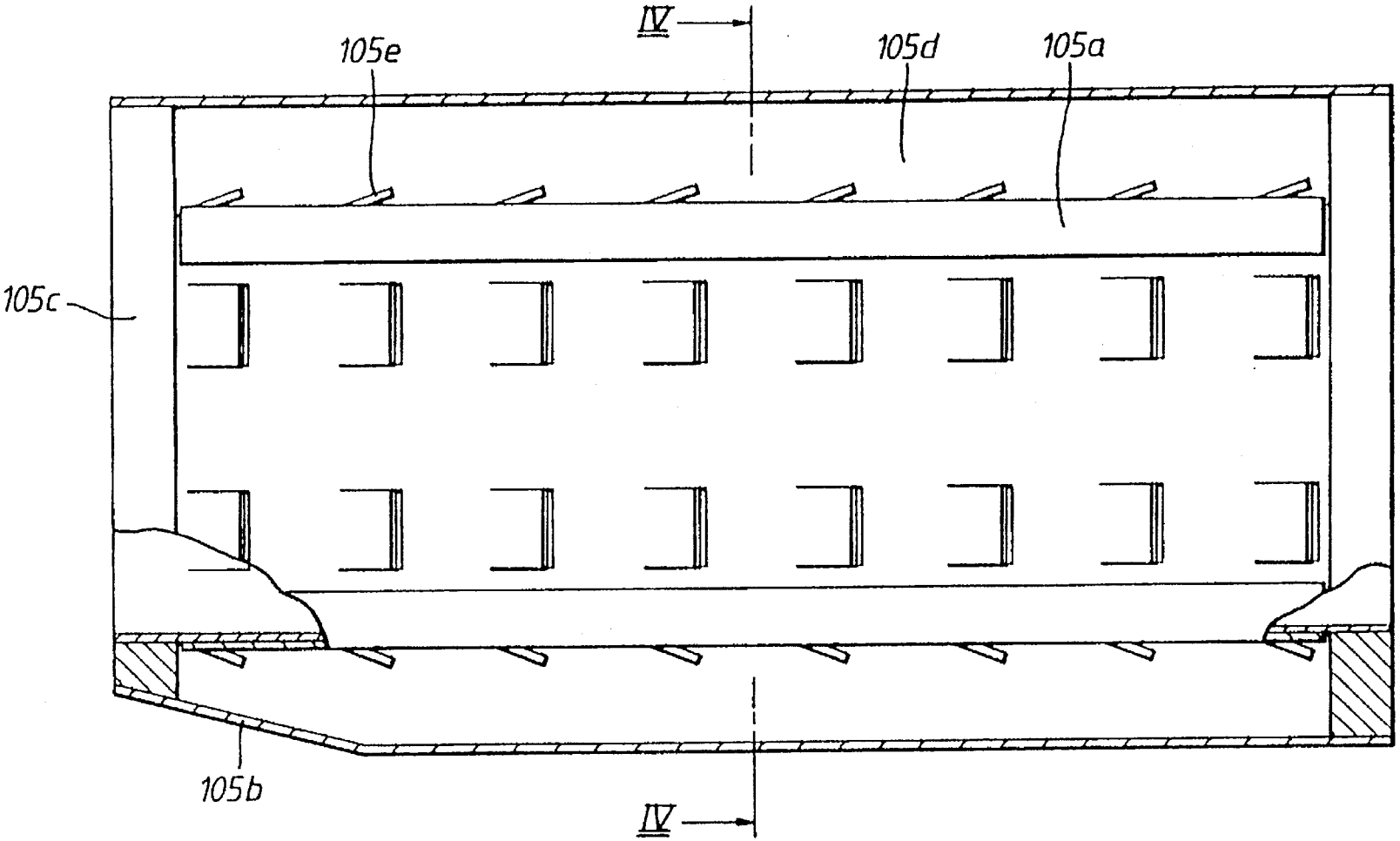
FIG. 3 shows a sectional side elevation of an air tunnel of the machine.
Figure 4:
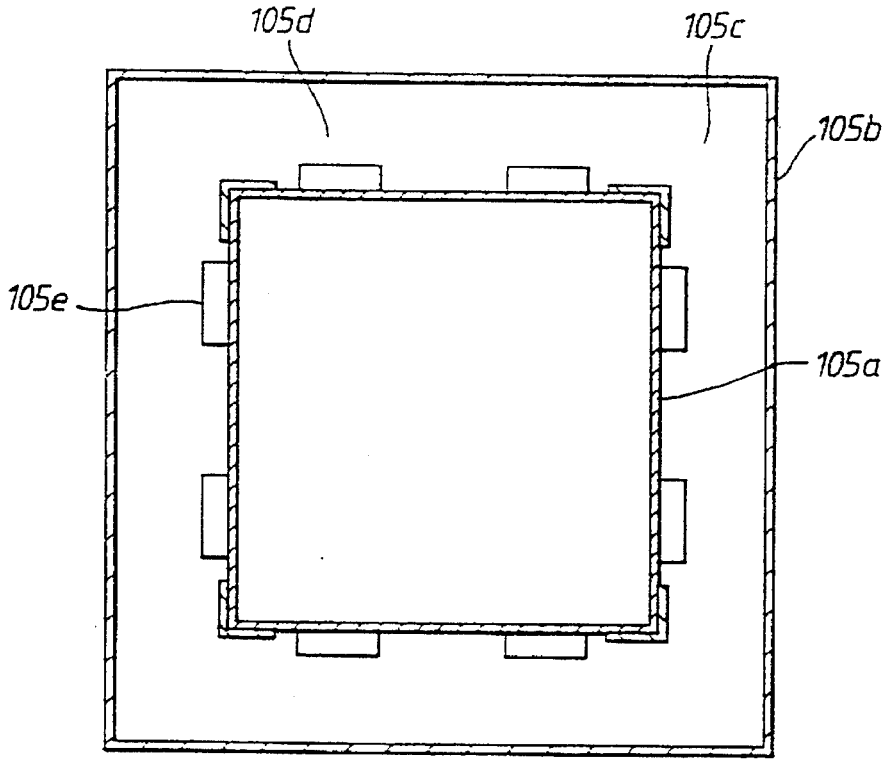
FIG. 4 shows a section taken on the line IV—IV of FIG. 3.

The air tunnel 105 is shown in more detail in FIGS. 3 and 4 and comprises a rectangular-section, horizontal tube **105*a* encircled by a rectangular-section, horizontal sleeve 105*b* and rectangular end rings 105*c* defining with the tube 105*a* an annular chamber 105*d* to which compressed air is supplied. The air flows into the interior of the tube 105*a* through angled, forwardly directed slots formed by half-piercings 105*e* in all four walls of the tube 105*a* and so provides forwardly directed jets of air from all four walls onto the closures 1 in the tunnel 105. The air flow is such that, not only do the closures continue to be advanced, but also their trailing edges are lifted and the closures are tilted into roughly upright positions, the pressure of the air jets from all four walls pushing the closures along the tunnel 105 into the box 110**.

The conveying and stacking apparatus just described with reference to FIG. 2 has been provided because we found that vertical stacking of the closures 1, which are non-nestable, was limited to stacks of about fifty. We found that beyond about fifty, the closures 1 fanned over to lie individually in a vertical plane, owing to interlocking among the closures 1. We have also found that, with the boxes 110 arranged at a significant angle to the vertical, the vibratory feed enabled the closures 1 to move relatively independently of each other. In fact, we obtained very good results with the boxes 110 nearly horizontal. We have further found that we have been able to control the lifting of the closures within the air tunnel 105 to the extent that they are blown into the box 110 while in a suitable orientation for stacking therein.

Figure 7:
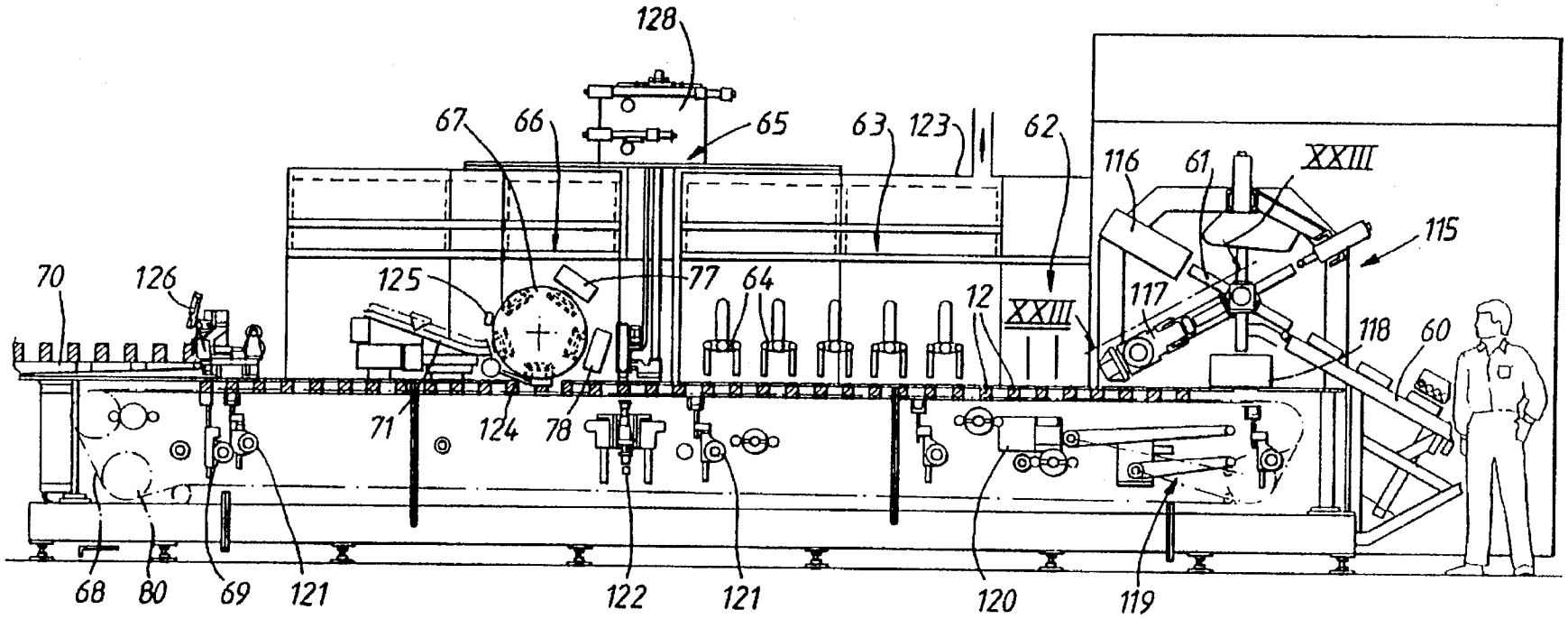
FIG. 7 shows diagrammatically a central vertical section through an aseptic packaging machine in which the closures are applied to respective containers, the machine constituting another part of the packaging system.
Figure 8:
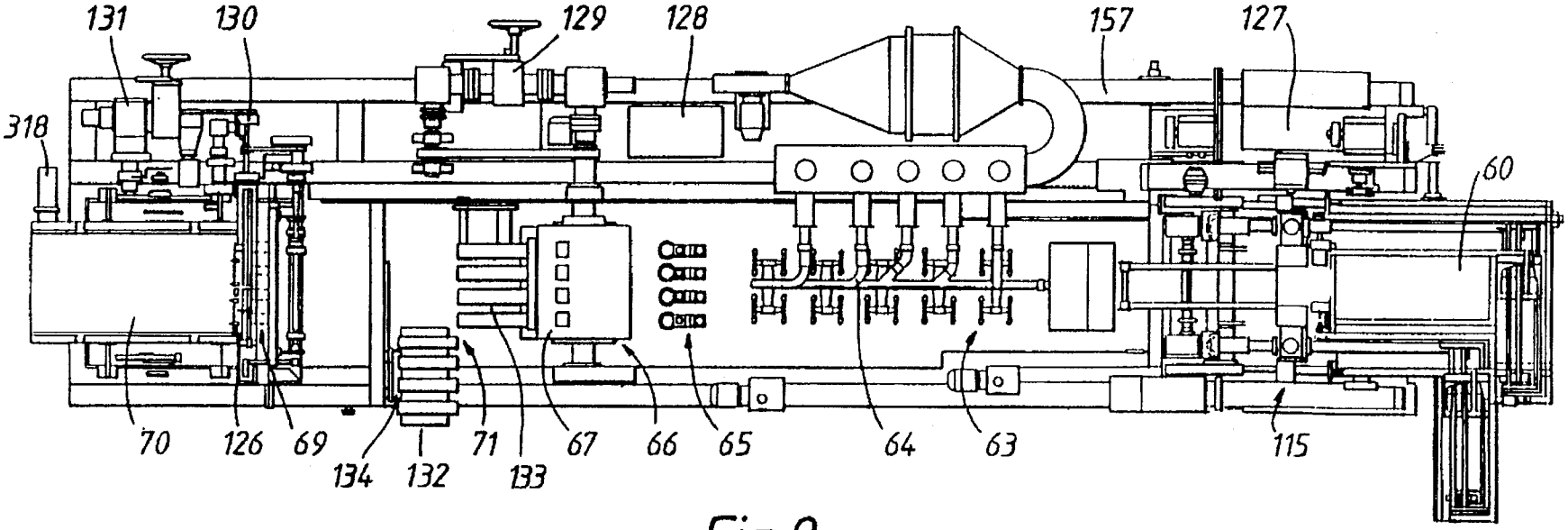
FIG. 8 shows a diagrammatic plan view of the aseptic packaging machine.
Figure 12:
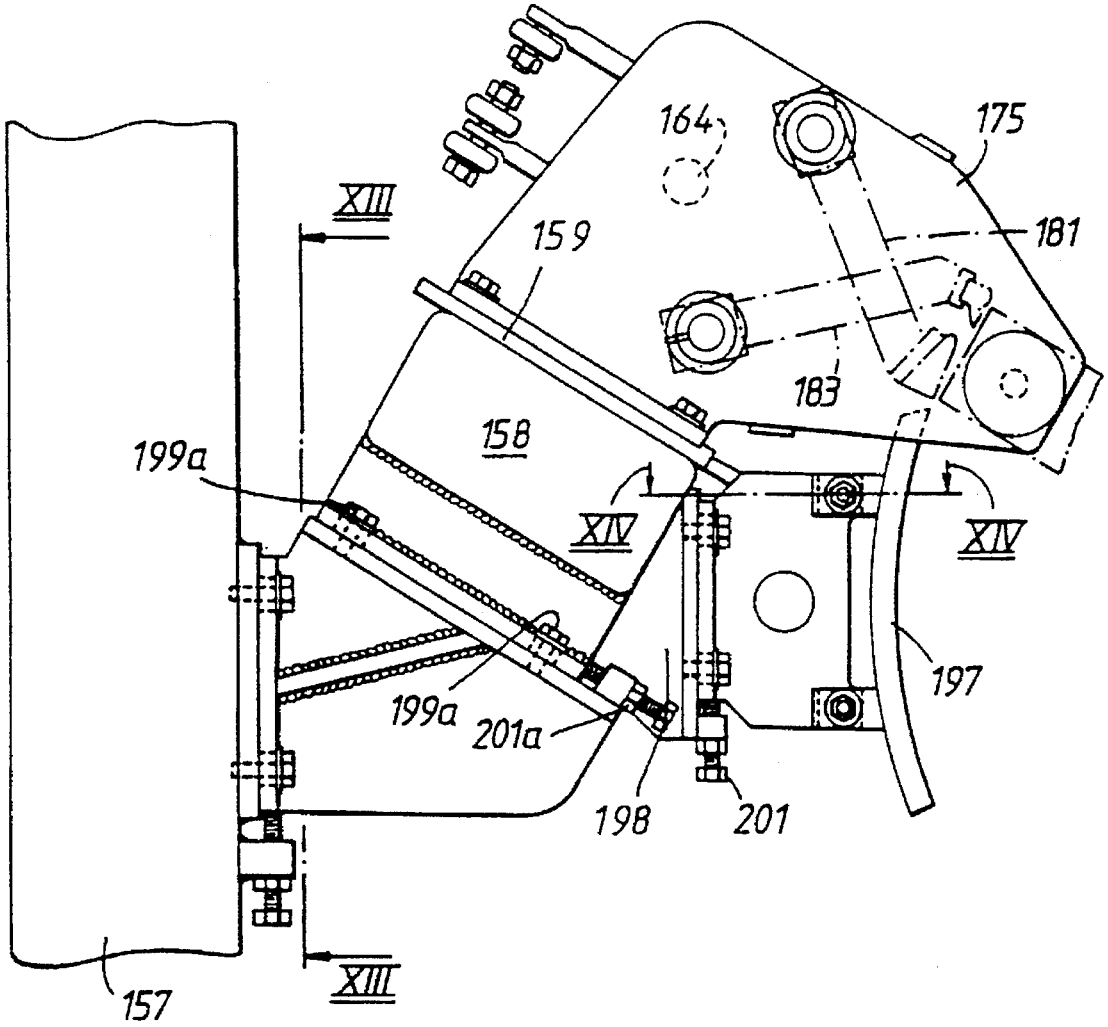
FIG. 12 shows an operator's side elevation of a bottom closure tucking device and a bottom closure retaining rail device of the aseptic packaging machine.
Figure 13:
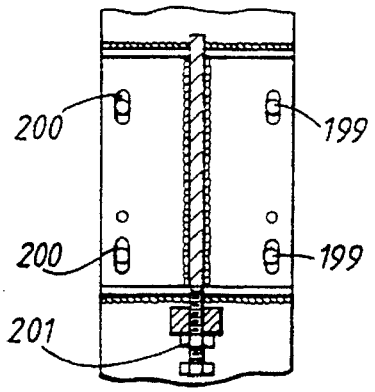
FIG. 13 shows a section taken on the line XIII—XIII of FIG. 12.
Figure 14:
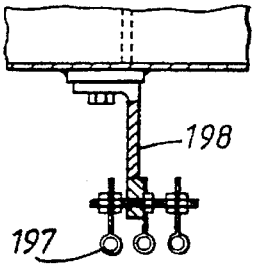
FIG. 14 shows a section taken on the line XIV—XIV of FIG. 12.
Figure 15:
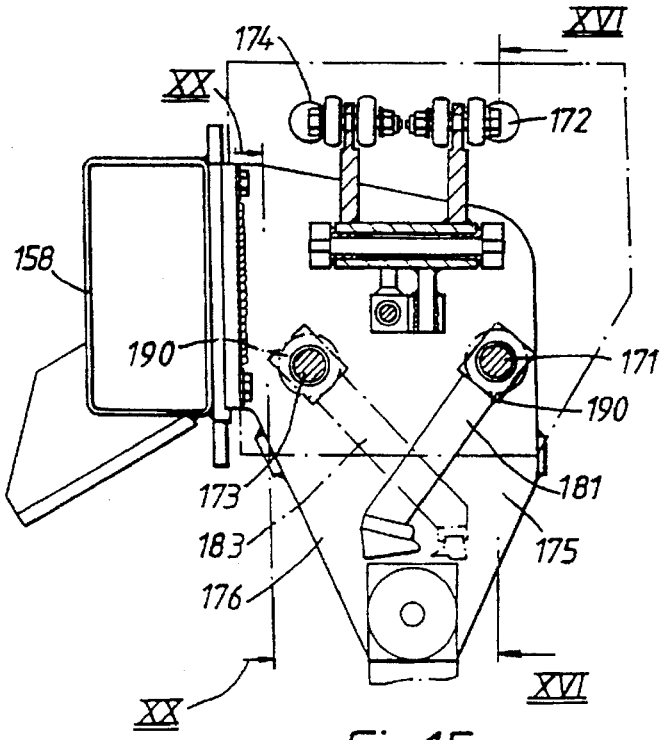
FIG. 15 is a view similar to FIG. 12 of the tucking device, but partly in section taken on the lines XV—XV of FIG. 16.
Figure 16:
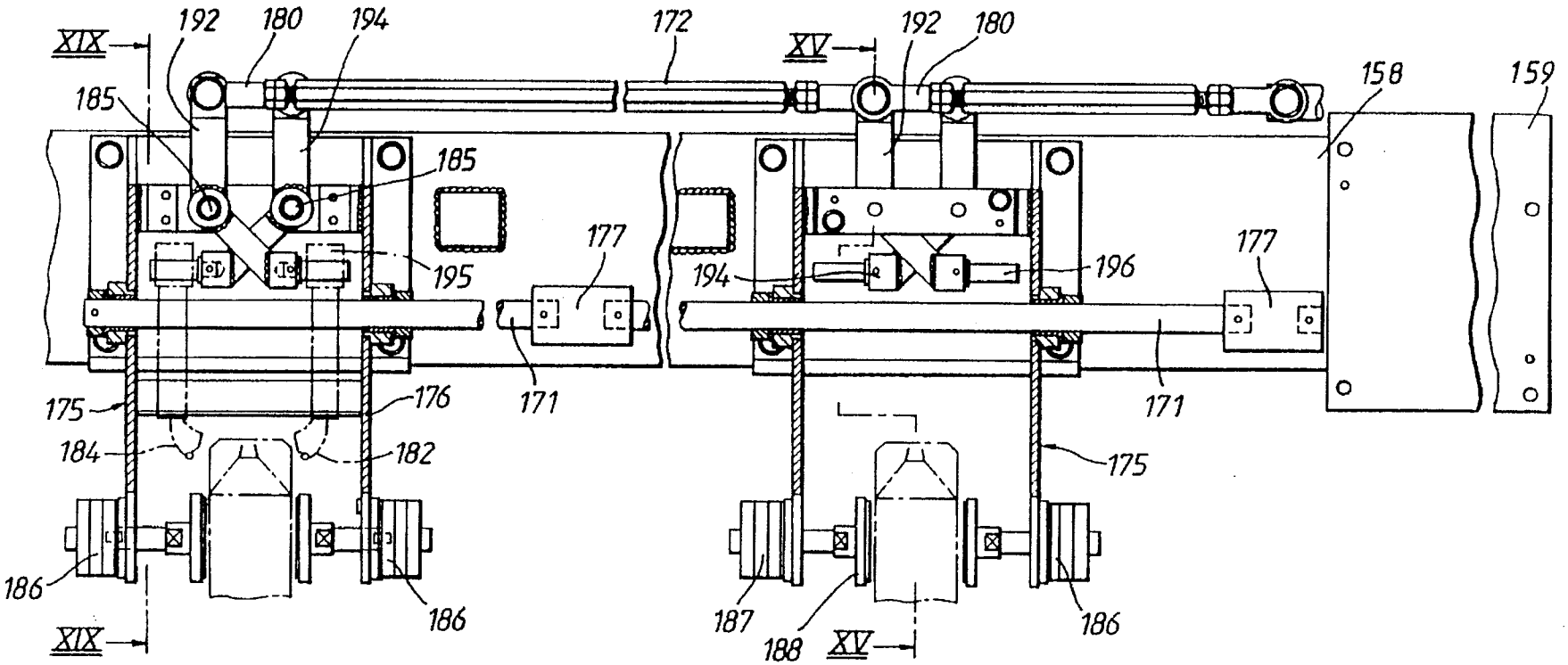
FIG. 16 is a section taken on the lines XVI—XVI of FIG. 15.
Figure 17:
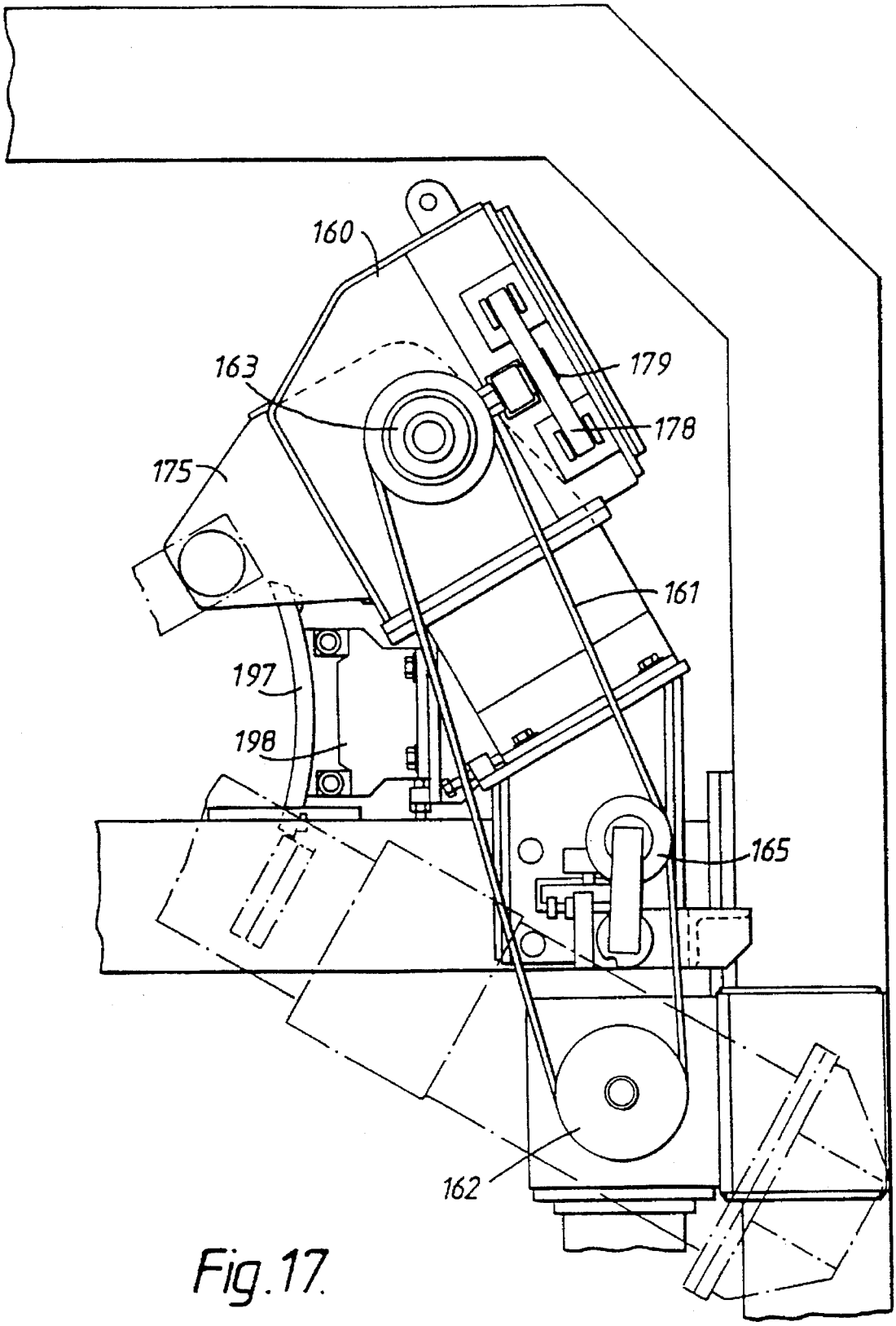
FIG. 17 is a drive side elevation of the tucking device and the retaining rail device.
Figure 18:
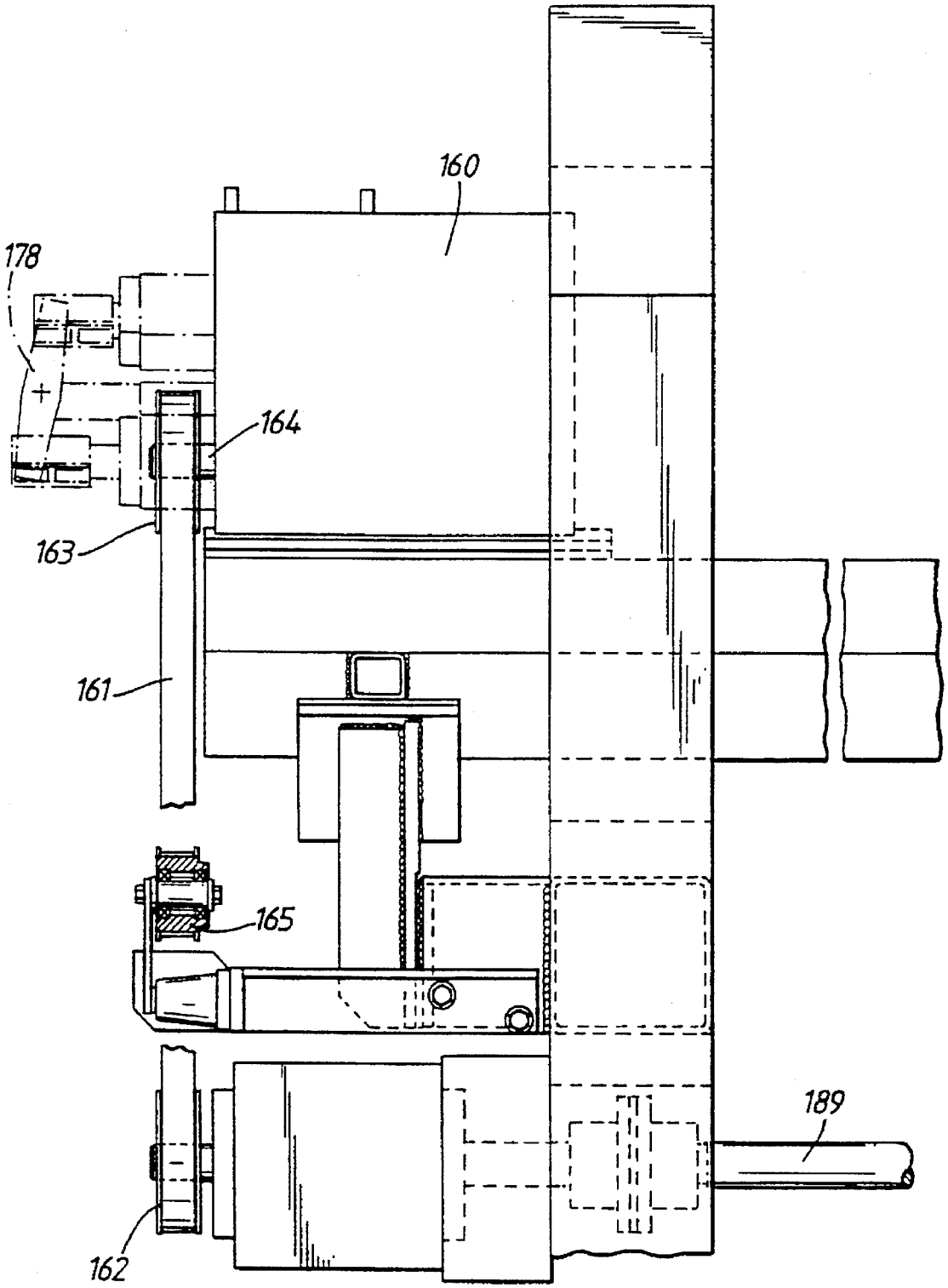
FIG. 18 shows an end elevation of the tucking device and the retaining rail device.
Figure 19:
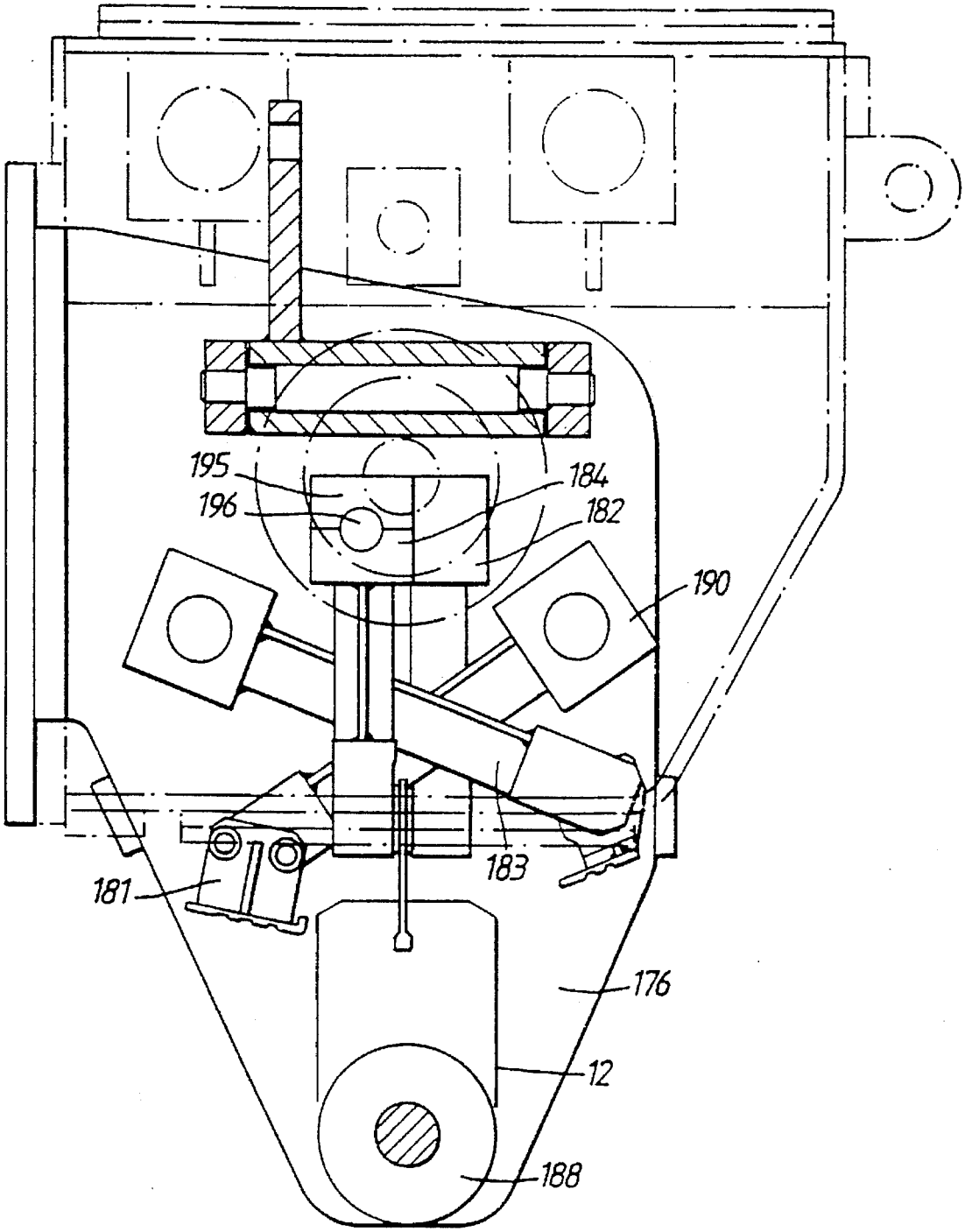
FIG. 19 is a diagrammatic view taken on the line XIX—XIX of FIG. 16.
Figure 20:
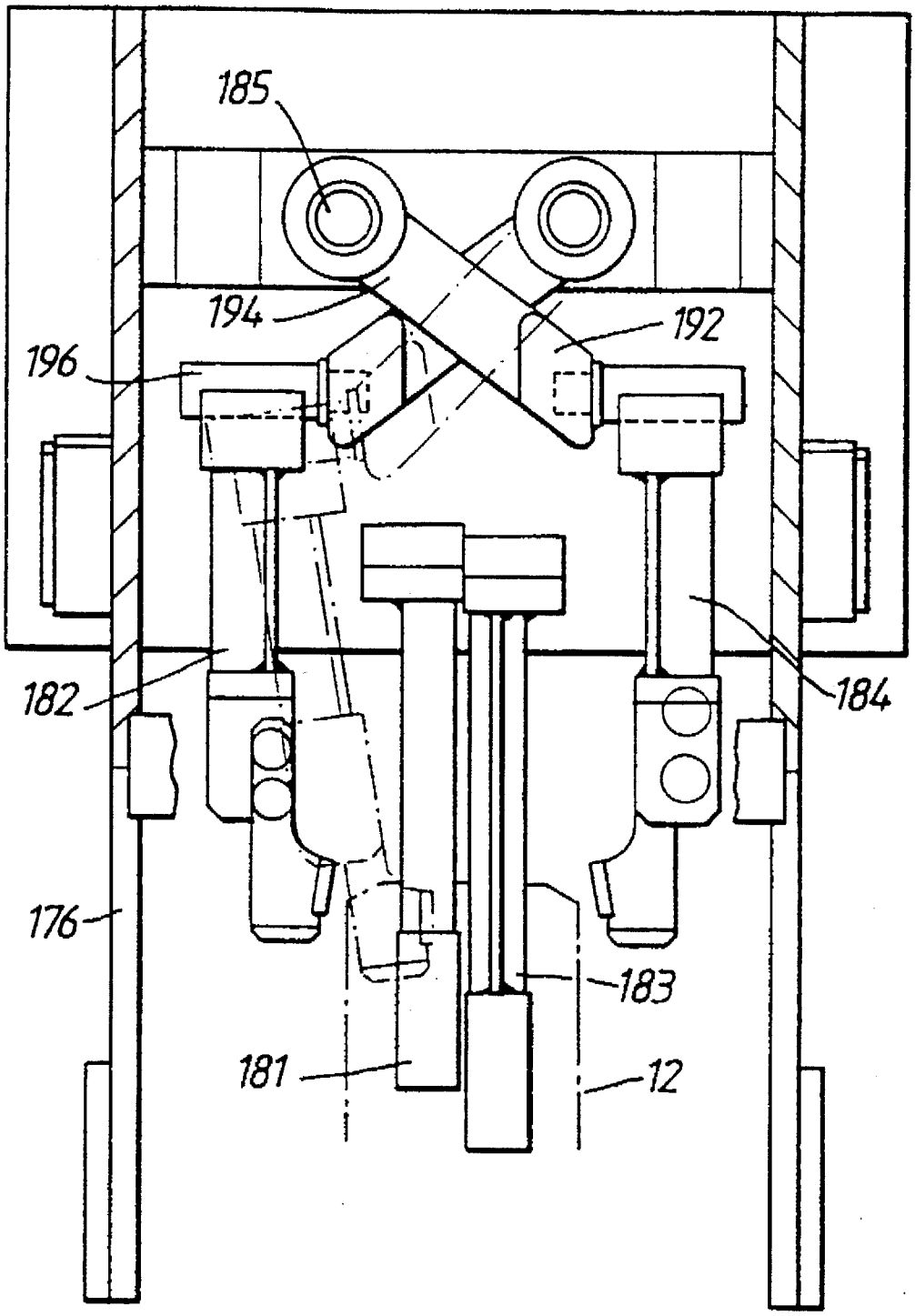
FIG. 20 is a diagrammatic view taken on the line XX—XX of FIG. 15.
Figure 21:
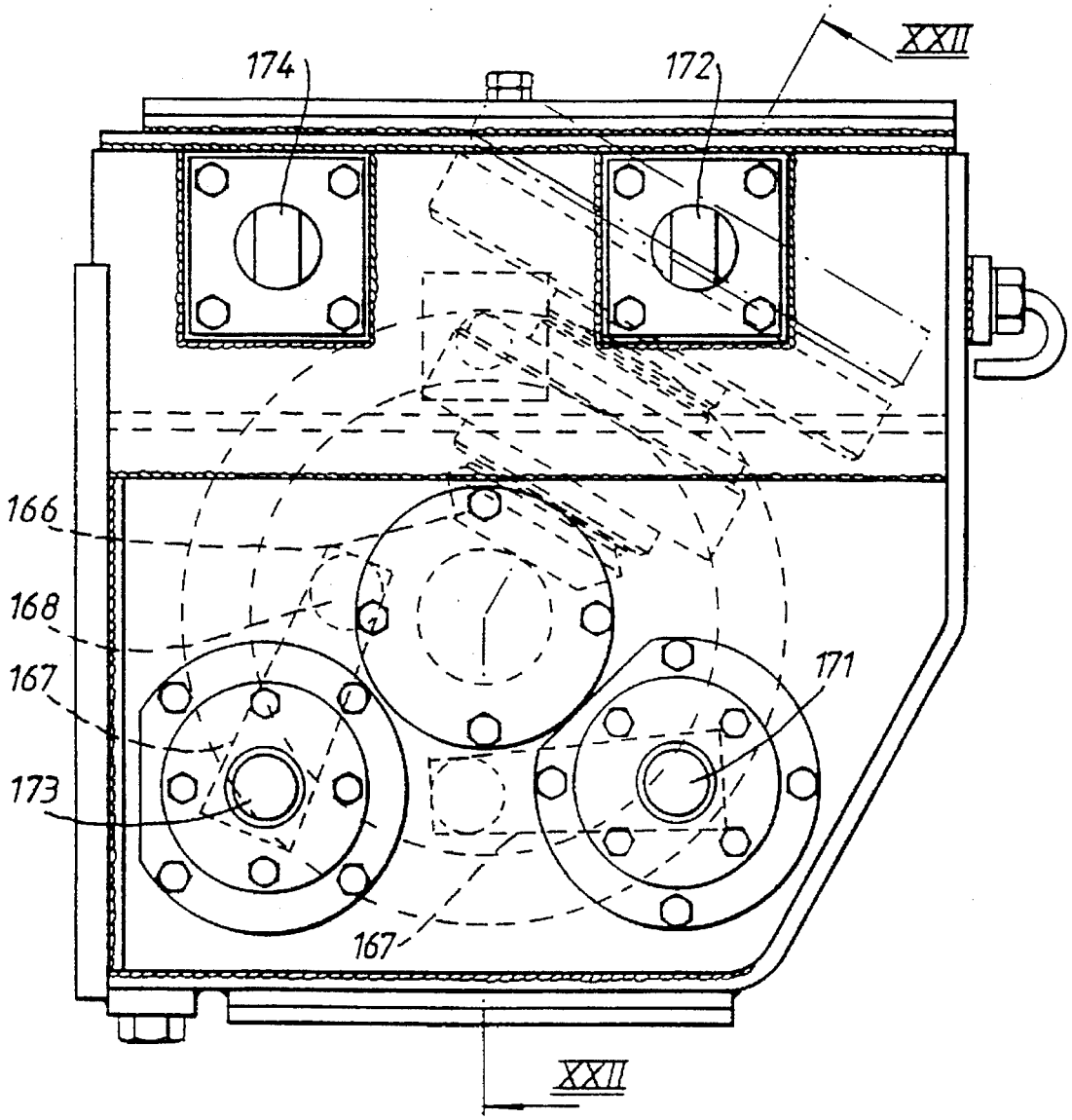
FIG. 21 is an operator's side elevation of a cam box of the tucking device.
Figure 22:
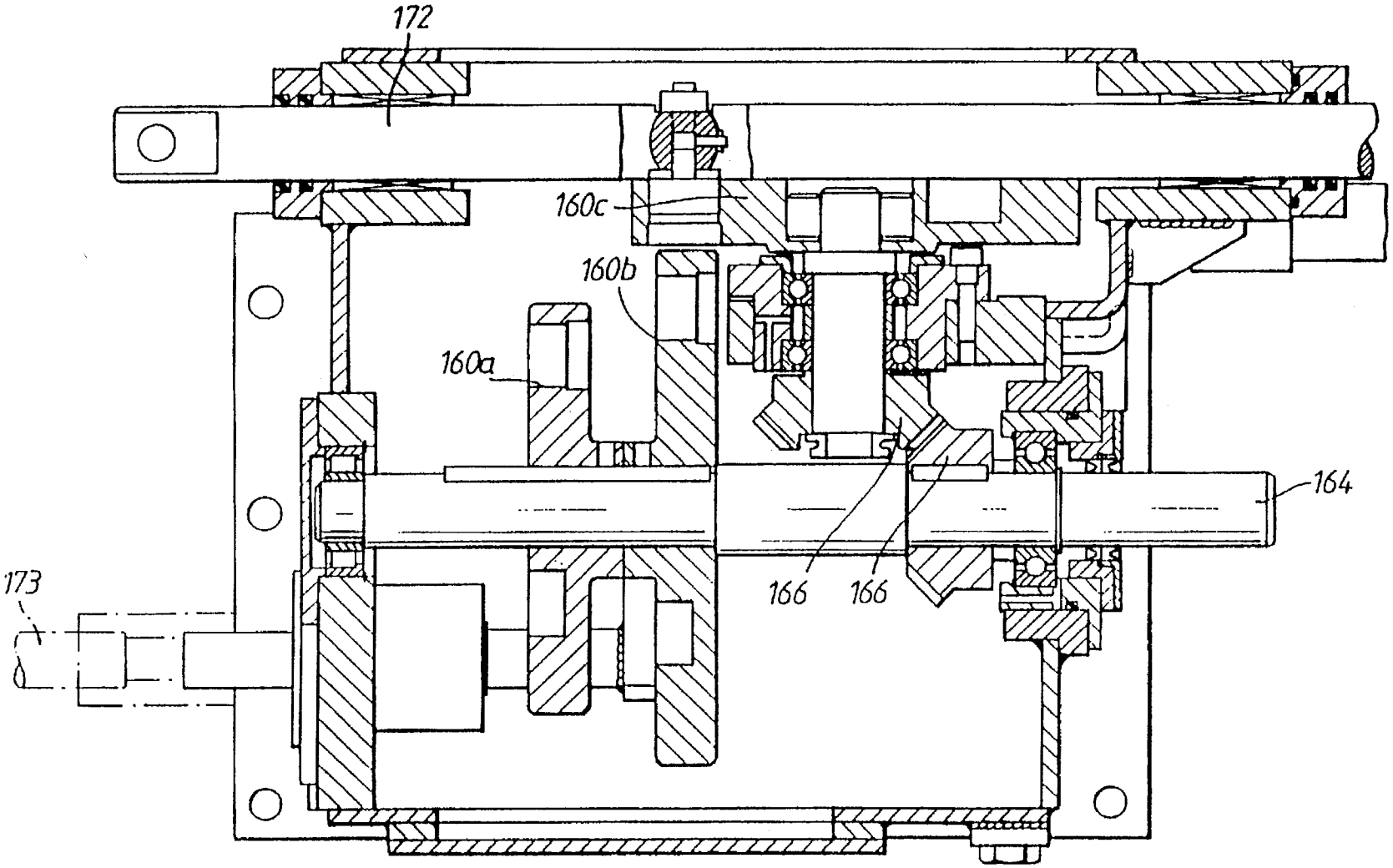
FIG. 22 is a section taken on the line XXII—XXII of FIG. 21.

Referring to FIGS. 7 and 8, the aseptic packaging machine, which is a development of the machine shown in FIGS. 12 to 14 of the aforesaid International Publication, again comprises a conventional apparatus 60 for feeding to a rotary, stepping mandrel device 61 seamed container sleeves each formed from sheet material consisting of paperboard coated on both faces with a suitable thermoplastics material. The open-topped cartons 12 formed therefrom by the mandrel device 61 are conveyed stepwise through a number of stations by the stepping main conveyor 68. The first station is the spraying station 62 in which hydrogen peroxide solution is sprayed into the cartons 12. The next station is the drying station 63 at which a series of manifolds 64 feed hot air into the interiors of the cartons 12 to evaporate the hydrogen peroxide solution. The next station is the filling station 65 at which the cartons 12 are filled with the substance to be packed, which may be foodstuffs. In the present example, food solids are mixed with a liquid. Next is the lidding station 66 at which a stepping drum 67 rotating about its horizontal axis applies the closures 1 to the cartons 12 as the latter are advanced stepwise beneath the drum 67 by the conveyor 68. The lidded cartons 12 now advance with the conveyor 68 until they are transferred therefrom by a vertical transfer device 69 onto a discharge conveyor 70. The closures 1 are supplied to the drum 67 by the closure feeding device 71. The drum 67 is rotatable about a horizontal axis and carries, distributed about its peripheral surface, the horizontal rows of rectangular, plunger-form mandrels 74 mounted in a rectangular guide sleeve framework 75 and provided centrally with respective suction cups 76 (see FIG. 9). The device 71 presents a row of closures 1, in this case four closures, simultaneously to the respective mandrels 74 with correct position and orientation. As the closures 1 in a row are carried stepwise around the axis of the drum 67, they arrive at a first infra-red heater 77 which heats up the polymer towards the melting temperature of the polymer, and then they are advanced stepwise as a row to a second infra-red heater 78 which heats up the polymer to just above its melting temperature. At the next step, the mandrels 74 are advanced radially outwards to apply the closures vertically downwards upon the row of four cartons 12 directly beneath the drum 67 and then the framework 75 associated with that row of mandrels 74 is lowered vertically downwards to fold the flanges 10 down the outside of the rims of the mouths of the cartons 12. Then the lidded cartons 12 are advanced away from the station 66 by the conveyor 68. The mandrel device 61 is part of a carton forming apparatus 115 which includes a bottom closure heating device 114, thereafter a bottom closure tucking apparatus 116, and thereafter a bottom closure sealing apparatus 117. The apparatus 117 is followed by a carton dividing device 118 which divides the two lanes of carton sleeves through the carton forming apparatus 115 into four lanes in preparation for their advance by the conveyor 68. The cartons are lowered from the dividing device 118 into the conveyor 68 by means of an unloading device 119 incorporating a modified Watt's linkage. Below the station 62 extends a hydrogen peroxide extraction duct 120 through which the hydrogen peroxide vapour from the station 63 is extracted. Arranged at intervals along the conveyor 68 are height-adjusting devices 121 whereby the height level of carton guides of the conveyor 68 can be adjusted to set the machine for cartons 12 of various heights. The filling station 65 is of a character disclosed in our International Publication WO88/06552. Included in the station 65 is a back pressure assembly 122. A gassing device 124 is arranged to inject a suitable sterile gas, for example nitrogen, to between the carton and the closure until the closure is received by the carton. Arranged after the device 71 in the sense of rotation of the drum 67 is a detector bank 125 which detects the absence of a lid from its intended position on the drum 67 and prevents the corresponding carton from being filled at the station 65. Disposed at the beginning of the discharge conveyor 70 is a reject assembly 126 which detects unfilled cartons and rejects them horizontally laterally. Located at the drive side of the aseptic packaging machine is a drive arrangement 127 for the carton forming apparatus 115, a drive arrangement 128 for the filling station 65, a drive arrangement 129 for the drum 67, a drive arrangement 130 for the vertical transfer device 69 and the discharge conveyor 70, and a drive arrangement 131 for the main conveyor 68. A compartmented aseptic chamber 123 extends from the feeding apparatus 60 to the closure feeding device 71.

Figure 9:
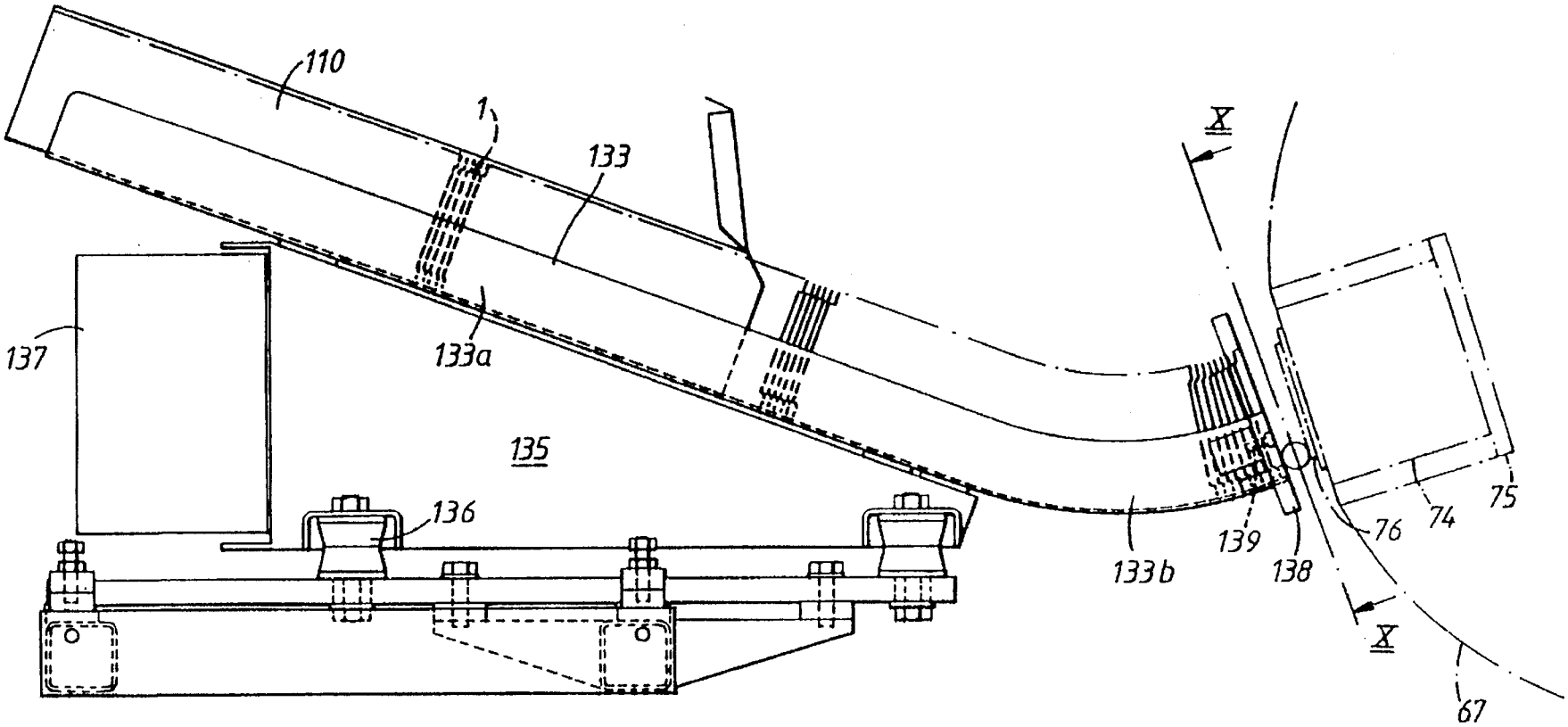
FIG. 9 shows an operator's side elevation of a closure feeding device of the aseptic packaging machine.
Figure 10:
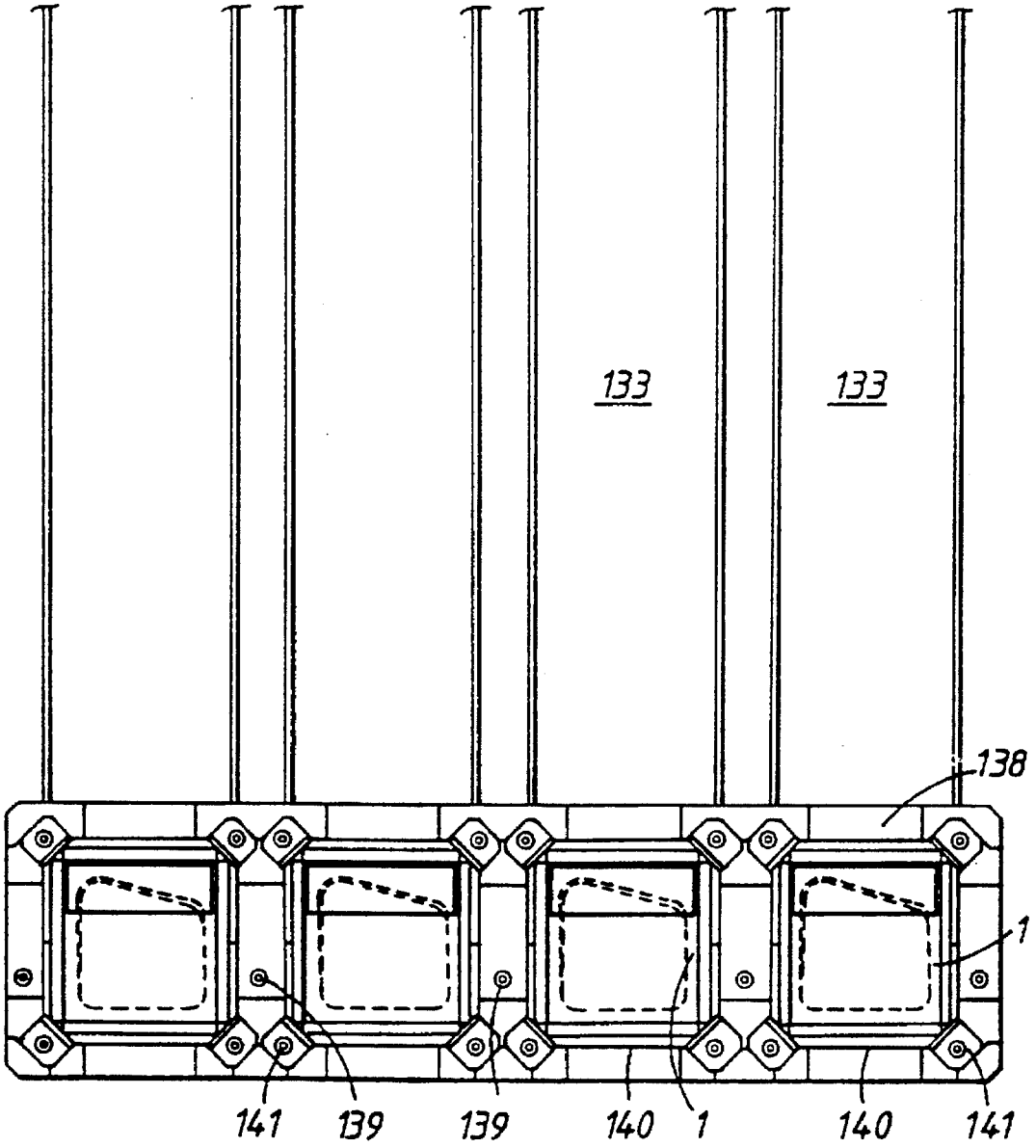
FIG. 10 is a view taken on the line X—X of FIG. 9.

The device 71 includes a set of holders 132 and a set of chutes 133, there being four in each set parallel to each other and at intervals corresponding to the intervals of the four lanes of the conveyor 68. The set of holders 132 is mounted upon a slide 134 so as to be displaceable, transversely of the conveyor 68, between the loading position shown in FIG. 8, in which it is off-set relative to the set of chutes 133 and a feeding position in which the holders 132 are aligned with the respective chutes 133. Boxes 110 of closures 1 are loaded into the holders 132 and the slide 134 is traversed to bring the holders 132 into alignment with the respective chutes 133. Then the holders 132 advance the boxes into the chutes 133, which are then vibrated to feed the closures 1 from the boxes 110. Referring particularly to FIGS. 9 and 10, each chute 133 includes a relatively long portion **133*a* inclined relatively gently downwardly towards the drum 67, followed by a relatively short portion 133*b* which is relatively gently upwardly inclined towards the drum 67, the portion 133*a* merging smoothly into the portion 133*b*. The angle of inclination of the portions 133*a* to the horizontal is advantageously between 15° and 25°, preferably approximately 20°. The chutes 133 are mounted upon a bracket 135 itself supported upon the machine frame 157 by way anti-vibration mountings 136. Attached to the bracket 135 is a linear vibrator 137 which vibrates the chutes 133, and thus any boxes 110 and any closures 1 therein. Extending across the exits of the chutes 133 is a setting plate 138 fixed by screws 139 to the chutes 133. The setting plate 138 is formed with four rectangular openings 140 therein through which the closures 1 could readily pass were it not for adjustable inserts 141 arranged in the corners of the openings 140**.

In use of the device 71 the chutes 133 are initially primed with closures 1 so that the stacks of closures extend to the downwardly tilted mouths of the boxes 110. This ensures that there is sufficient head to provide a pressure of the closures 1 against the setting plate 138 when a subsequent box change-over is required. To assist in applying this pressure, the vibrator 137 agitates the closures 1 towards the setting plate 138 and particularly helps them up the incline of the portion **133*b*. However, this pressure is not sufficient to overcome the detaining effect of the inserts 141 upon the closures 1. The closures 1 automatically discharge from the boxes 110 aided by the vibration. The device 71 presents four closures simultaneously to the respective mandrels 74. Suction is applied to the cups 76 to pull the respective leading closures 1 from the chutes 133 past the inserts 141 onto the mandrels 74 and hold the closures 1 there. The closures 1 are sufficiently flexible that their corners can be deflected past the inserts 141 as the suction cups 76 pull the closures 1 away. This is repeated at each index of the drum 67** and on all four lanes.

There is no regular pitch between the closures 1 when in stack form, because, as already mentioned, the closures are not designed to have nesting properties. The vibration provided by the vibrator 137 tends to keep the closures 1 separate and avoid interlocking of the closures.

Figure 11:
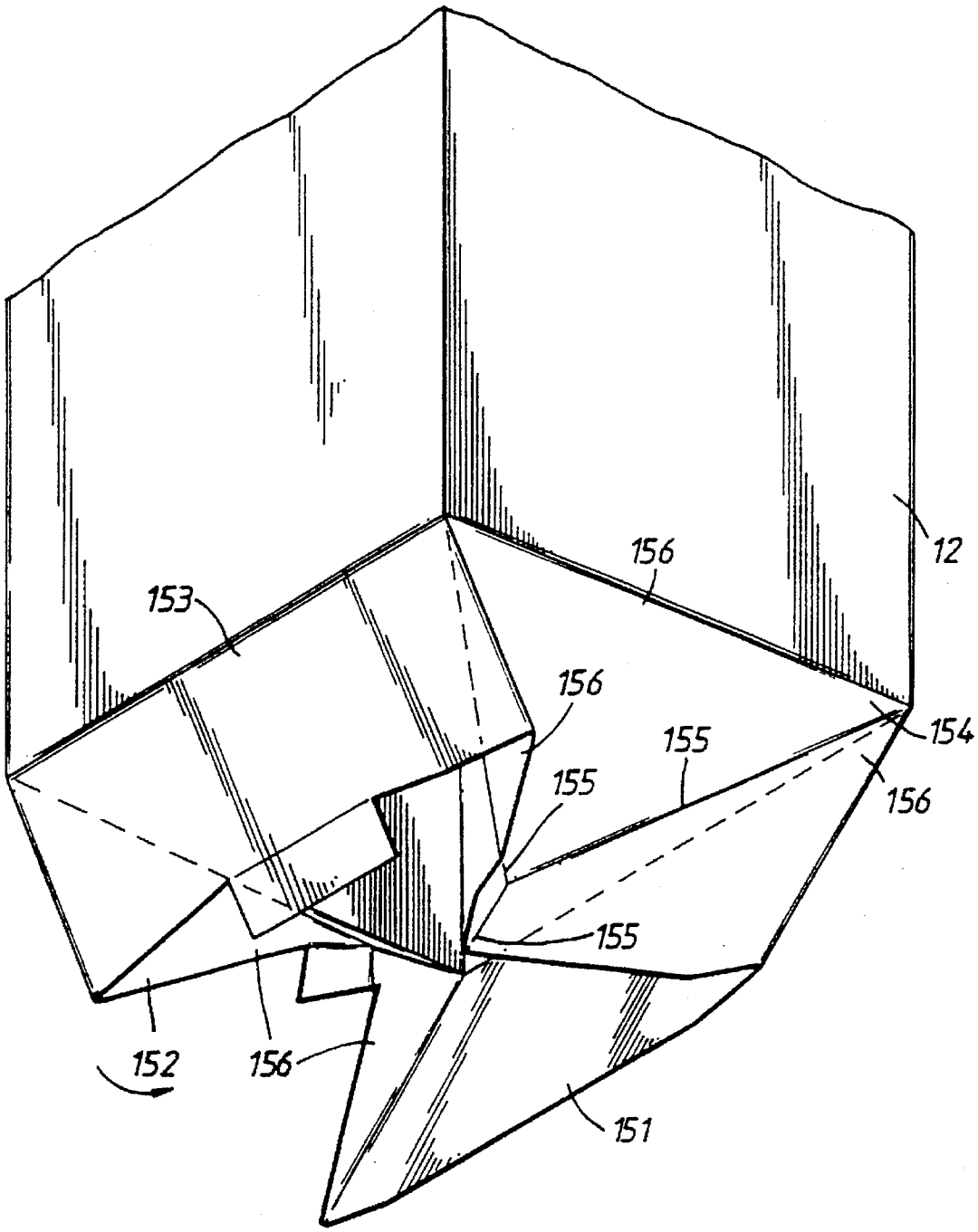
FIG. 11 is a perspective view of a partly closed bottom closure of one of the containers.

Referring to FIG. 11, the bottom end closure of each carton 12 comprises four closure panels 151, 152, 153 and 154 of which the panels 152 and 154 are sub-divided by score lines 155 into substantially triangular sub-panels 156. The panels 151 and 153 are substantially rectangular. Such bottom closure is substantially conventional.

In order to fold the panels 151 to 154 inwards while the carton sleeve is received upon the mandrels of the device 61, the aseptic packaging machine includes the tucking apparatus 116 which will now be described with reference to FIGS. 12 to 22. Fixed to the frame 157 of the aseptic packaging machine is a horizontal beam 158 to which is fixed, at the drive side of the machine, a mounting pad 159. Upon the mounting pad 159 is mounted an oil-filled cam box 160 containing three cams **160*a*, 160*b* and 160*c* driven from a cam drive shaft 164 itself driven from a drive comprised of a timing belt 161, a drive pulley 162, a driven pulley 163 connected to the shaft 164, and a belt-tensioning pulley 165. The output from the cam box 160 takes the form of two oscillatory shafts 171 and 173 associated with the panels 151 and 153, and two reciprocatory bars 172 and 174 associated with the respective panels 152 and 154. The tucking apparatus 116 includes two identical tucking devices 175 arranged in a horizontal row along the beam 158. Each tucking device 175 includes a housing 176 fixed to the beam 158. Mounted in bearings in the housings 176 are the oscillatory shafts 171 and 173 which include couplings 177 located among the devices 175. To these shafts 171 and 173 are fixed respective tucking arms 181 and 183, the ends of which fold inwards the respective panels 151 and 153. At their ends nearer the cam box 160, the reciprocatory bars 172 and 174 are interarticulated by a yoke 178 centrally mounted upon a fixed pivot pin 179. Included in the rods 172 and 174 are rose-jointed links 180 at the tucking devices 175. Connected via these rose-jointed links to the respective rods 172 and 174 are outer ends of respective bell-crank levers 192 and 194 which are mounted by way of pivot pins 185 in and on the housings 176 and have fixed to the inner ends thereof respective tucking arms 182 and 184. The three cams within the cam box 160 are in the form of eccentrically grooved discs and are individually replaceable. The shaft 164 has the cams 160***a* and 160*b* releasably fixed co-axially thereto, but drives the cam 160*c*, which is mounted to rotate about an axis perpendicular to the shaft 164, by way of a pair of bevel gears 166. Fixed to the shafts 171 and 173 are respective radial arms 167 carrying at their free ends roller followers 168 which run in the eccentric grooves in the cams 160*a* and 160*b*, respectively. Anchored to the bar 172 is a roller follower 169 which runs in the eccentric groove in the cam 160*c*. The cam 160*c* controls the reciprocatory motions of the bars 172 and 174, which are forcibly synchronized owing to the provision of the yoke 178. Thus, the motion of the arm 182 in relation to the panel 152 is identical to the motion of the arm 184 in relation to the panel 154. The other two cams 160*a* and 160*b* respectively control the motions of the shafts 171 and 173 which, since the panel 153 is tucked in beneath the panel 151, will be different from each other. The cam 160*c* is adjustable relative to the cams 160*a* and 160*b*. Mounted upon each housing 176 is a pair of carton clamps 186, each consisting of a short-stroke air-driven, piston-and-cylinder device 187 on the outer end of the piston rod of which is mounted a silicone rubber pad 188. The independent cam control of the tucking arm 181, the tucking arm 183 and the pair of tucking arms 182 and 184 not only promotes accurate folding of the heated panels 151 to 154 along the relevant score lines prior to sealing, but also permits minimising of contact of the arms 181 to 184 with the heated thermoplastics surface coatings of those panels. The mechanical timing of the four arms 181 to 184 from the cam box 160 can give particularly accurate motion of those arms. It permits the generation of individual motions for the panel 151, the panel 153 and the panel pair 152 and 154, so as to optimise the approach angles and pivot radii of the tucking movements, which are features of particular importance. To promote accurate timing of the motions of the arms 181 to 184 relative to the other operations of the carton forming apparatus 115, the pulley 162 may be connected directly to the main drive shaft 189 of the apparatus 115. To permit easy adjustment of the arms 181 and 183 relative to the shafts 171 and 173, the inner ends of the arms are releasably clamped about the shafts 171 and 173 by means of clamps 190. The inner ends of the arms 182 and 184 are formed with respective releasable clamps 195 encircling pin-form ends 196 of the respective bell-crank levers 192 and 194, so that the arms 182 and 184 may be adjusted relative to those pin-form ends 196. Adjustment of those ends 196 and thus also of the arms 182 and 184, relative to the rods 172 and 174 is also obtainable by adjustment of the rose-joined links 180. The carton clamps 186 prevent axial displacement of the carton 12 on the mandrel during folding. The clamp motions are timed from a programmable logic controller of the aseptic packaging machine, to clamp the cartons 12 axially on the respective mandrels before the arms 181 to 184 contact the carton. Providing the control cam mechanism within a single oil-filled box 160 to one side away from the carton lanes promotes a cleaner environment for the cartons, as well as easier servicing and maintenance.

Immediately following the tucking devices 175 along the paths of movement of the mandrels are bottom- closure retaining rails 197 mounted upon the beam 158 by way of a bracket system 198. As can be seen from FIG. 13, the bracket system 198 includes releasable bolts 199 through slots 200 to permit the height level of the rails 197 to be adjusted by means of a set screw 201, whilst, as can be seen from FIG. 12, a similar arrangement of bolts 199*a* and set screw 201*a* permits the radial position of the beam 158 relative to the mandrel device 61 to be adjusted. As can be seen from FIG. 14, the rails 197 are of relatively small diameter and of circular external cross-section to minimise the area of contact between the heated thermoplastics surfaces of the carton 12 and the rails 197. The arms 181 to 184 are water-cooled, as also are the rails 197, the contact surfaces of which are highly polished. Thus the rails 197 provide a highly-polished, chilled surface contact area of minimal extent, so that the bottom closure is adequately supported to prevent damage thereto, but as little heat as possible is removed from the bottom closure during transfer. Water-cooling of the arms 181 to 184 and of the rails 197 has the particular advantage of reducing pick-up of thermoplastics by the rails 197.

The advantage of optimising the motions of the arms 181 to 184 is that squarer, less distorted cartons 12 are presented to the bottom closure sealing apparatus 117.

Figure 23:
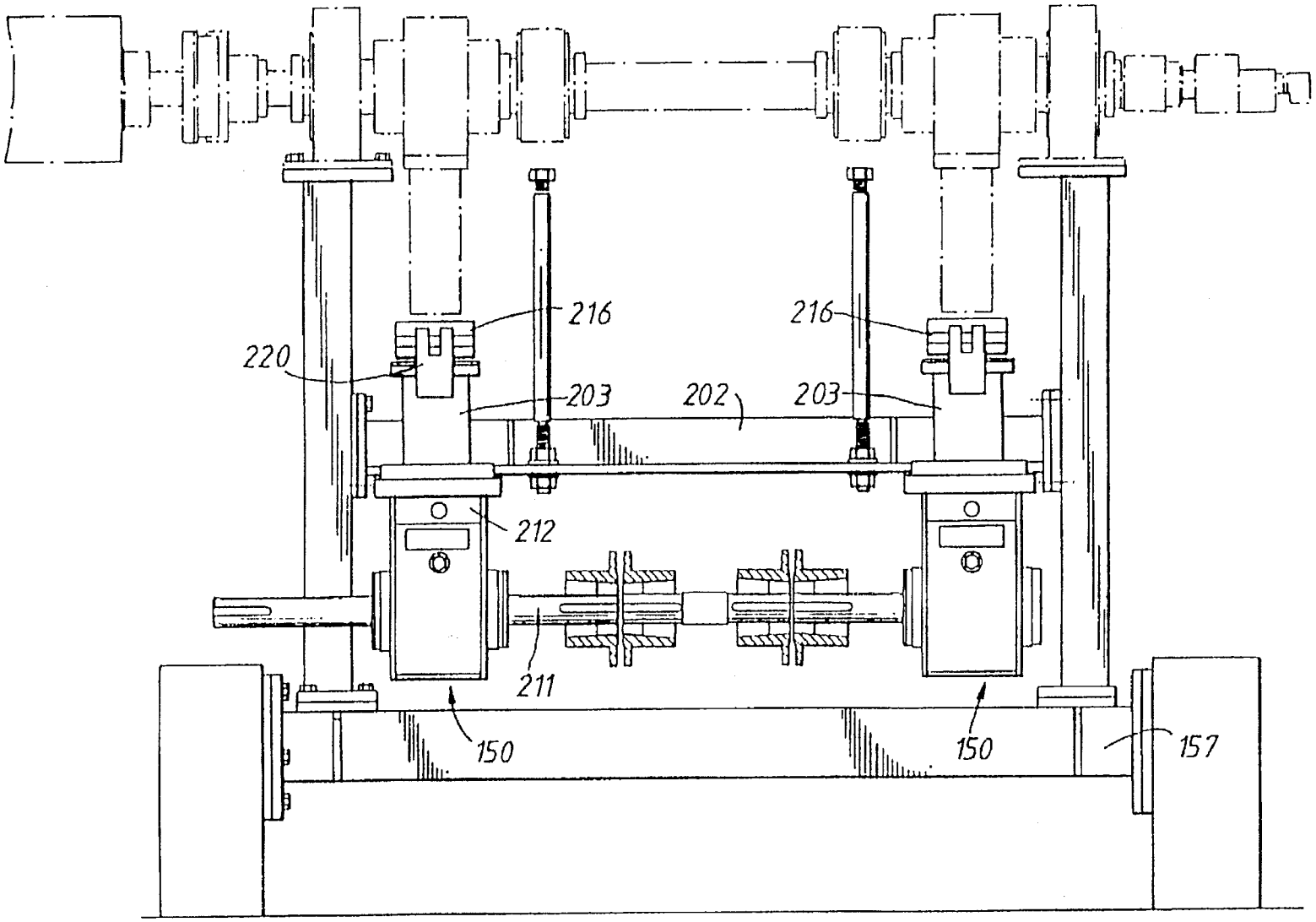
FIG. 23 is a view taken along the line XXIII—XXIII of FIG. 7, and illustrating a bottom sealing apparatus of the aseptic packaging machine.
Figure 24:
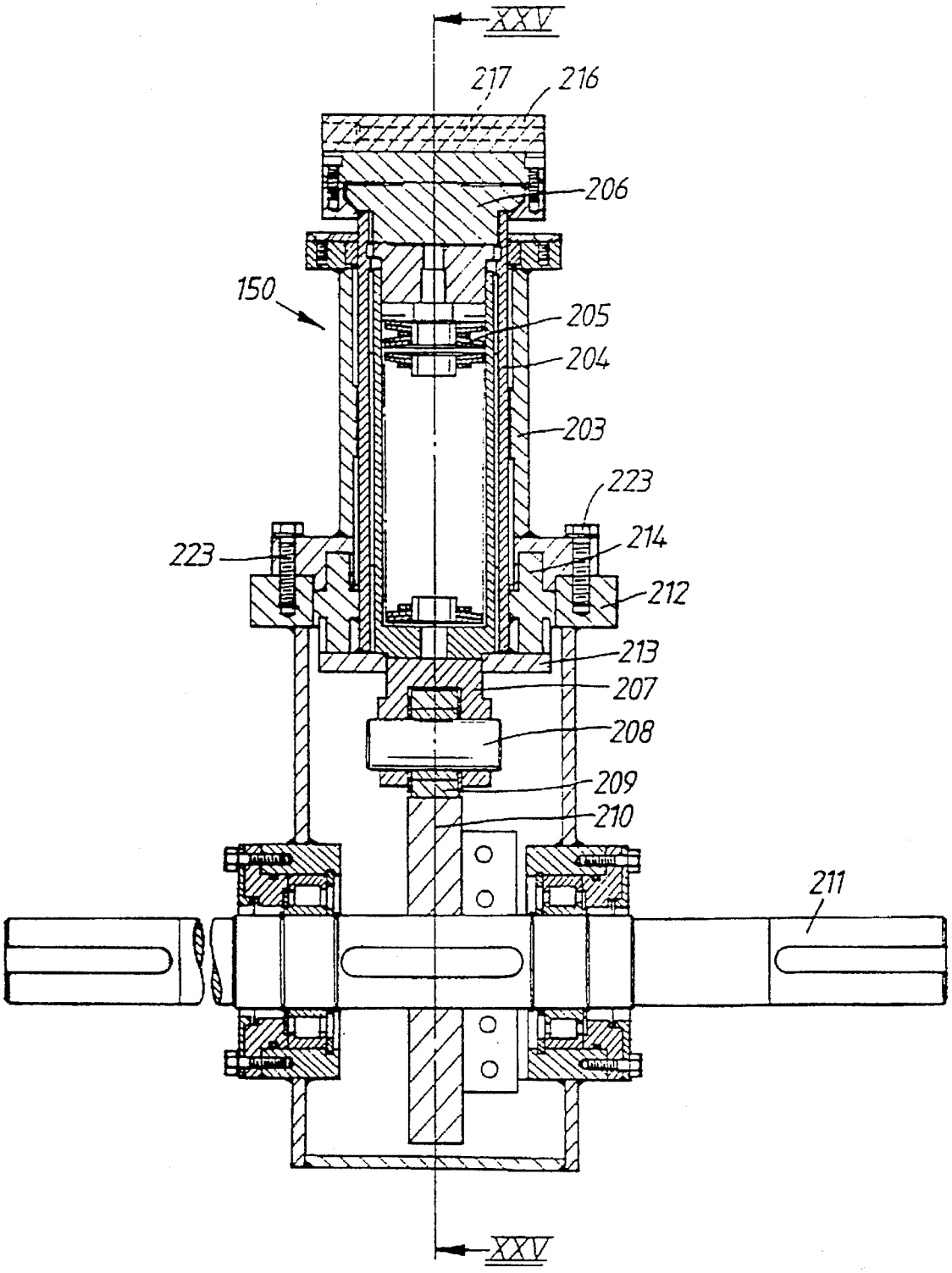
FIG. 24 shows an axial section through one of two bottom sealing devices of the bottom sealing apparatus and taken parallelly to the plane of FIG. 23.
Figure 25:
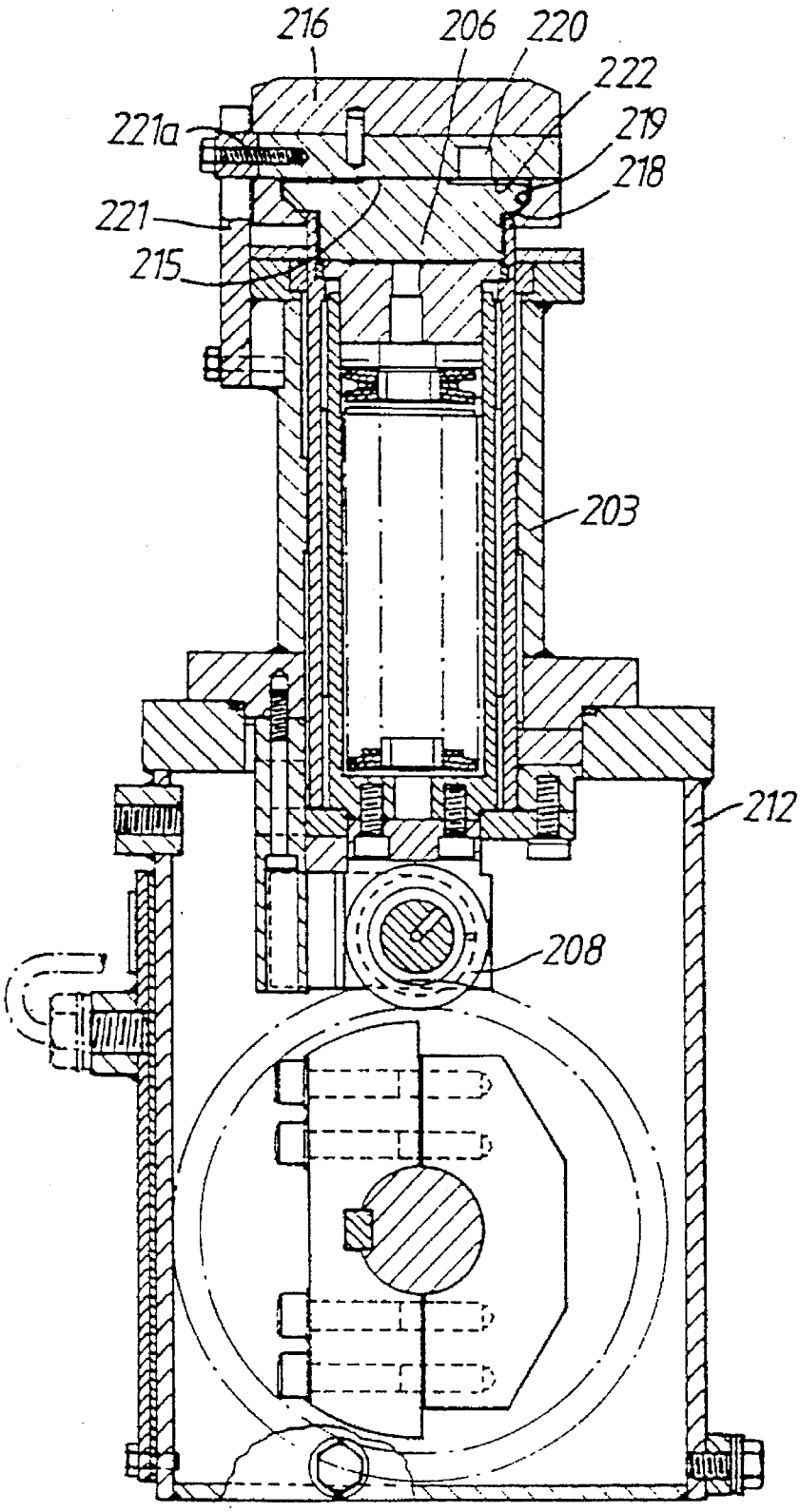
FIG. 25 shows an axial section taken on the line XXV—XXV of FIG. 24.

The bottom closure sealing apparatus 117 is shown in more detail in FIGS. 23 to 25 and includes two sealing devices 150 mounted upon a horizontal beam 202 of the machine frame 157. They include respective radial sleeves 203 which are fixed to the beam 202 and within which are radially reciprocably and concentrically mounted respective inner sleeves 204 which receive respective pre-loaded disc spring stacks 205 and which are closed at their upper ends by plugs 206 against which respective ends of the spring stacks may press. The other end of each spring stack 205 presses against a yoke 207 supporting a bearing pin 208 of a roller follower 209 co-operating with a cam 210 keyed to a drive shaft 211. The cam 210 and its follower 209 are located in an oil-filled cam box 212 fixed to the beam 202. At its end nearer the cam 210, the sleeve 204 has fixed thereto a flange 213 and a spring 214 encircling the sleeve 204 acts between the flange 213 and the cam box 212, so that the flange 213 resiliently limits the extent of movement of the yoke 207 towards the sleeve 204. The plug 206 has its outer end face formed centrally with a spherical nose 215 upon which is mounted a pressing head 216 which is water-cooled by way of ducting 217. Outside the sleeve 204, the plug 206 is formed with a radial flange which is undercut to provide a frusto-conical surface 218, whilst the pressing head 216 annularly embraces that flange and is internally formed with a matching frusto-conical surface 219, but the head 216 is arranged with lateral and axial play upon the plug 206. A compression spring 220 acts between the head 216 and the plug 206 to bring the frusto-conical surfaces 218 and 219 into contact with each other, whereupon they become self-centering. Fixed to the sleeve 203 is a forked bracket 221 which guides a laterally projecting pin 221*a* fixed to the head 216 to prevent rotation of the head 216 about the axis of the sleeve 203 relative to the plug 206. The head 216 has a planar internal surface 222 which cooperates with the spherical nose 215 in such manner that the pressing head 216 is self-aligning in relation to the bottom closure of the carton.

This sealing apparatus 117 optimises leak-free sealing of heated carton bottom closures, such leak-free sealing being dependent upon a pressure/time/temperature relationship. The chilled, pressing head 216 applies pressure to the bottom closure and simultaneously extracts heat from the thermoplastics thereof. It presses the bottom closure against chilled caps of the mandrels of the device 116. The bottom closure is sandwiched between the chilled mandrel cap and the pressing head 216 for the maximum time within the machine cycle. The apparatus 117 has its pressing units (extending from the cam followers 208 to the pressing heads 216) directly cam driven in a simple manner, thus minimising cost and wear. The cam 210 is of such form (an asymmetrical modified sine form) as to give a slow advance under sealing load and a rapid withdrawal at the end of sealing, so to give the longest possible contact time of the pressing head 216 on the carton bottom closure, in order to extract the maximum amount of heat. The pressing load is internally set by adjusting the pro-loaded spring stacks 205, although some variation in the pressing load may be achieved by adjusting the distance between the mandrel cap and the pressing head 216. Each sealing device 150 is of modular form, with a unit formed by the parts carried by the sleeve 203 being removable as a unit relative to a unit formed by the cam box 212, the shaft 211 and the cam 210, by simply releasing bolts 223 connecting the two units together. Moreover, the latter unit is itself removable as a single unit from the beam 202, by simply releasing other bolts (not shown) connecting that unit to the beam 202. Having the sealing devices 150 of such modular form simplifies adjustment, servicing and maintenance thereof. The self-aligning feature of the head 216 provided by the spherical nose 215 in co-operation with the planar surface 222 has the advantage of equalizing the contact pressure between the head 216 and the bottom closure and thereby also of maximising the contact area between the head 216 and the bottom closure and thus maximising heat extraction therefrom. The self-centering feature provided by the frusto-conical surfaces 218 and 219 and the compression spring 220 has the advantage of immediately returning the head 216 to its position ready for self-alignment, so ensuring that the self-alignment is as effective as possible.

Figure 26:
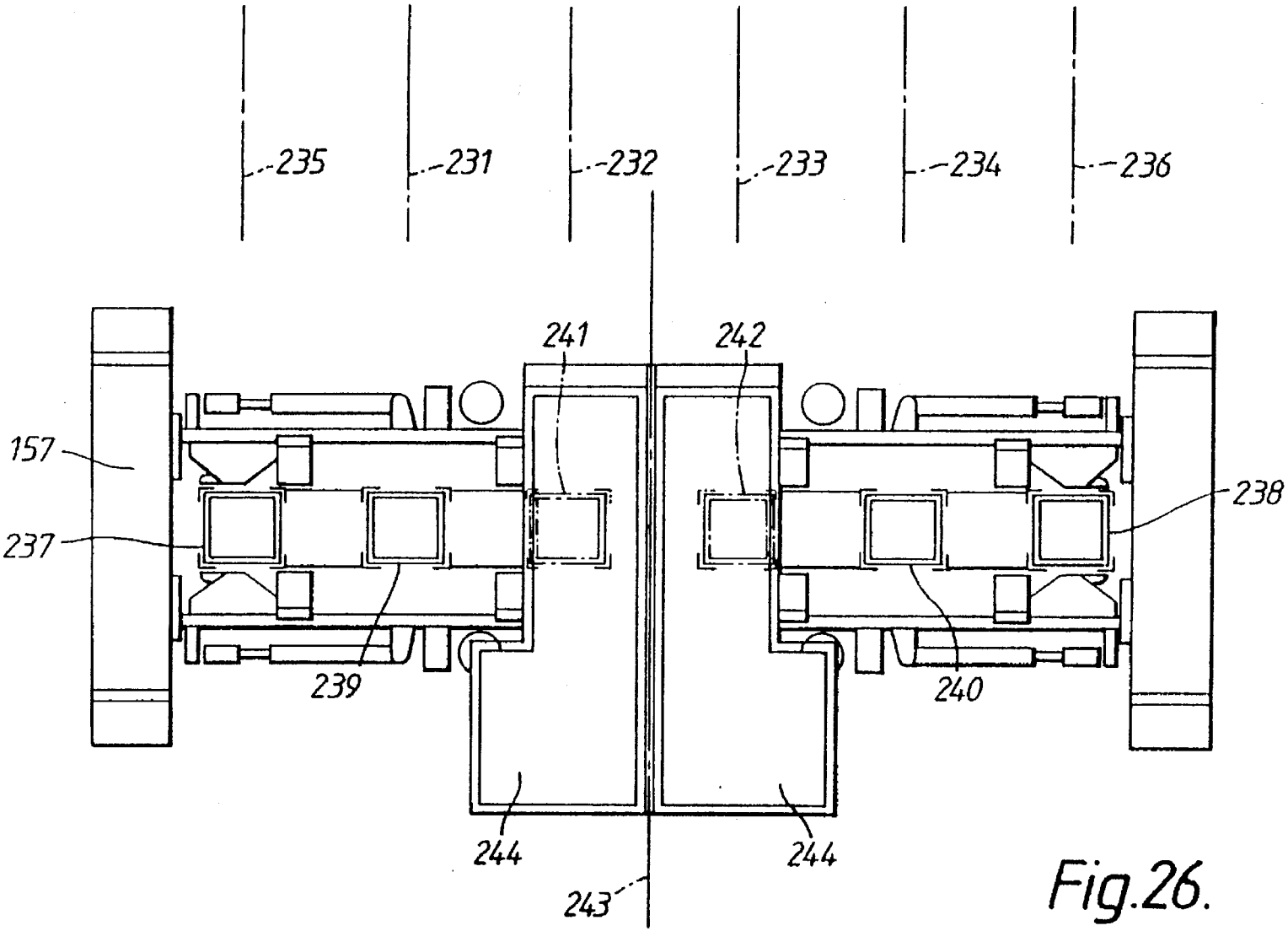
FIG. 26 shows a diagrammatic plan view of a container dividing device of the aseptic packaging machine.
Figure 27:
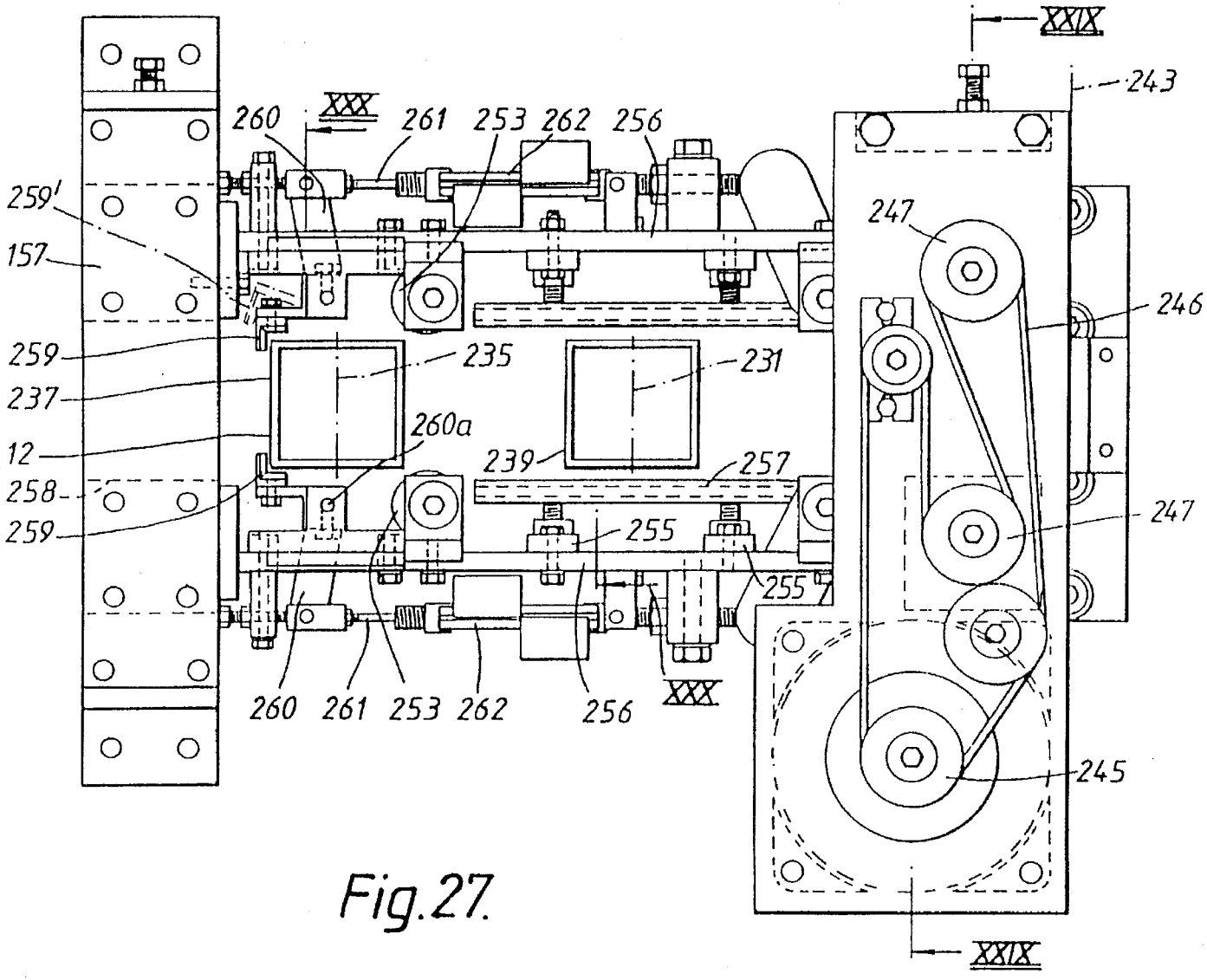
FIG. 27 shows a detail of FIG. 26.

The carton dividing device 118 will now be described with reference to FIGS. 26 to 30. Referring initially to FIG. 26, the centrelines of the four lanes of the conveyor 68 are referenced 231, 232, 233 and 234, whilst the centrelines of the two lanes of the mandrel device 61 are referenced 235 and 236. As the bottom-sealed, open-topped cartons 12 arrive in a vertically upright position above the device 118, they are stripped downwards from the two mandrels in question and dropped into the positions 237 and 238 in the device 118. Unless one or both of the cartons is faulty or required for sampling purposes, they are then displaced inwards to positions 239 and 240 aligned with the centrelines 231 and 234, respectively. Then two more cartons are stripped from the device 61 into the positions 237 and 238 and immediately thereafter are themselves displaced inwards to the positions 239 and 240, respectively, the cartons previously at those positions 239 and 240 being displaced inwards into positions 241 and 242 aligned with the centrelines 232 and 233. Then, while a further two cartons are stripped from the mandrel device 61 into the positions 237 and 238, the cartons at the positions 239 to 242 are lowered as a group into the conveyor 68 by the unloading device 119.

Figure 28:
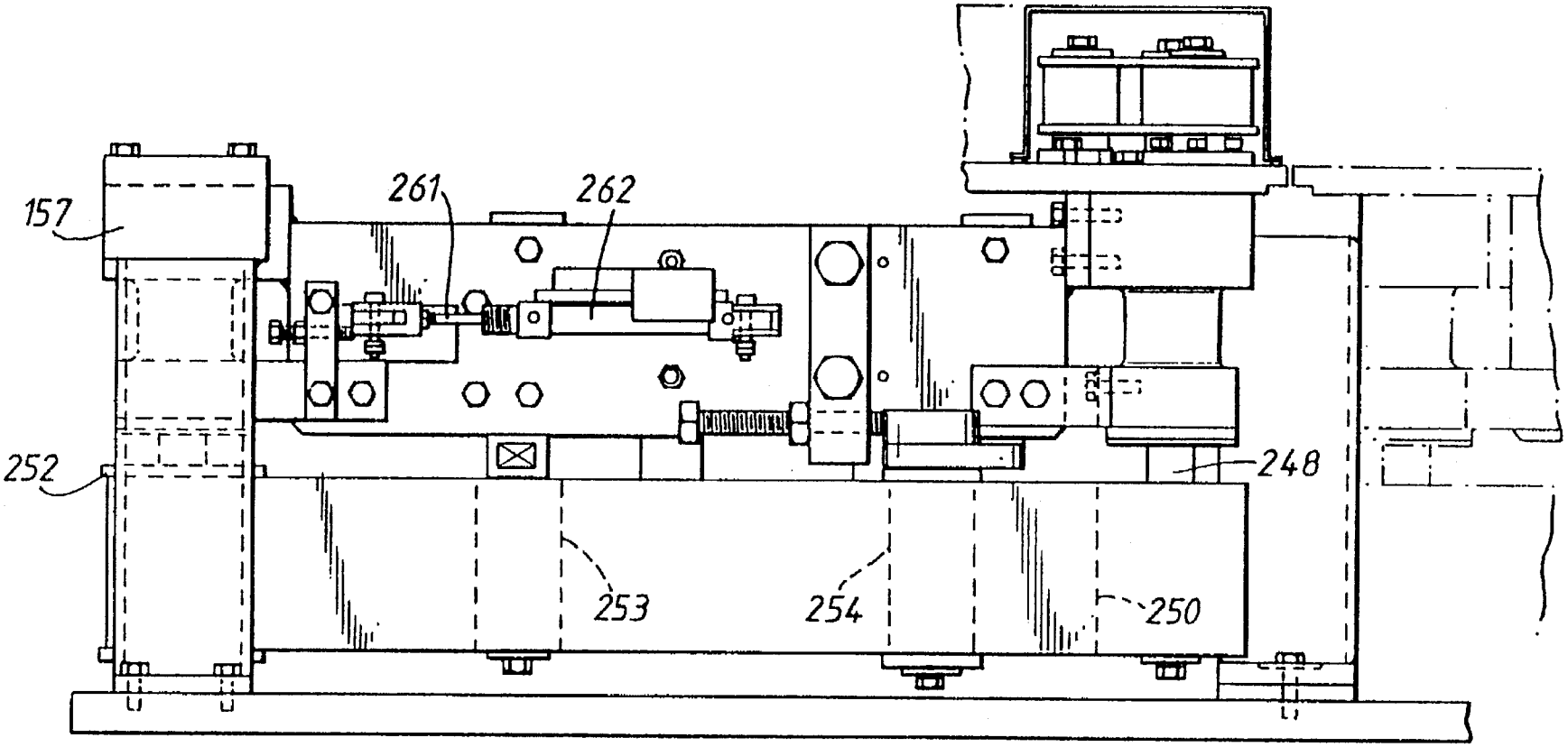
FIG. 28 shows an operator's side elevation of the parts shown in FIG. 27.
Figure 29:
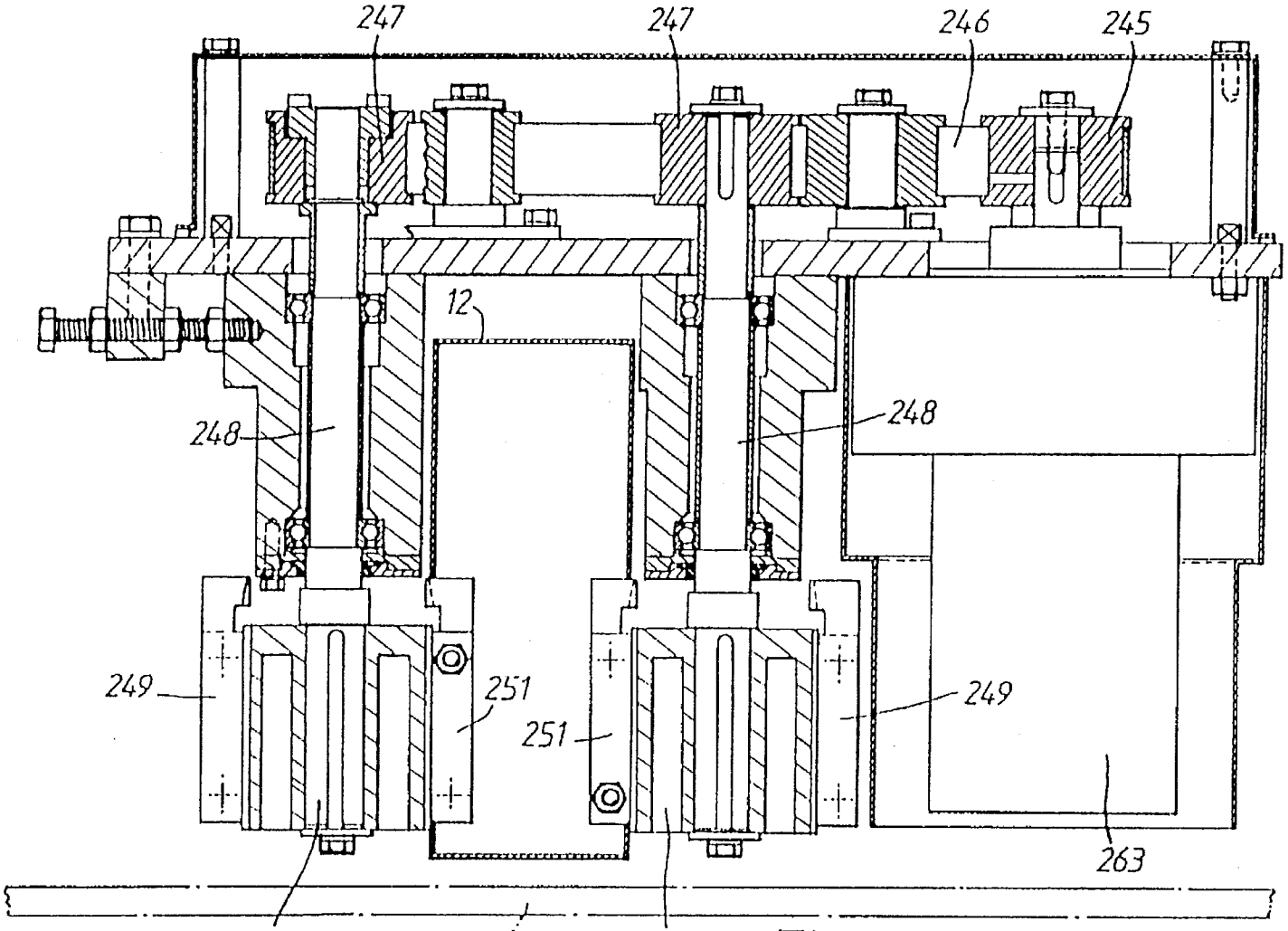
FIG. 29 shows a section taken on the lines XXIX—XXIX of FIG. 27.
Figure 30:
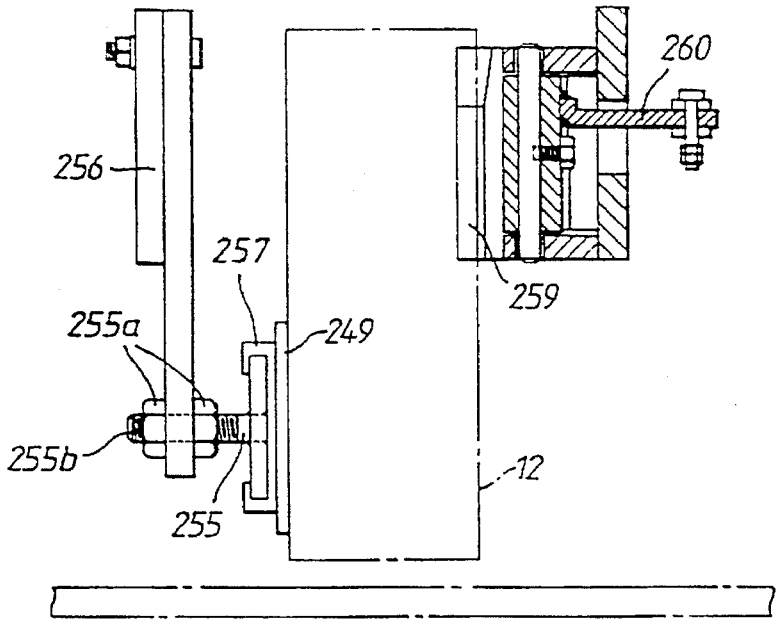
FIG. 30 shows a section taken on the lines XXX—XXX of FIG. 27.

Since the device 118 is symmetrical about the longitudinal central plane 243 of the machine, only the left-hand half thereof in FIG. 26 will be described with reference to FIGS. 27 to 30. A timing-belt and pulley drive 244 is provided including a drive pulley 245, a timing belt 246, and two driven pulleys 247 keyed to respective vertical shafts 248. The pulley 245 is driven by a stepper motor and reduction gear box unit 263. The vertical shafts 248 drive two belts 249 of a short, transverse conveyor. The belts 249 are driven by two pulleys 250 fixed to the shafts 248 and are provided with vertical dogs 251. The belts 249 extend around reversal pulleys 252 at the relevant outer edge of the machine and extend over fixed vertical pulleys 253 and belt-tensioning pulleys 254 at the inner runs of the belts. At the position 237 (and 238), the belts 249 are spaced apart sufficiently that the carton 12 may drop to between them, where it is supported by a horizontal deadplate (not shown), and yet the dogs 251 are able to advance the cartons. However, over those sections of the inner runs of belts 249 between the pulleys 253, on the one hand, and the pulleys 250, on the other hand, the belts 249 are brought nearer to each other, by the pulleys 253 and 250, so that the cartons 12 are gripped firmly between the belts 249 and thus do not fall from between the same under gravity. Supported by brackets 255 from horizontal bars 256 fixed to the machine frame 157 are guide strips 257 which guide the belts 249 over those sections. There is a lateral opening 258 through the machine frame and through which reject or sample cartons 12 can be expelled. Movement of cartons 12 at the position 237 (and 238) towards the opening 258 is normally prevented by inwardly projecting ends 259 of two bell-cranks levers 260 arranged at respective opposite sides of the position 237 and (238) and having pivots 260*a*. The outer ends of the bell-crank levers 260 are articulated to piston rods 261 of respective air-driven, piston-and-cylinder devices 262 (FIG. 28). The ends 259 effectively constitute a gate displaceable, by operation of the devices 262, between the closed condition shown in full lines in FIGS. 27 and 30 and the open condition indicated in dot-dash lines at 259' in FIG. 27. Since the belts 249 are disposed immediately above the horizontal deadplate mentioned above for supporting the carton 12 at the position 237, they do not require any height adjustment to cope with open-topped cartons of various heights. The device 118 is mounted on a top cover 264 of a tank 265 of the machine.

The device 118, together with the unloading device 119, constitute means for transferring the bottom-sealed, open-topped cartons 12 from the two-lane device 61 to the four-lane conveyor 68. The open-topped cartons are delivered to all four lanes in the same orientation as one another. This transfer means can accommodate a range of carton sizes, i.e. carton heights. A particular advantage is that no contact occurs with the inside walls of the cartons or with the top edge zones of the cartons to which zones the top closures are to be applied. Reliable gripping of the cartons during transfer can be achieved by accurately setting the distance between the guides 257 and thus between the belts 249. Such setting is obtained by adjustment of lock nuts 255*a* on stud bolts 255*b* included in the brackets 255. This belt arrangement allows transfer of the full range of carton heights without the use of bottom and adjustable top guides. The stepper drives provided by the stepper motors 263 give the flexibility necessary to permit reversal of the direction of movement of the belts 249, thus to expel reject or sample cartons through the automatically operated gates (259), which are under PLC control. An advantage of dividing the two rows of cartons into four rows is that the rate of stepping of the cartons in the four rows can be half that of the cartons in the two rows, so allowing longer dwell time in the filling station 65 and the lidding station 66 to give good quality filling and lidding. Another advantage of the device 118 is that cartons are transferred outside the machine tank 265, permitting easier access for clearance of wrecked cartons and for adjustment purposes. A further advantage is that formed cartons can be rejected from the machine before transfer to the main conveyer 68, so permitting setting and evaluation of the carton-forming apparatus 115 as an independent production unit. It is particularly noteworthy that cartons of the present character when formed and sealed have bottom external dimensions greater than intermediate external dimensions, owing to the folding of the bottom closure locally expanding the sidewalls of the cartons. For example, cartons may regularly be 73–74 mm. square externally at the bottom but 71 mm. square from 10 mm. above the bottom. The device 118 can exploit this feature by having its belts 249 grip each carton a short distance, say 10 mm. upwards, above the bottom of the carton, so that the wedging effect of an increase from, say, 71 mm. to, say, 73–74 mm. produces a resistance to upward movement of the carton relative to the belts 249. This provides stability for the carton during unloading by the device 119 and reduces any need for top carton guides. Thus, relatively low contact pressure between the belts 249 and the carton is possible, with correspondingly low risk of distortion of the carton during transfer.

Figure 31:
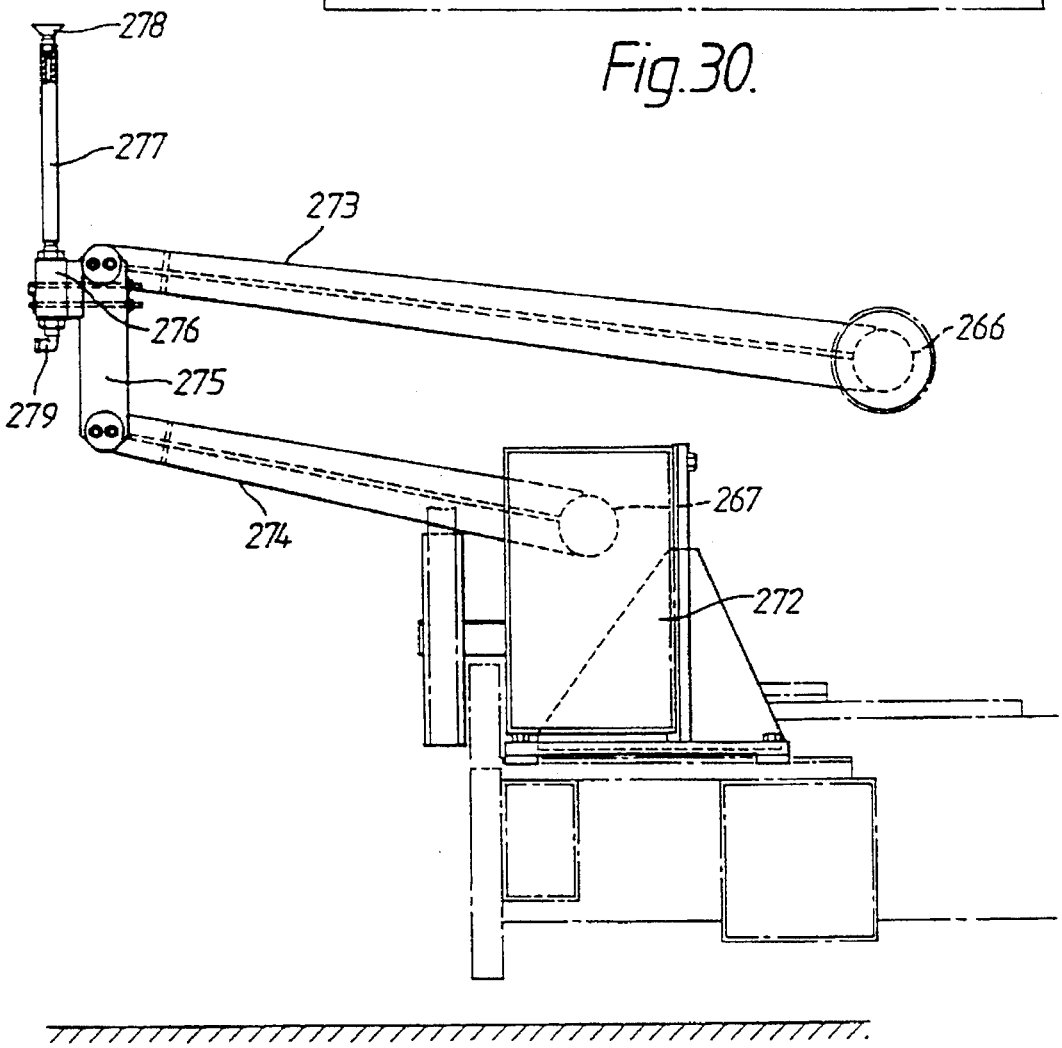
FIG. 31 shows diagrammatically a drive side elevation of an unloading device of the aseptic packaging machine.
Figure 32:
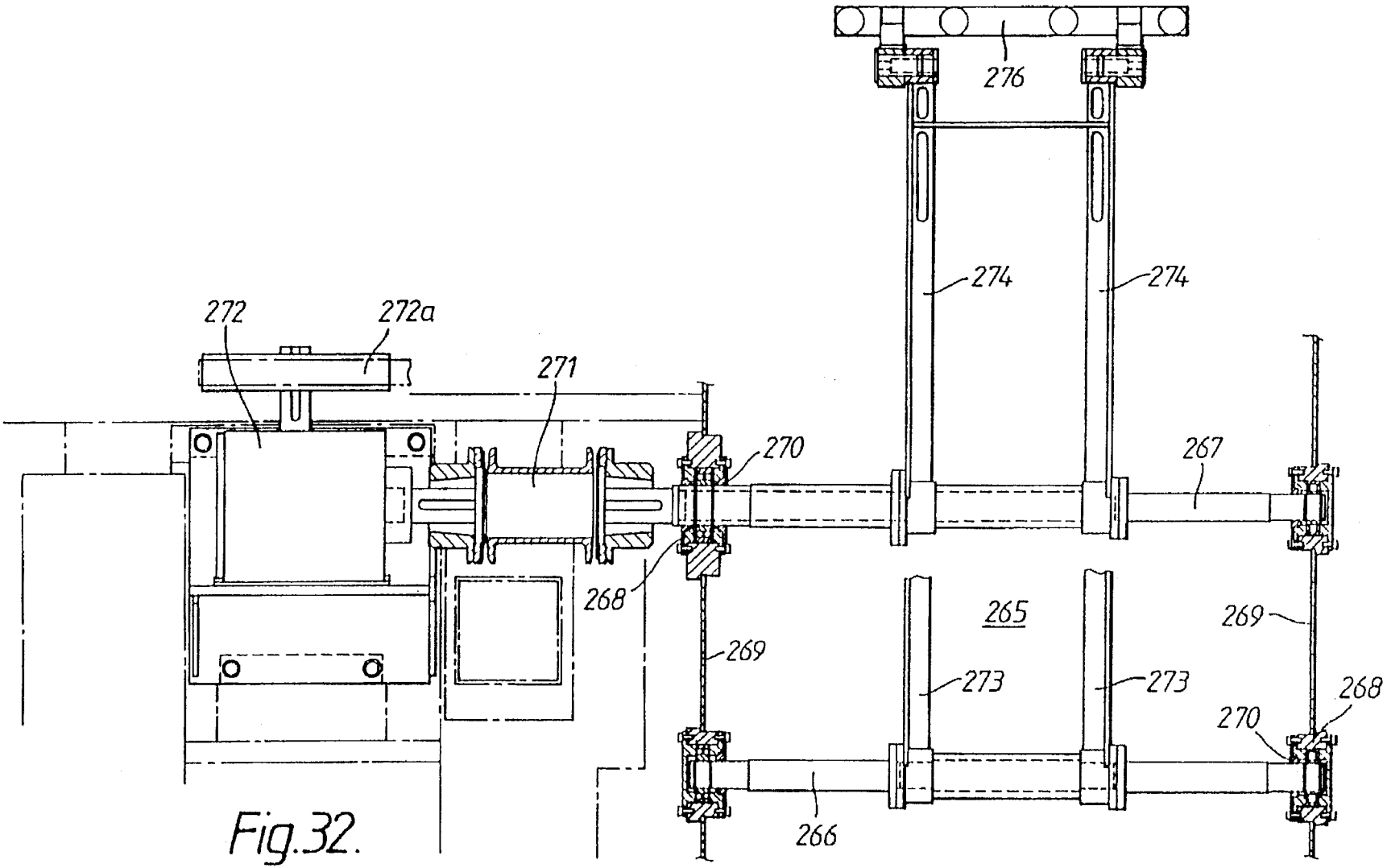
FIG. 32 shows diagrammatically a fragmentary plan view of the unloading device.

The unloading device 119 will now be described in detail with reference to FIGS. 31 and 32. The device is mounted in the machine tank 265 and includes upper and lower, parallel, horizontal shafts 266 and 267 mounted in bearings 268 extending through the vertical lateral walls 269 of the tank 265. Annular seals 270 assist in separating the interiors of the bearings 268 from the tank 265. The lower shaft 267 is an oscillatory drive shaft and is connected through a dry disc misalignment coupling 271 with a cam oscillator box 272 driven by a timing-belt and pulley drive 272*a* connected to the drive shaft 189. A 1:2 drive ratio causes the device 119 to perform a complete oscillation at every alternate index of the carton-forming apparatus 115 and in synchronism with each index of the main conveyer 68. Fixed to and extending radially from the upper shaft 266 is a pair of parallel arms 273, whilst another pair of parallel arms 274 is fixed to and extends radially from the shaft 267. The radially outer ends of the arm pairs 273 and 274 are articulatedly interconnected by a pair of approximately vertical links 275 both fixed to a horizontal beam 276. The beam 276 has extending upwardly therefrom four rigid suction pipes 277 arranged directly above the respective centrelines 231 to 234. The pipes 277 terminate at their tops in respective suction cups 278 and at their bottoms are connected to respective vacuum lines 279. The wedging effect mentioned above in relation to the belts 249 opposes any inadvertent upward knocking of the cartons by the suction cups 278 to out of reach of the suction cups 278 themselves.

The device 119 unloads open-topped cartons 12 from the carton dividing device 118 into the four lanes of the conveyor 68. It employs a modified "Watt" linkage to convert oscillatory motion of the shaft 267 into approximately straight line motion (the deviation is preferably less than 0.15 mm) of the beam 276 and thus of the suction cups 278 which seize the sealed bottom closures of the four open-topped cartons in the device 118 and pull those cartons downwards into the conveyor 68. The programmable logic controller of the machine determines the termination of suction at the cups 278 and thus the distance through which the cartons are pulled downwards thereby. This is required because carton guides of the main conveyor 68 are adjustable vertically to accommodate the range of carton heights, so that the position of carton release from the suction through the cups 278 is required also to vary with carton height. The design of the cam in the box 272 is of a modified sine form to minimise linear velocity at the unload positions for the various carton heights.

Moreover, the device 119 is better able to cope with the clean-in-place method employed to clean the tank 265. That method leaves on machine surfaces extremely hard crystalline deposits from the cleaning chemicals evaporating from those surfaces, so that linear sliding motions between machine elements are particularly vulnerable to wear, since relatively large exposed surfaces are wiped by bearing elements and seals. The use in the device 119 of rotary bearings in which there are co-extensive inner and outer annular bearing surfaces minimises the exposure to such deposits and hence increase service life. The device is capable of withstanding elevated temperatures (up to 90° C.) and attack from the aggressive media used in the clean-in-place method. Stainless steel and "TUFNOL" materials are used for all components exposed to the clean-in-place media. "TUFNOL" enables the components to be lightweight, as well as providing an excellent bearing material with good mechanical strength and abrasion resistance. Another advantage of the device 119 is that there is no contact with the inside walls of the carton or with the open top closure thereof. Moreover, the linkage mechanism of the device 119 is relatively compact and can operate within the space constraints imposed by the upper and lower runs of the main conveyer 68.

Generally speaking, the advantages of the device 119 are longer bearing lives, higher reliability and longer service intervals.

Figure 33:
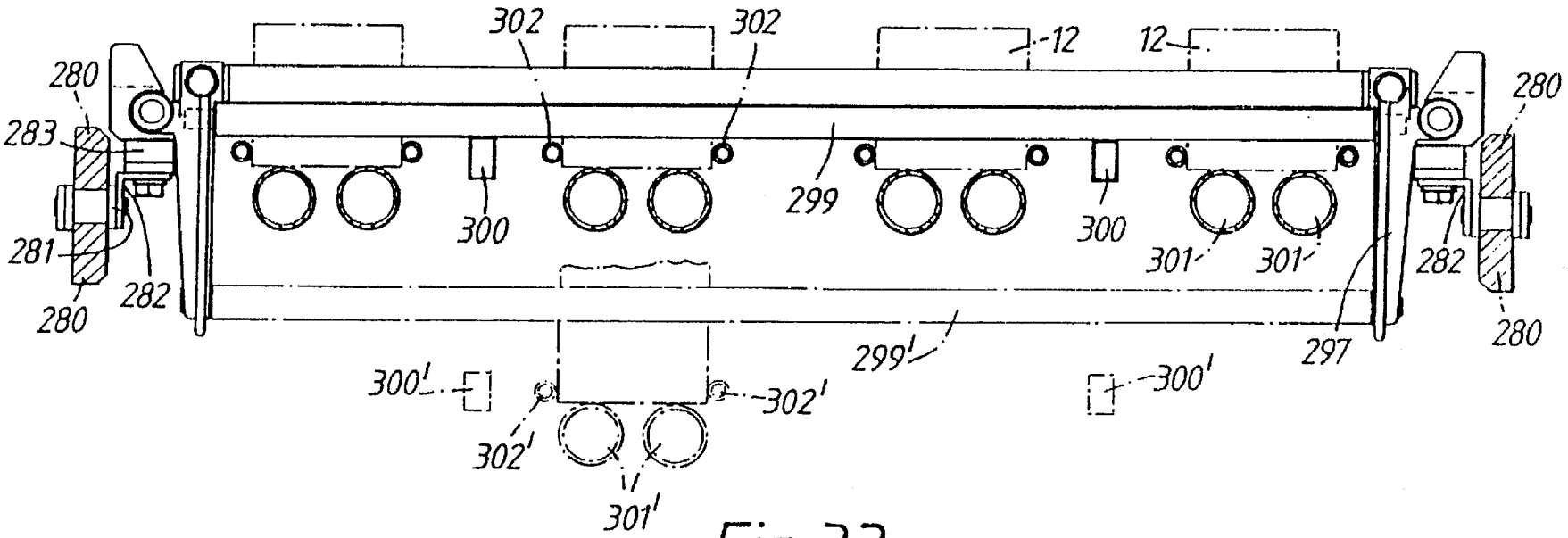
FIG. 33 shows a fragmentary sectional view through a main conveyor of the aseptic packaging machine.
Figure 34:
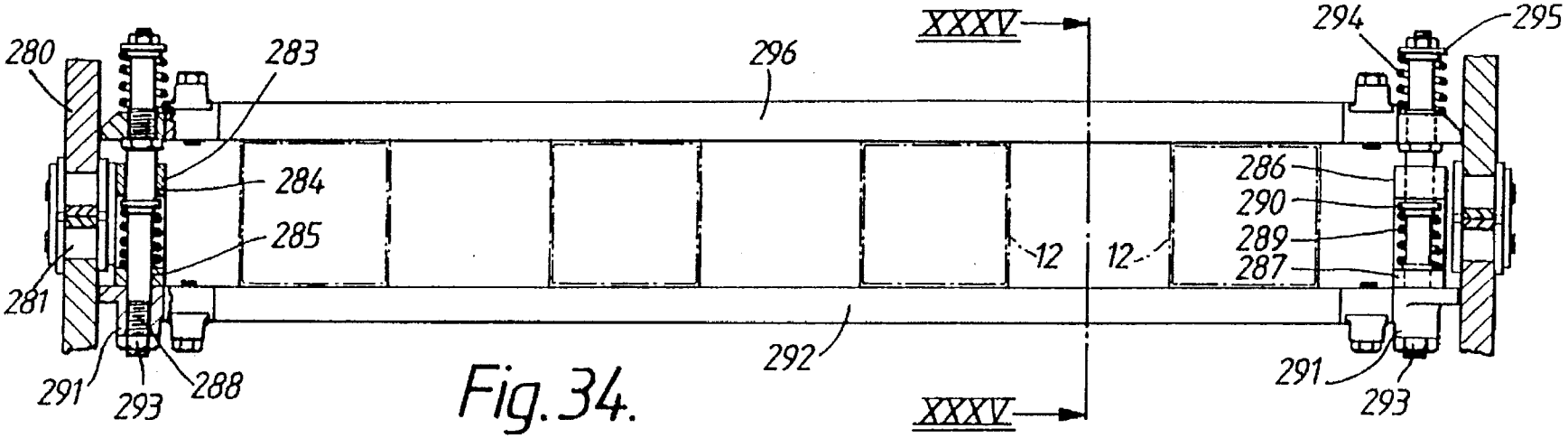
FIG. 34 shows a partly-sectional fragmentary plan view of the conveyor.
Figure 35:
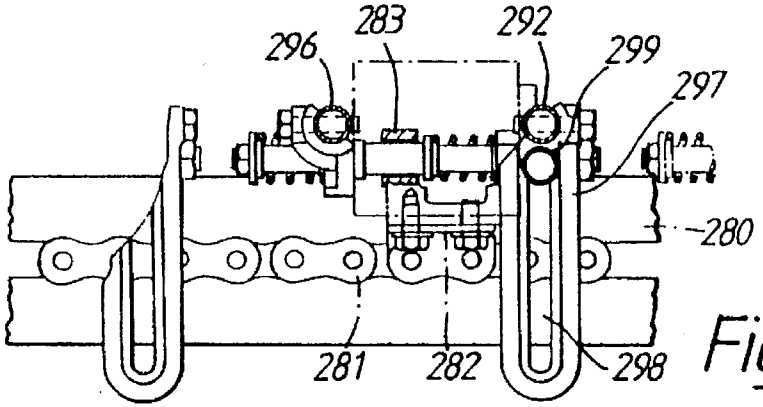
FIG. 35 shows a section taken on the line XXXV—XXXV of FIG. 34.

The conveyer 68 is illustrated in more detail in FIGS. 33 to 35. It includes, at each side of the machine, two lateral rails 280 arranged one above the other and fixed to the lateral walls 269. Between each pair of horizontal rails 280 is guided a stainless steel roller chain 281 to which are fixed at intervals brackets 282 arranged in ninety-two pairs across the machine. The brackets 282 support respective mounts 283 formed with horizontal bores 284 and 285 through respective upright projections 286 and 287 thereof. A horizontal pin 288 extends through the bores 284 and 285 of each mount 283, parallelly to the rails 280. A helical compression spring 289 disposed between the projections 286 and 287 of each mount 283 encircles the pin 288 and acts between the projection 287 and a flange 290 of the pin 288 to urge the pin forwards in the direction of movement of the conveyer 68. Each pair of pins 288 extends rearwards through bosses 291 formed at respective ends of a horizontal tube 292 extending transversely of the machine. The rearward ends of the pins 288 are threaded and carry respective nuts 293 whereby the tube 292 is pressed forwards against the projections 287 by the action of the springs 289. At its forward end, each pin 288 is encircled by a helical compression spring 294 acting between a flange 295 at the forward end of the pin 288 and an adjacent end of a horizontal transverse tube 296, through which end the pin 288 passes. Thus the tube 296 is pressed rearwardly by the springs 294 at the respective ends thereof. Integral with and depending downwardly from the bosses 291 are respective loops 297 providing respective vertical slots 298 vertically slidably receiving the respective ends of a lower horizontal transverse tube 299. Spaced apart from each other beneath the tubes 299 and extending horizontally parallelly to the upper run of the conveyor 68 are respective guide rails 300 of "TUFNOL". As shown in full lines, the rails 300 are in uppermost raised positions in which they support the tubes 299 in their uppermost positions. The lowermost positions of the tubes 299 and the rails 300 are shown in dot-dash lines at 299' and 300' in FIG. 33. The cartons 12 are supported upon pairs of horizontal, stainless steel, guide tubes 301 which extend parallelly to the rails 300 and which may be heated or chilled by circulating thermically controlled water through them. Just above the level of the tubes 301 and arranged parallelly thereto are pairs of stainless steel, water-coolable or -heatable tubes 302 which severely limit lateral movement of the bases of the cartons 12 on the tubes 301. The tubes 301 and 302 are again liftable and lowerable, their uppermost positions being shown in full lines at 301 and 302, and their lowermost positions being shown in dot-dash lines at 301' and 302'. The level of the tubes 299, the rails 300, the tubes 301 and the tubes 302 as a group is adjusted according to the height of the cartons being handled. The springs 294 cause each pair of tubes 292 and 296 to grip the four cartons 12 between them. In use, the tubes 292 and 296 are positioned at a level spaced below the carton top closures, for example at a two cm. spacing from the carton top closures and thus contact neither the inside walls of the cartons, nor the top closures thereof. The springs 289 pro-load the assembly 292, 296, 297 and 299 against mounts 283 yet allow the assembly to be displaced to a limited extent relative to the chains 281 to allow accurate positioning of the cartons at the lidding station 66. The tube 299 helps to ensure that the lower parts of the cartons 12 do not lag behind seriously owing to frictional forces at the tubes 301 and 302, especially with the taller cartons. The tubes 302 are not provided adjacent the conveyer 68 until the lidding station 66 is reached.

The height adjusting devices 121 each comprise a rack-and-pinion mechanism supporting the guides 300, 301, and 302. The rack-and-pinion mechanisms are driven via indexing boxes (not shown) and simple geared motors (also not shown). One index of the boxes equals one height increment of the carton range. In respect of each transverse row of cartons 12, the tube 296, on the one hand, and the tubes 292 and 299, on the other hand, are opened at the dividing device 118 and at the vertical transfer device 69 during every machine cycle, to allow the cartons 12 to pass freely between those tubes. At the filling station 65, the tube 296, on the one hand, and the tubes 292 and 299, on the other hand, are opened only during the clean-in-place method, to allow back pressure tubes of the back pressure assembly 122 to pass through and connect onto dispensing nozzles of the four fillers of the station 65. As already referred to above, the tubes 292, 296 and 299 are accurately positioned during each machine cycle at the lidding station 66 to ensure accurate alignment between the carton 12 and the components of the lidding station 66; this is achieved by simple lever and crank mechanisms (not shown) operated by pneumatic cylinders (not shown) controlled by the programmable logic controller.

The drive arrangement 131 for the conveyor 68 includes an indexing cam box driven by a servo-motor, thereby giving complete control over the conveyor speeds, the indexing periods, and the accelerations experienced by the contents of the cartons, the latter in order to prevent spillage. The commencement of each indexing of the conveyor 68 is governed by the indexing of the carton forming device 115 through the programmable logic controller. Tensioning of the conveyor 68 is achieved by a simple swinging jockey system 80 (see FIG. 7).

Figure 36:
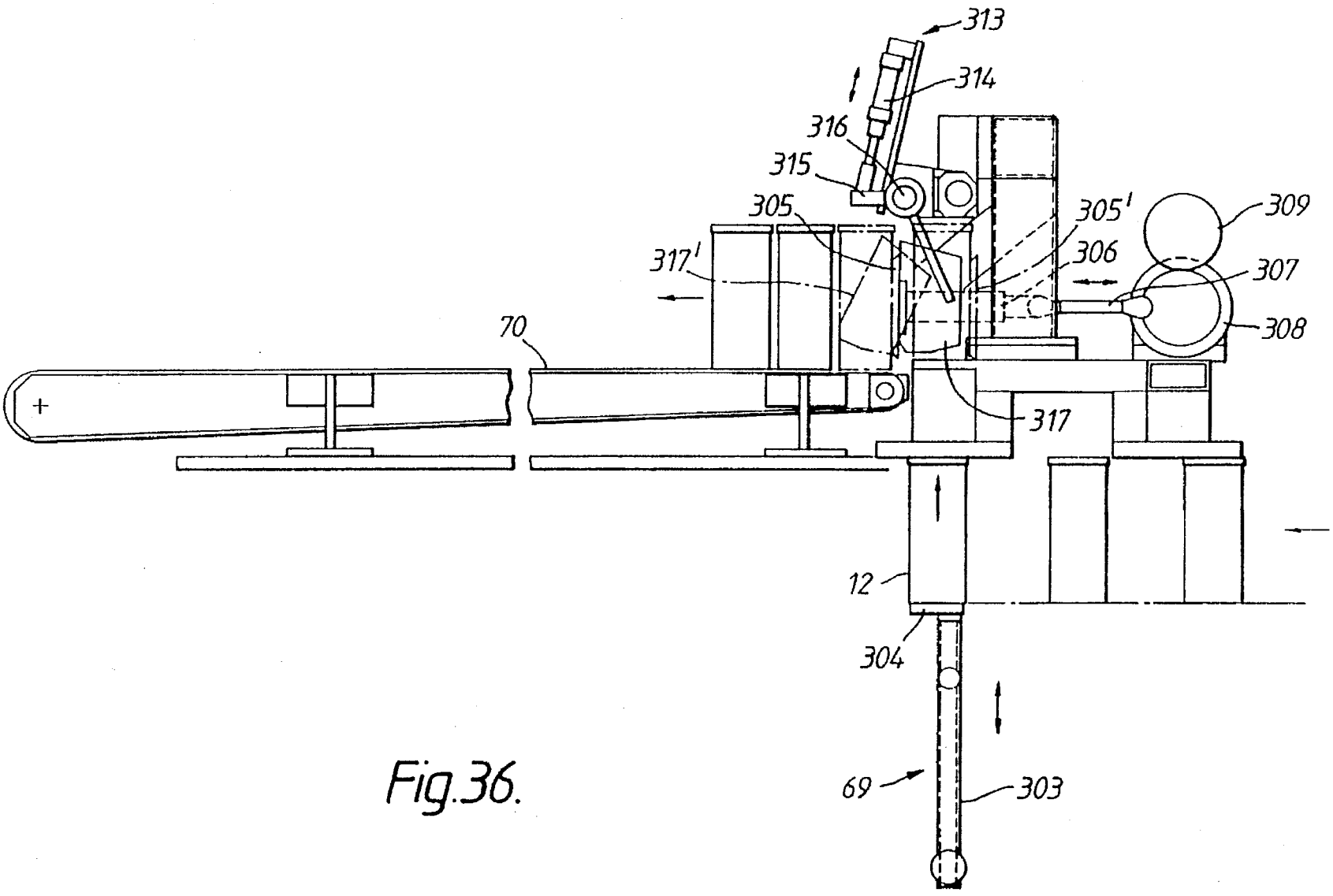
FIG. 36 is a diagrammatic operator's side elevation of discharge and reject assemblies of the aseptic packaging machine.
Figure 37:
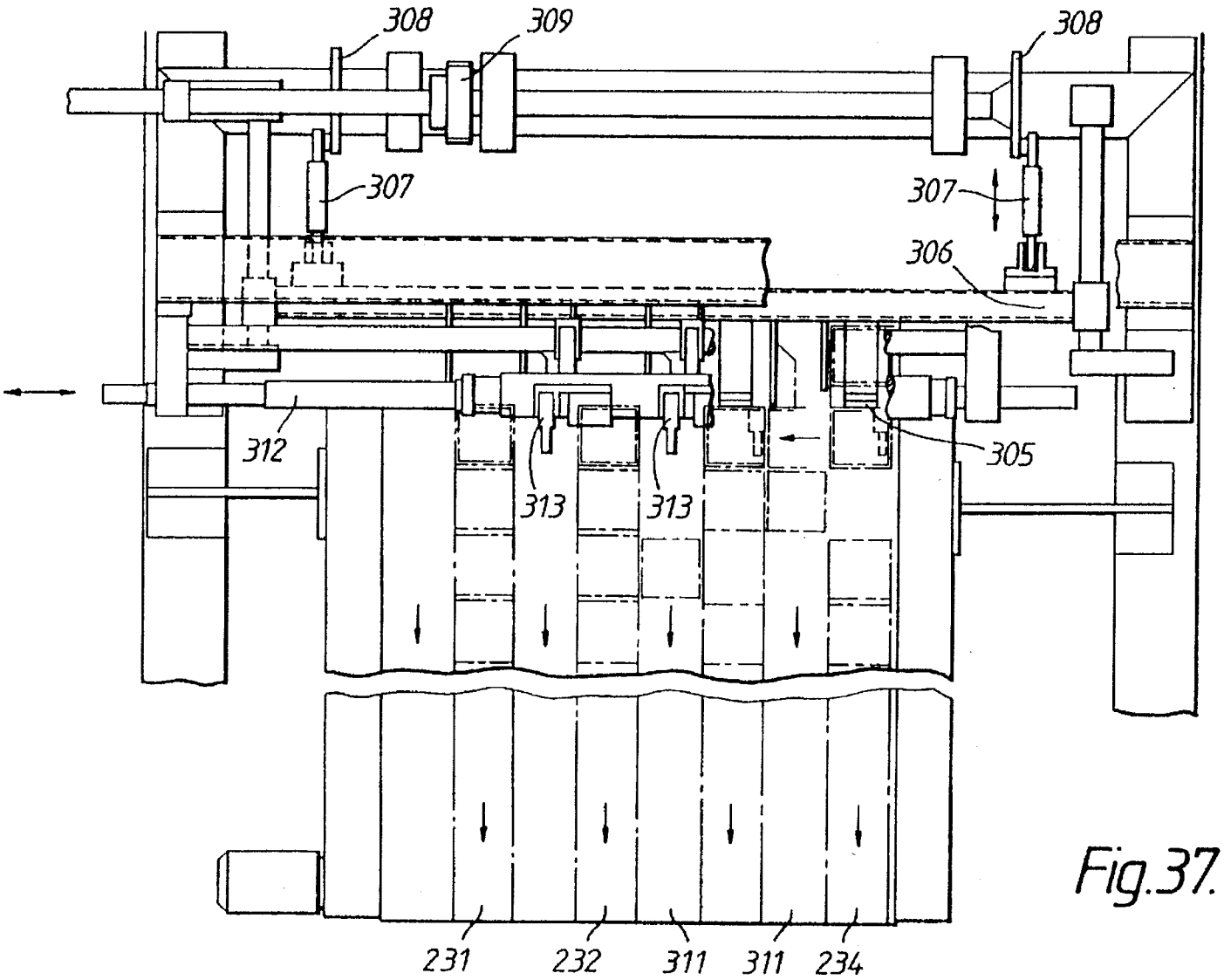
FIG. 37 shows a diagrammatic plan view of those assemblies.
Figure 38:
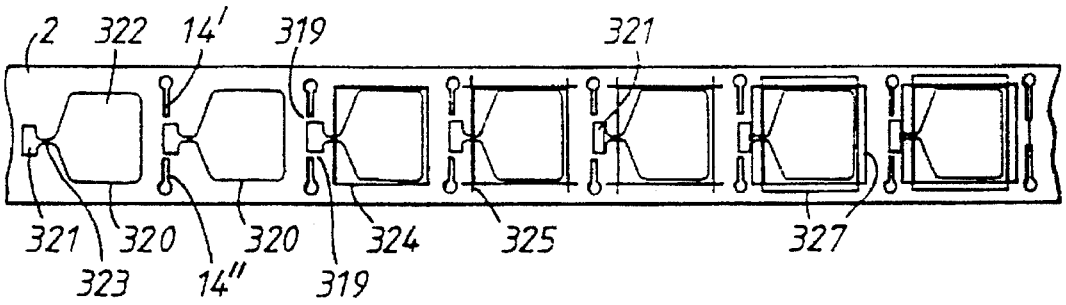
FIG. 38 shows a plan view of the forming of the closures from sheet material in a modified version of the packaging system.
Figure 39:
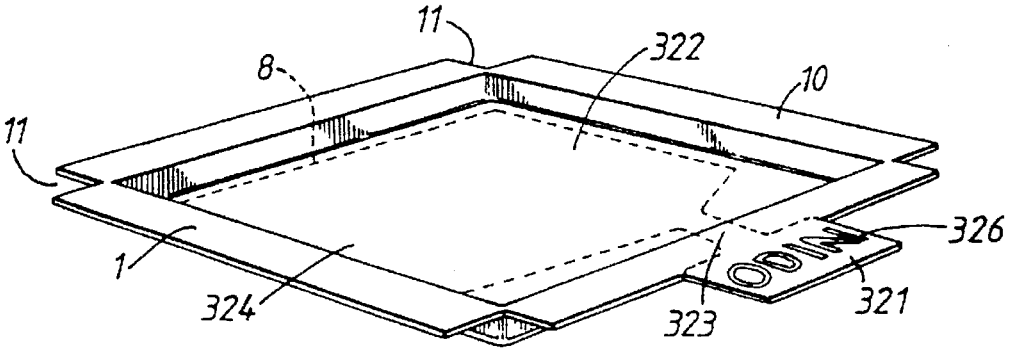
FIG. 39 shows a perspective view of one of the closures of the modified version prior to heat-sealing to a container.
Figure 40:
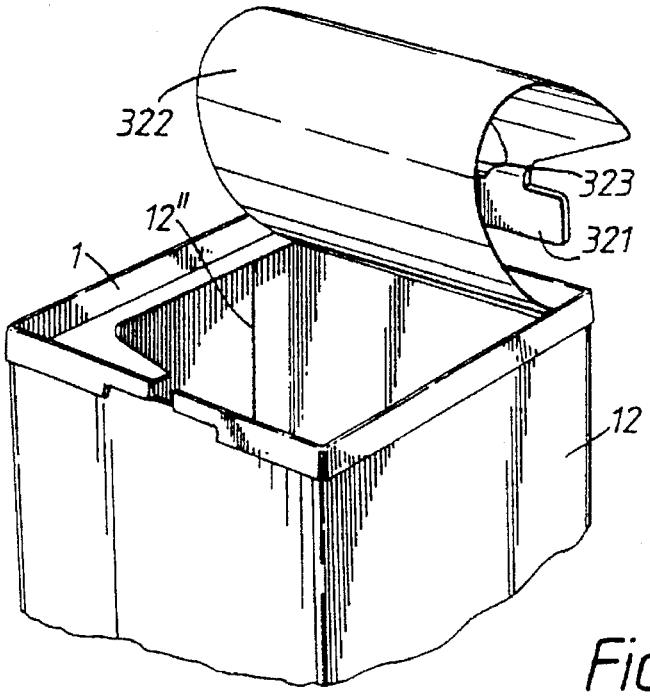
FIG. 40 shows a perspective view of the container of the modified system with its closure being opened.

The vertical transfer device 69, the reject assembly 126 and the discharge conveyor 70 will now be described in more detail with reference to FIGS. 36 and 37. The device 69 includes a vertical rack 303 vertically reciprocable by a pinion (not shown) driven by a stepper motor (also not shown). At its upper end, the rack 303 has fixed thereto a horizontal platform 304 extending beneath the four lanes of the conveyor 68 and vertically displacable by the rack 303 to lift four top-sealed cartons at a time to positions ahead of respective pusher plates 305 attached to a horizontally reciprocable transverse beam 306. The stepper motor can adjust its extent of angular movement to accommodate the range of carton heights. Articulated to respective ends of the beam 306 are two crank rods 307 articulated to crank discs 308 rotatable about a horizontal axis by means of a drive 309 including a single-revolution, wrap spring clutch on a constantly rotating drive shaft, the clutch being triggered on demand. The discharge conveyor 70 is in the form of a flat belt conveyor with four "approved" lanes 231,232,233 and 234 alternating with four "reject" lanes 311. Mounted upon a horizontal pin 312 reciprocable transversely of the lanes 231,232,233,234 and 311 are four reject devices 313 each comprised of an air-driven piston-and-cylinder device 314 connected, via a bell-crank lever 315 having a horizontal pivot 316, to a rejecting plate 317 which is thereby displaceable between a non-rejecting position shown in full lines at 317 in FIG. 36 and a rejecting position shown in dot-dash lines at 317' in FIG. 36, in which latter position the plate 317 is so inclined relative to the lanes 231,232,233,234, and 311 as to divert a rejected carton 12 from an approved lane onto an adjacent reject lane 311. The conveyor 70 is indexed by a stepper motor (not shown). The cartons 12 are raised by the device 69 from their positions shown in full lines in FIG. 36 into positions directly in front of the pusher plates 305 in their withdrawn condition 305' shown in dot-dash lines in FIG. 36. Then the four cartons are advanced forwards onto the discharge conveyor 70 by the advance of the pusher plates 305, any carton considered to be a "reject" owing to lack of product, or for whatever other reason, being moved sideways into the adjacent reject lane by the associated rejecting plate 317 inclined to the direction of advance of the carton. The lifting platform 304 occupies its uppermost position momentarily, to allow the cartons 12 to be advanced horizontally onto the conveyor 70. The conveyor 70 carries the approved cartons through for a destination separate from that of the reject cartons. The conveyor 70 is driven through a reduction gear box by a stepper motor 318 (see FIG. 8). The stepper motor 318 imparts a stepping motion to the conveyor 70 synchronised with the associated parts of the machine. The conveyor 70 is raisable to give access to the tank 265 and to assist replacement of its belt.

Referring to FIGS. 38 to 40 and 43, the top closure 1 is formed from a sheet material 2 consisting of a metal/thermoplastics laminate. The laminate is, for example, an aluminium layer 2B and a grey-pigmented LDPE layer 2D, the grey pigment being absorptive of infra-red radiation. The thickness of the metal layer 2B is advantageously between 100 and 200 microns, for example 200 microns, and the LDPE layer is advantageously of the same range, for example 160 microns. In a first stage of forming of the closure 1, a closed loop of weakness 320 is formed in the sheet material 2 to provide a manually seizable tab 321 connected to a tear panel 322 by way of a tear strip 323. The tab 321 is of rectangular form in plan view and the sheet material 2 is completely cut through around those three edges of the tab 321 further from the tear strip 323. It will be noted that the tab 321 is relatively wide whilst the tear strip 323 is relatively narrow. The width of the tear strip is advantageously less than 10 mm, preferably between 2 and 10 mm, for example between 3 and 5 mm. The innermost edge of the tab 321, the respective opposite edges of the tear strip 323 and the edges of the tear panel 322 are in the form of a score line made from the thermoplastics outer surface of the sheet material 2 and of a depth to extend completely through the thickness of the layer 2D and partly through the thickness of the layer 2B.

At a second stage, two transverse strips are cut out of the material 2 at respective opposite sides of the tab 321 to leave respective transverse slots 14' and 14" terminating short of the tab 321. Two narrow webs 319 thereby remain at respective opposite sides of the tab 321. The webs discourage the laminate above the tab 321 from moving too readily towards the drawing zone. As an alternative to the bridged slot 14 (bridged by the narrow webs 319), it is possible to provide a line of weakness, such as a score line, which will split during deep-drawing. In a third stage, the intended edges of the closure are clamped between two rectangular rings (not shown) encircling the tear panel 322 at a spacing therefrom, but clamping between them an outer part of the tear strip 323, and the zone encircled by the rings is drawn downwards and also outwards from the centre, in order to obtain sharp corners and to avoid wrinkling, a shallow rectangular recess 324 being thereby formed. At a fourth stage, there are formed, completely through the sheet material 2, 90° V-shaped incisions 325 whereof the apices are at the respective corners of the drawn-down recess 324 and whereof the sides are co-linear with respective edges of the recess 324. At a fifth stage, the tab 321 is ribbed, for example as at 326, to promote manual gripping of the tab for opening of the container. At a sixth stage, linear incisions 327 are made completely through the sheet metal 2 and extend parallelly to the edges of the recess 324 to meet the outer ends of the V-shaped incisions 325, to form the complete closure 1. The fourth and sixth stages may be combined form a single stage.

To attach the closure 1 thus formed to a filled container 12, which may consist of paperboard coated on both faces with thermoplastics, the closure is placed, aluminium-face first, upon the end of the mandrel 74 and is heated over its whole thermoplastics surface by the heaters 77 and 78 to above the melting temperature of the thermoplastics to sterilise the underneath surface of the closure and provide sufficient superheating of the closure to give sufficient stored heat to enable the closure to bond sealingly no the container 12 on application to the container. Then the drawn-down zone is fitted into the rectangular mouth of the container, and the four flanges 10 are folded down the outside of the rim of the mouth, the molten plastics of the closure re-flowing the polyethylene coating of the container and thus forming a good bond therewith.

The thickness of the thermoplastics layer 2D is sufficiently great than potential leakage of the gaps between the closure and the container, particularly at the cut longitudinal edge 12" of the sealing seam panel, are sealed. The thermoplastics layer 2D is also sufficiently thick to ensure that the score line cuts through the thermoplastics are filled during heat-sealing of the closure 1 to the rim of the mouth of the container 12. Since the closure thermoplastics is relatively transparent and the aluminium is reflective, the layer 2D incorporates the infra-red absorbing particles in the form of the grey pigment mentioned above.

To open the container, the pull tab 321 which, in fully closed condition, lies parallelly face-to-face against the adjacent side wall of the container 12, is seized between the thumb and fore-finger and pulled upwardly towards the opposite side wall of the container 12. This causes the innermost edge of the tab 321, the respective opposite edges of the tear strip 323 and the respective opposite edges of the tear panel 322 to tear along the score line forming part of the line of weakness 320. The arrangement whereby, prior to opening of the container, the tear strip 323 extends, from the tab 321, up the outside of the rim of the mouth of the container 12, over that rim and down the inside of that rim, ensures a good seal between the closure and the container even at the location of the tear strip 323. When the closure 1 is heat-sealed to the container 12, at least part of the tab 321 is heat-sealed to the adjacent side wall of the container 12, to render the closure tamper-evident. The tearing of the tab 321 or the tear strip 323 from the container 12 tends to occur through tearing of the paperboard of the container 12, since the polyethylene and the aluminium are less readily tearable than the paperboard. A particular advantage of making the tear strip 323 as narrow as reasonably practical is that this facilitates tearing-open of the closure through requiring the application of minimal force by the consumer. Such tearing is also facilitated by the fact that the scoring at respective opposite sides of the tear strip 323 is parallel to the intended sense of pull by the consumer to open the container. It is also particularly advantageous if the scoring at both sides of the tear strip 323 is along the grain of the crystalline structure of the aluminium layer 2B, since this again facilitates tearing-open.

Scoring through the sheet material 2 from the thermoplastics surface thereof rather than the aluminium surface thereof is particularly advantageous in that the thermoplastics is more difficult to score accurately than is the aluminium, particularly because it is more elastic than the aluminium, so that the desired depth of score can be more reliably obtained.

Nevertheless, it is likely that the score depth will vary significantly. However, the location of the pull tab 321 at an outer peripheral edge of the closure, as opposed to inwardly of the outer periphery of the closure, means that the tab can accommodate such significant variation in score depth, so as to promote reliable tearing.

Figure 41:
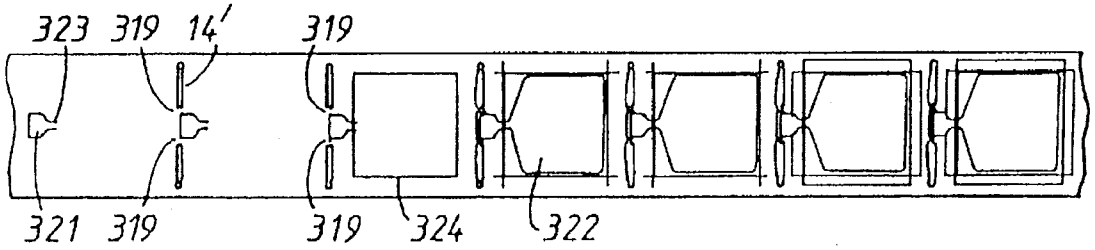
FIG. 41 shows a plan view of the forming of the closures from sheet material in a modification of the modified version of the system.
Figure 42:
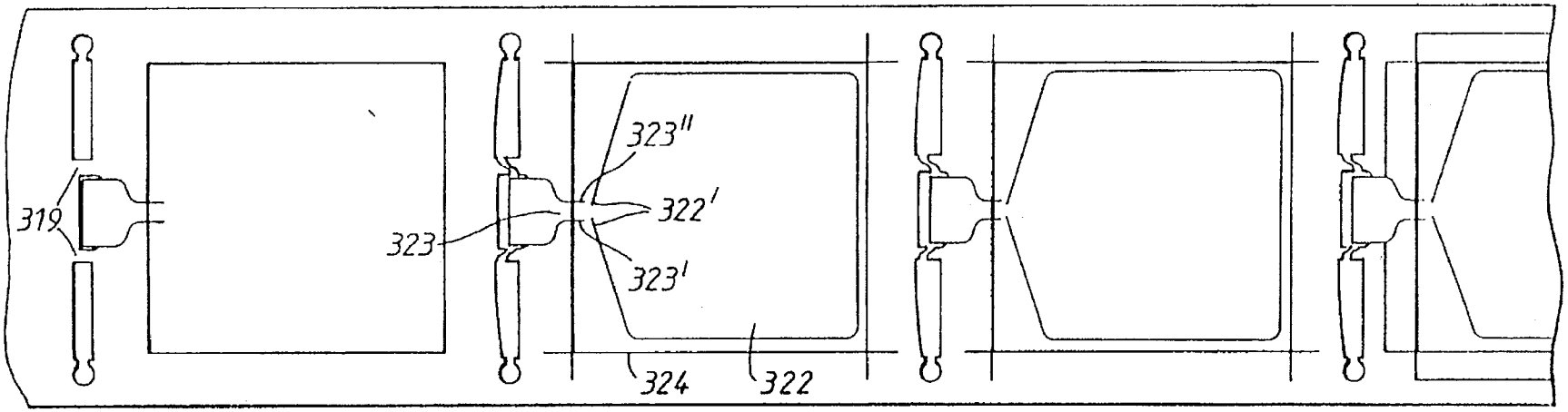
FIG. 42 shows a detail of FIG. 41.
Figure 43:
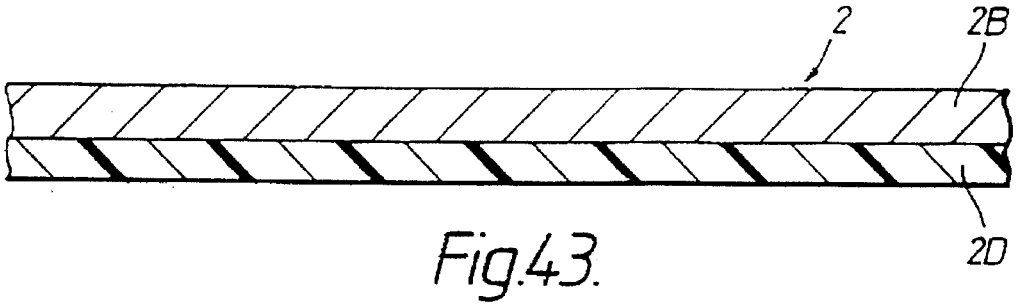
FIG. 43 shows a fragmentary vertical section through an embodiment of the closure of FIG. 38 or 41.

In certain circumstances, there may be a risk that the drawing of the sheet material 2 to form the recess 324 may tend to produce splits along the score line defining the tear panel 322. In order to avoid such risk, the modification described with reference to FIGS. 41 and 42 may be employed. In this modification, the pull tab 321 and the tear strip 323 are formed in the first stage, as in the first stage of FIG. 38, but the tear panel 322 is not formed until the fourth stage, i.e. until after the drawing to form the recess 324. In order to promote correct tearing, and as particularly shown in FIG. 42, the pair of ends 322' of the score line defining the tear panel 322 are located just inside the pair of score lines 323' and 323" bounding the tear strip 323. This accommodates a limited amount of misalignment of the pair of ends 322' with the pair of score lines 323' and 323" by using the naturally tendency for the tear paths of a tear strip without preformed lines of weakness to converge towards each other.

It is particularly advantageous for the tab 321 to be arranged at the middle of the edge of the closure 1, since the nearer it is arranged to a corner of the closure, the greater the likelihood of splitting of the score lines during drawing.

Figure 44:
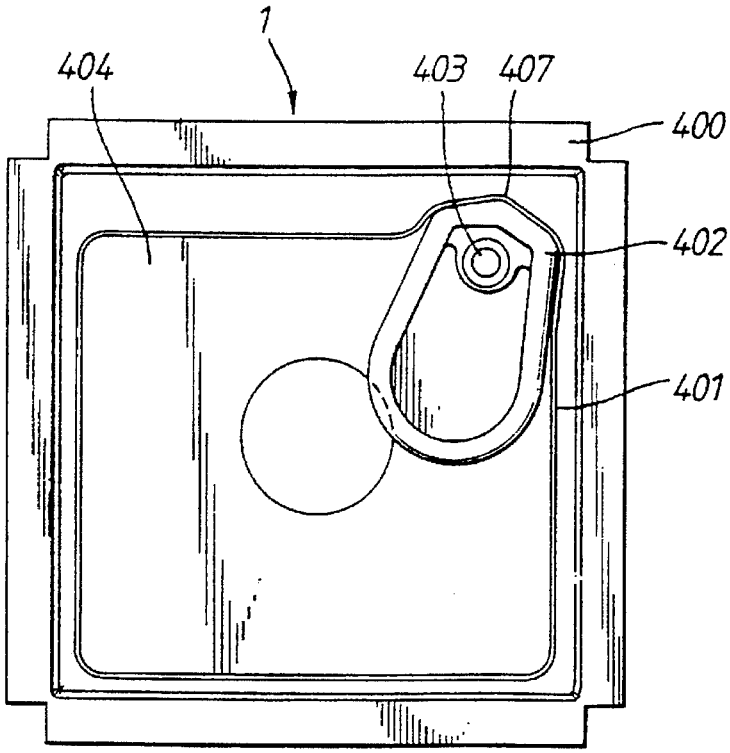
FIG. 44 shows a top plan view of a modified version of the closure.
Figure 45:
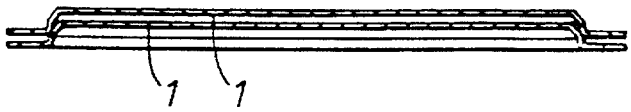
FIG. 45 shows a vertical section through two closures each according to FIG. 44 stacked one upon the other.

It is sometimes required that the closed containers and their contents should be suitable for heating in a domestic microwave oven. The closed container of the version of FIGS. 38, to 43 has the disadvantage that the discontinuities in the rim of the closure formed by the score lines defining the tab 321 and the strip 323 can produce arcing when heated in a microwave oven. This can lead to browning and in extreme cases burning of the adjacent paperboard of the container 12. FIG. 44 shows a closure 1 which does not react adversely when inserted into a domestic microwave oven. The closure 1 comprises a square shell 400 formed of the laminate of FIG. 43. The shell 400 has a scored opening profile 401 in the form of a closed loop in the drawn-down portion of the shell, together with a tab 402 attached by a rivet 403 to the shell 400. This tab 402 can be of any style, but preferably resembles a ring-pull. The preformed closure 1 is sterilised and sealed to a container 12 after product-filling. The container is opened by first lifting the tab 402, which breaks the scored profile 401 at a predetermined point 407. Then, by pulling the tab 402, access is gained as the continuous scored profile 401 is split. The resulting centre panel 404 can be completely removed and disposed via an aluminium waste stream.

Figure 46:
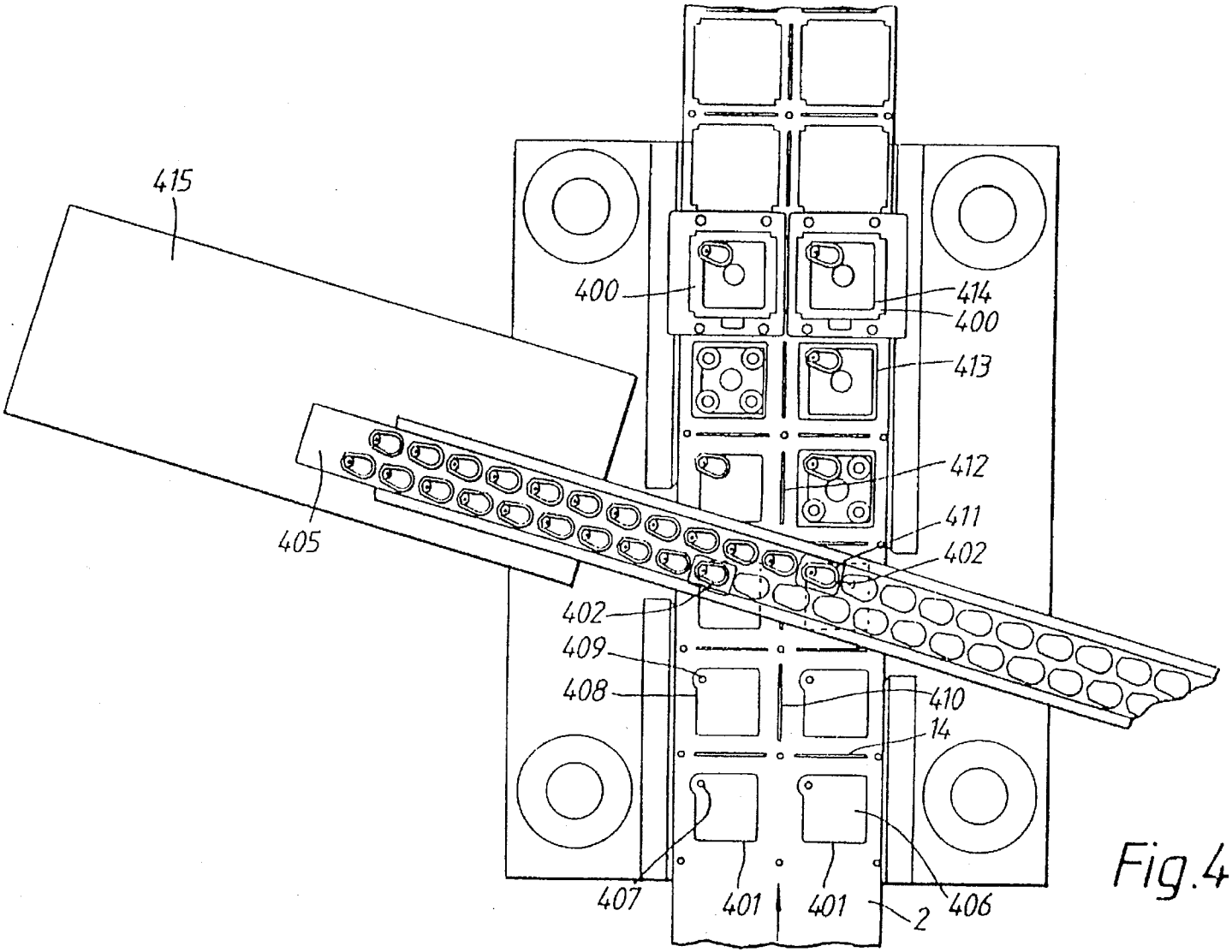
FIG. 46 shows a diagrammatic top plan view of a modified version of the machine for manufacturing closures.

Referring to FIG. 46, the closure 1 of FIG. 44 is manufactured from the web 2 of aluminium/LDPE laminate. The machine shown in FIG. 46 is a conversion press to which is fed not only the web 2 from which the shells 400 are formed, but also a metal strip 405 from which the tabs 402 are formed. At a first station 406 a pair of rivet domes 407 and a pair of score lines 401 are formed in the web 2. At a second station 408 the rivet domes 407 are formed into a pair of rivet buttons 409, whilst two transverse slots 14 and a central longitudinal slot 410 serving the same purpose as the slots 14 are formed through the web 2. At the next station 411, two tabs 402 are pressed from the strip 405 and placed over the two rivet buttons 409 and a pair of rivets 403 formed. The next station 412 is an idle station, the right-hand half of the web 2 being broken away in the Figure to show machine parts underneath. The web (2) is deep-drawn at the following station 413, the left-hand half of the web 2 again being broken away in the Figure. The two shells 400 are cropped out of the web 2 at the last station 414, the web 2 again being broken away in the Figure. The shells 200 are collated into the boxes 110. The machine includes a pressing device 415 in which two lanes of tabs 402 are formed in the strip 405, which is obliquely transversely inclined to the web 2 at an angle such that two tabs 402 in the respective lanes of tabs 402 repeatedly arrive directly above the buttons 409 of a pair of rivet buttons 409. The angle of approach of the strip 405 is chosen to optimise the operation by minimizing the number of stations along the web 2 and to provide the correct tab angle for the specific packaging application in question. The formation of the domes 407, the scored profiles 401 and the rivet buttons 409 and the attaching of the tabs 402 to the rivet buttons 409 are all carried out in the same horizontal plane to minimize distortion of the web 2 that occurs during forming, so that consistent relative positions of the scored profile 401, the tab 402 and the rivet 403 are maintained throughout production. A similar benefit is obtained in relation to the strip 405 from performing the pressing operations for the tabs 402 in a common horizontal plane. Moreover, because the transfer of the tabs 402 to the web 2 is performed at a single level, the transfer apparatus need not be complicated. Although two lanes are shown for each of the web 2 and the strip 405, another number is possible. The shape of the closure 1 produced is not critical. The sequence of operations can be varied; for example in an alternative sequence the pair of rivet domes 407 is formed at the first station, the pair of scored profiles 401 at the second station and the pair of rivet buttons 409 at a third station, then the tabs 402 are applied and the rivets 403 formed at a fourth station, the slots 14 and 410 formed at a fifth station, the web 2 deep-drawn at a sixth station and the shells 400 cropped at a final station. The machine version shown in FIG. 46 also has the advantage of combining the formation of the shells 400 and the tabs 402, accurate location of the rivet points, and assembly and cropping of the final closures 1 all within a single machine.

INDUSTRIAL APPLICABILITY

This invention is applicable to packaging closures, to machines for the manufacture of packaging closures and to packaging machines, inter alia.

We claim:

1. A method comprising mounting a box upon a support from which a guide surface extends downwards away from a downwardly directed mouth of said box, vibrating said box and thus a stack of closures therein to cause the closures to exit from said mouth and as an inclined stack advance down said guide surface, providing a row of open-topped containers one behind another, thereafter dividing the row of open-topped containers into a plurality of rows of open-topped containers, filling the open-topped containers in the plurality of rows, and subsequently closing the open tops of the containers with respective said closures, the open-topped containers being formed on container-forming apparatus before said dividing occurs and the filling of the open-topped containers in the plurality of rows occurring in all of said plurality of rows substantially simultaneously.

2. A method according to claim 1, and further comprising, after guiding said closures inclinedly downwards but before applying said closures to said containers, advancing said closures in a row to an opening of dimensions to abut peripheral portions of a leading closure of the row, and forcing the closures in turn through the opening, whereby, owing to the abutment by said peripheral portions, each closure flexes sufficiently to pass through said opening.

3. A method according to claim 1, and further comprising, after guiding said closures inclinedly downwards, guiding said closures inclinedly upwards.

4. A method according to claim 1 and further comprising, before mounting said box upon said support, displacing said box transversely of said support to align said box with said support prior to loading of said box onto said support.

5. Packaging apparatus, comprising container-conveying means including a lane which carries a row of open-topped containers and which divides into a plurality of lanes, filling means at said plurality of lanes arranged to fill a plurality of rows of said open-topped containers, top-closing means arranged to close the tops of the containers in said plurality of lanes, forming means at said lane arranged to form the containers of said row of open-topped containers, said filling means comprising a plurality of fillers at the respective lanes of said plurality of lanes, a support arranged to support a box containing a stack of closures for said containers, a guide surface extending inclinedly downwards from said support for guiding inclinedly downwards said stack of closures exiting from a mouth of said box, and vibrating means arranged to vibrate said box, said support being arranged to support said box in such a condition that said mouth of said box is directed inclinedly downwards.

6. Apparatus according to claim 5, and further comprising, after said guide surface, an opening of dimensions to abut peripheral portions of a leading closure of a row of said closures, said vibrating means serving to advance said row of articles to force said closures in turn through said opening, whereby, owing to abutment by said peripheral portions, each closure flexes to pass through said opening.

7. Apparatus according to claim 5, wherein, after extending inclinedly downwards, said guide surface continues inclinedly upwards.

8. Apparatus according to claim 5, and further comprising a holder serving to hold said box and displaceable transversely of said support to align said holder with said support.

9. A packaging method, comprising providing a row of open-topped containers one behind another, thereafter dividing the row of open-topped containers into a plurality of rows of open-topped containers, filling the open-topped containers in the plurality of rows, and subsequently closing the open tops of the containers, wherein the open-topped containers are formed on container-forming apparatus before said dividing occurs and the filling of the open-topped containers in the plurality of rows occurs in all of said plurality of rows substantially simultaneously, and wherein said dividing comprises lowering the leading container in said row to a first position, shifting said leading container laterally to a second position, lowering the next container in said row to said first position, and subsequently advancing those two containers side-by-side.

10. A method according to claim 9, and further comprising, between the aforesaid shifting of said leading container and the aforesaid lowering of said next container, on the one hand, and said advancing of said two containers, on the other hand, shifting said two containers laterally to said second position and a third position, respectively, and lowering the second next container in said row to said first position.

11. A method according to claim 9, and further comprising, immediately before those two containers are advanced side-by-side as aforesaid, lowering those two containers from the second and third positions, respectively, into respective positions at the trailing ends of said plurality of rows.

12. A method according to claim 9, and further comprising rejecting one of said container by shifting said one of said containers laterally oppositely to the aforesaid shifting of said leading container after lowering of said one of said containers into said first position.

13. Packaging apparatus, comprising container-conveying means including a lane which carries a row of open-topped containers and which divides into a plurality of lanes, filling means at said plurality of lanes arranged to fill a plurality of rows of said open-topped containers, top-closing means arranged to close the open tops of the containers in said plurality of lanes, forming means at said lane arranged to form the containers of said row of open-topped containers, said filling means comprising a plurality of fillers at the respective lanes of said plurality of lanes, and said container-conveying means including means serving to lower the containers in said row one-by-one to a first position, laterally conveying means serving to convey the containers one-by-one laterally from said first position to a second position and to convey the containers one-by-one laterally from said second position to a third position, and means serving to lower the respective containers at the second and third positions to respective positions in said plurality of lanes.

14. Apparatus according to claim 13, wherein said laterally conveying means is operable to reject one of said containers by conveying the same laterally from said first position away from said second position.

15. Apparatus according claim 13, wherein said laterally conveying means comprises first and second endless elongate flexible members spaced apart horizontally and arranged to grip the containers horizontally between them.

16. Apparatus according to claim 15, wherein, at said first position, the horizontal spacing between said members is too great for said members to be able to grip the containers between them, but, at the second and third positions, the horizontal spacing between said members is sufficiently less that said members can grip the containers between them, said apparatus including means serving to advance said containers from said first position to said second position.

17. Apparatus according to claim 16, wherein said means serving to advance said containers comprises projections carried by said members.

18. Apparatus according to claim 13, wherein said means serving to lower said respective containers from said second and third positions comprises suction cup means.

19. A packaging method, comprising providing a row of open-topped containers one behind another, thereafter dividing the row of open-topped containers into a plurality of rows of open-topped containers, filling the open-topped containers in the plurality of rows, and subsequently closing the open tops of the containers, wherein the open-topped containers are formed on container-forming apparatus before said dividing occurs and the filling of the open-topped containers in the plurality of rows occurs in all of said plurality of rows substantially simultaneously, wherein said containers are advanced in said rows in a system of lanes substantially parallel to each other and to said rows, and selected containers are removed by displacing the selected containers transversely of said system, and wherein said selected containers are removed as aforesaid into reject lanes substantially parallel to the first-mentioned lanes and are then advanced along said reject lanes.

20. Packaging apparatus, comprising container-conveying means including a lane which carries a row of open-topped containers and which divides into a plurality of lanes, filling means at said plurality of lanes arranged to fill a plurality of rows of said open-topped containers, top-closing means arranged to close the open tops of the containers in said plurality of lanes, forming means at said lane arranged to form the containers of said row of open-topped containers, said filling means comprising a plurality of fillers at the respective lanes of said plurality of lanes, said container-conveying means comprising longitudinal container-conveying means for advancing said containers in said rows, which are substantially parallel to each other and to said lanes, and transverse container-conveying means arranged to remove selected containers transversely of said lanes, there being among said lanes a plurality of reject lanes for advancing said selected containers removed.

21. Packaging apparatus, comprising container-conveying means including a lane which carries a row of open-topped containers and which divides into a plurality of lanes, filling means at said plurality of lanes arranged to fill a plurality of rows of said open-topped containers, top-closing means arranged to close the open tops of the containers in said plurality of lanes, forming means at said lane arranged to form the containers of said row of open-topped containers, said filling means comprising a plurality of fillers at the respective lanes of said plurality of lanes, said container-conveying means comprising longitudinal container-conveying means for advancing said containers in said rows, which are substantially parallel to each other and to said lanes, and transverse container-conveying means arranged to remove selected containers transversely of said lanes, said lanes being provided upon an endless belt of said container-conveying means.

22. Packaging apparatus, comprising container-conveying means including a lane which carries a row of open-topped containers and which divides into a plurality of lanes, filling means at said plurality of lanes arranged to fill a plurality of rows of said open-topped containers, top-closing means arranged to close the open tops of the containers in said plurality of lanes, forming means at said lane arranged to form the containers of said row of open-topped containers, said filling means comprising a plurality of fillers at the respective lanes of said plurality of lanes, said container-conveying means comprising longitudinal container-conveying means for advancing said containers in said rows, which are substantially parallel to each other and to said lanes, and transverse container-conveying means arranged to remove selected containers transversely of said lanes, said transverse container-conveying means comprising endless elongate flexible members spaced apart and arranged to grip said selected containers between them.

23. Packaging apparatus, comprising container-conveying means including a lane which carries a row of open-topped containers and which divides into a plurality of lanes, filling means at said plurality of lanes arranged to fill a plurality of rows of said open-topped containers, top-closing means arranged to close the open tops of the containers in said plurality of lanes, forming means at said lane arranged to form the containers of said row of open-topped containers, said filling means comprising a plurality of fillers at the respective lanes of said plurality of lanes, an operating member for operating upon the containers, a rotary drive, and a linkage interconnecting said drive and said member and arranged to convert rotary motion of said drive into substantially rectilinear motion of an operating portion of said member, all sliding surfaces of said linkage being substantially exclusively pairs of co-extensive annular rotary sliding surfaces.

24. Apparatus according to claim 23, wherein said linkage resembles a "Watt" linkage.

25. A packaging method, comprising providing a row of open-topped containers one behind another, thereafter dividing the row of open-topped containers into a plurality of rows of open-topped containers, filling the open-topped containers in the plurality of rows, and subsequently closing the open tops of the containers, wherein the open-topped containers are formed on container-forming apparatus before said dividing occurs and the filling of the open-topped containers in the plurality of rows occurs in all of said plurality of rows substantially simultaneously, wherein the containers are conveyed by resiliently gripping the containers between leading and trailing bars, and advancing the bars and thus the containers, and wherein said containers are conveyed by additionally locating said containers immediately at the front of other trailing bars lower than the first-mentioned trailing bars, and also advancing said other trailing bars.

26. A method according to claim 25, and further comprising adjusting the level of said other trailing bars in dependence upon the height dimension of said containers.

27. A packaging method, comprising providing a row of open-topped containers one behind another, thereafter dividing the row of open-topped containers into a plurality of rows of open-topped containers, filling the open-topped containers in the plurality of rows, and subsequently closing the open tops of the containers, wherein the open-topped containers are formed on container-forming apparatus before said dividing occurs and the filling of the open-topped containers in the plurality of rows occurs in all of said plurality of rows substantially simultaneously, wherein the containers are conveyed by resiliently gripping the containers between leading and trailing bars, and advancing the bars and thus the containers, and wherein the level of base guides for said containers is adjusted in dependence upon the height dimension of said containers.

28. A packaging method, comprising providing a row of open-topped containers one behind another, thereafter dividing the row of open-topped containers into a plurality of rows of open-topped containers, filling the open-topped containers in the plurality of rows, and subsequently closing the open tops of the containers, wherein the open-topped containers are formed on container-forming apparatus before said dividing occurs and the filling of the open-topped containers in the plurality of rows occurs in all of said plurality of rows substantially simultaneously, wherein the containers are conveyed by resiliently gripping the containers between leading and trailing bars, and advancing the bars and thus the containers, and wherein the containers are resiliently gripped between the bars at locations spaced below the tops of the containers.

29. Packaging apparatus, comprising container-conveying means including a lane which carries a row of open-topped containers and which divides into a plurality of lanes, filling means at said plurality of lanes arranged to fill a plurality of rows of said open-topped containers, top-closing means arranged to close the open tops of the containers in said plurality of lanes, forming means at said lane arranged to form the containers of said row of open-topped containers, said filling means comprising a plurality of fillers at the respective lanes of said plurality of lanes, wherein said container-conveying means comprises leading and trailing rigid bars for receiving said containers therebetween, advancing means arranged to advance the bars and thus the containers therebetween, biassing means arranged to cause the bars to bear against the containers, and other trailing bars at a lower level than, but advanced with, the first-mentioned trailing bars for pressing against trailing portions of said containers lower than those portions thereof gripped between said leading and trailing bars.

30. Apparatus according to claim 29 and further comprising adjusting means arranged to adjust the level of said other trailing bars.

31. Apparatus according to claim 30, wherein said adjusting means comprises guide members extending in the direction of advance of said leading and trailing bars and vertically adjustable relative to said leading and trailing bars.

32. Packaging apparatus, comprising container-conveying means including a lane which carries a row of open-topped containers and which divides into a plurality of lanes, filling means at said plurality of lanes arranged to fill a plurality of rows of said open-topped containers, top-closing means arranged to close the open tops of the containers in said plurality of lanes, forming means at said lane arranged to form the containers of said row of open-topped containers, said filling means comprising a plurality of fillers at the respective lanes of said plurality of lanes, and said container-conveying means comprising leading and trailing rigid bars for receiving said containers therebetween, advancing means arranged to advance the bars and thus the containers therebetween, and biassing means arranged to cause the bars to bear against the containers therebetween, and base guides for said containers and vertically adjustable relative to said leading and trailing bars.

33. Packaging apparatus, comprising container-conveying means including a lane which carries a row of open-topped containers and which divides into a plurality of lanes, filling means at said plurality of lanes arranged to fill a plurality of rows of said open-topped containers, top-closing means arranged to close the open tops of the containers in said plurality of lanes, forming means at said lane arranged to form the containers of said row of open-topped containers, said filling means comprising a plurality of fillers at the respective lanes of said plurality of lanes, and said container-conveying means comprising leading and trailing rigid bars for receiving said containers therebetween, advancing means arranged to advance the bars and thus the containers therebetween, and biassing means arranged to cause the bars to bear against the containers therebetween, said bars being of substantially circular cross-section.

* * * * *